US006749908B2

(12) United States Patent
Tsurumi

(10) Patent No.: US 6,749,908 B2
(45) Date of Patent: Jun. 15, 2004

(54) MULTICOLOR HEAT-SENSITIVE RECORDING MATERIAL

(75) Inventor: Mitsuyuki Tsurumi, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 162 days.

(21) Appl. No.: 10/201,493

(22) Filed: Jul. 24, 2002

(65) Prior Publication Data

US 2003/0114305 A1 Jun. 19, 2003

(30) Foreign Application Priority Data

Aug. 2, 2001 (JP) ..... 2001-235372

(51) Int. Cl.[7] ..... B41M 5/26; B41M 5/41
(52) U.S. Cl. ..... 428/32.77; 503/204
(58) Field of Search ..... 428/32.77; 503/204

(56) References Cited

FOREIGN PATENT DOCUMENTS

| | | | |
|---|---|---|---|
| JP | 08175015 A | * | 7/1996 |
| JP | 2000289338 A | * | 10/2000 |
| JP | 2003112478 A | * | 4/2003 |

* cited by examiner

*Primary Examiner*—N. Edwards
(74) *Attorney, Agent, or Firm*—Sughrue Mion, PLLC

(57) ABSTRACT

Disclosed is a multicolor heat-sensitive recording material at least having a yellow-forming heat-sensitive recording material, a cyan-forming heat-sensitive recording material, and a magenta-forming heat-sensitive recording material disposed on a support, characterized in that, if laminates are made of a transparent support, a single layer of these heat-sensitive recording layers, and a protective layer in the order listed, the haze values of the laminates are all not greater than 40.

18 Claims, No Drawings

MULTICOLOR HEAT-SENSITIVE RECORDING MATERIAL

BACKGROUND OF THE INVENTION

1. Field of the Invention

The present invention relates to a multicolor heat-sensitive recording material, and more particularly relates to a multicolor heat-sensitive recording material comprising a support having disposed thereon at least three heat-sensitive recording layers.

2. Description of the Related Art

Heat-sensitive recording has developed in recent years because recording apparatus therefor are simple, reliable, and maintenance-free. Materials using the reaction between an electron-donating colorless dye and an electron-accepting compound, and materials that utilize the reaction between a diazo compound or a diazonium salt (may be referred to below simply as "diazo compound or the like") and a coupler, are widely known as materials for heat-sensitive recording.

The development of multicolor heat-sensitive recording materials in recent years has also been remarkable. Such multicolor heat-sensitive recording materials comprise a support having disposed thereon a yellow-forming layer, a magenta-forming layer, and a cyan-forming layer. A multicolor image is formed thereon by heating the respective layers imagewisely.

Multicolor heat-sensitive recording materials typically employ a combination of a color-forming layer (heat-sensitive recording layer) that comprises an electron-donating colorless dye and an electron-accepting compound and a color-forming layer that comprises a diazo compound or the like and a coupler. Generally, the support is successively disposed with the yellow-forming layer, the magenta-forming layer, and the cyan-forming layer.

Image stability inmulticolor heat-sensitive recording materials can be enhanced by utilizing photodecomposition of the diazo compound or the like to irradiate the entire surface of the heat-sensitive recording material after an image has been formed and thereby fix the image. In order to effectively photofix the image, the lowermost layer (i.e., the layer closest to the support) is often a cyan-forming layer comprising an electron-donating colorless dye and an electron-accepting compound. However, there has been a demand for further improvement of image stability with respect to such photofixable heat-sensitive recording materials.

Another large issue has been to enhance color formability. However, multicolor heat-sensitive recording materials that utilize the reaction between an electron-donating colorless dye and an electron-accepting compound are problematic in terms of image stability because the reaction is an equalizing reaction. Further, because the content of the electron-accepting compound must be higher than that of the electron-donating colorless dye, the color-forming layer that contains the electron-donating colorless dye becomes thicker in comparison with the color-forming layer that contains the diazo compound or the like. A thicker color-forming layer results in a thicker multicolor heat-sensitive recording material, which adversely affects color formability.

There is also a problem with conventional multicolor heat-sensitive recording materials in that, when the upper layers are opaque, fixing light is not effectively utilized and fixation takes longer. Additionally, when the upper layers are opaque, the hues of the color-forming layers become turbid and color reproduction regions shrink.

There is another problem in that whiteness cannot be sufficiently enhanced even if a fluorescent brightener is added.

When conventional multicolor recording materials are used as materials for overhead projectors, there is also a problem in that the background is undesirably colored.

SUMMARY OF THE INVENTION

In view of the problems described above, an object of the present invention is to provide a multicolor recording material that exhibits high sensitivity during fixation, excellent whiteness, and good hues.

Another object of the invention is to provide a multicolor recording material that has high transparency and is suitable for use with overhead projectors.

A first aspect of the invention provides a multicolor heat-sensitive recording material comprising a support having disposed thereon at least a yellow-forming heat-sensitive recording layer, a cyan-forming heat-sensitive recording layer, and a magenta-forming heat-sensitive recording layer, wherein when any one of the heat-sensitive recording layers is disposed on a transparent support and a protective layer is disposed on the any one of the heat-sensitive recording layers, a haze value of the resultant laminate is no greater than 40.

A second aspect of the invention provides a multicolor heat-sensitive recording material comprising a transparent support having disposed thereon a yellow-forming heat-sensitive recording layer, a cyan-forming heat-sensitive recording layer, a magenta-forming heat-sensitive recording layer, and a protective layer, wherein the haze value of the recording material is no greater than 50.

DETAILED DESCRIPTION OF THE PREFERRED EMBODIMENT

According to the first embodiment, the multicolor heat-sensitive recording material of the invention at least has a support having disposed thereon at least a yellow-forming heat-sensitive recording layer, a cyan-forming heat-sensitive recording layer, and a magenta-forming heat-sensitive recording layer, and when any one of the heat-sensitive recording layers is disposed on a transparent support and a protective layer is disposed on the any one of the heat-sensitive recording layers, a haze value of the resultant laminate is no greater than 40.

According to this embodiment of the multicolor heat-sensitive recording material, when a laminate is made by sandwiching any one of a yellow-forming heat-sensitive recording layer, a cyan-forming heat-sensitive recording layer and a magenta-forming heat-sensitive recording layer between a transparent support and a protective layer, the haze value of the laminate is no greater than 40. In other words, the heat sensitive recording layers which are designed such that, when a laminate is made by sandwiching any one of the heat-sensitive recording layers between a transparent support and a protective layer, the haze value of the laminate is not greater than 40 are laminated on a support. Because of this construction, the transparency of the heat-sensitive layers becomes higher and the fixing light can be effectively utilized. As a result, the fixing speed is raised. In addition, since every heat-sensitive layer has a high transparency, the color of the recording material does not look turbid.

The multicolor heat-sensitive recording material according to this embodiment may further has an intermediate layer and a light transmittance-adjusting layer. Also in the case where an intermediate layer and a light transmittance-adjusting layer are provided, it is preferable that the haze value of the material produced by laminating, on a transparent support, the intermediate layer or the light transmittance-adjusting layer and a protective layer in that order is no greater than 40. The details of the intermediate layer and the light transmittance-adjusting layer are described later.

The haze value as used herein means the value in percentage (%) obtained by dividing the diffuse transmittance by the total light transmittance (i.e., diffuse transmittance÷total light transmittance×100). The smaller the haze value is, the better the transparency is.

As stated above, if a laminate is made by sandwiching any of the heat-sensitive recording layers between a transparent support and a protective layer, the haze value of the laminate is no greater than 40. This value is preferably no greater than 35 and more preferably no greater than 30. If the haze value exceeds 40, the transparency is lowered and the objective of the invention cannot be achieved.

Examples of the transparent support include synthetic polymer films such as polyester films, e.g., polyethylene terephthalate and polybutylene terephthalate; cellulose triacetate films; and polyolefin films, e.g., polypropylene and polyethylene. These films may be used alone or as laminates thereof.

The thickness of the synthetic polymer film is preferably 25 to 250 $\mu$m and more preferably 50 to 200 $\mu$m.

The haze value of the transparent support itself is preferably not greater than 10.

If necessary, the protective layer may be made by laminating two or more layers. Examples of the material to be used in the protective layer include water-soluble polymeric compounds such as polyvinyl alcohol, carboxy-modified polyvinyl alcohol, vinyl acetate/acrylamide copolymers, silicon-modified polyvinyl alcohol, starch, modified starch, methyl cellulose, carboxymethyl cellulose, hydroxymethyl cellulose, gelatins, gum arabic, casein, hydrolyzates of styrene/maleic acid copolymers, hydrolyzates of styrene/maleic acid copolymer half esters, hydrolyzates of isobutylene/maleic anhydride copolymers, polyacrylamide derivatives, polyvinyl pyrrolidone, sodium polystyrenesulfonate, and sodium alginate; and latices such as styrene/butadiene rubber latex, acrylonitrile/butadiene rubber latex, methyl acrylate/butadiene rubber latex, and vinyl acetate emulsion.

Storage stability can be further improved by crosslinking the water-soluble polymeric compounds. The crosslinking agents can be selected from conventionally known crosslinking agents. Examples of the crosslinking agents include N-methylol urea, N-methylol melamine, and water-soluble initial-stage condensation products such as urea/formalin; dialdehyde compounds such as glyoxal and glutaraldehyde; inorganic crosslinking agents such as boric acid and borax; and polyamide epichlorohydrin.

In addition, a conventionally known pigment, a metal soap, a waxe, a surfactant, and the like may be used in the protective layer.

The coating weight of the protective layer is preferably 0.2 to 5 g/m$^2$, and more preferably 0.5 to 2 g/m$^2$. The thickness is preferably 0.2 to 5 $\mu$m and more preferably 0.5 to 2 $\mu$m.

When a protective layer is provided, a conventionally known ultraviolet light absorbent or a precursor thereof may be incorporated in the protective layer.

The protective layer can be formed by a conventionally known coating method as in the case where a light-sensitive, heat-sensitive recording layer is formed on a support.

Examples of the support that can be used in this embodiment include plastic films, paper, plastic resin-laminated paper, synthetic paper, etc.

According to the second embodiment, the multicolor heat-sensitive recording material of the invention has a transparent support having disposed thereon a yellow-forming heat-sensitive recording layer, a cyan-forming heat-sensitive recording layer, a magenta-forming heat-sensitive recording layer, and a protective layer, and the haze value of the multicolor heat-sensitive recording material is no greater than 50. Accordingly, the multicolor heat-sensitive recording material of the embodiment can be advantageously used in such applications as over head projectors sheets and color slides.

In the multicolor heat-sensitive recording material of this embodiment, although the haze value of the recording material is no greater than 50, the haze value is preferably no greater than 45 and more preferably no greater than 40. If the haze value exceeds 50, the transparency is so reduced that the use as an overhead projector material is difficult.

The transparent support and the protective layer in this embodiment of the multicolor heat-sensitive recording material are the same as those previously described in the first embodiment.

In any of the embodiments described above, it is preferable that each of the heat-sensitive recording layers contains a diazo compound and/or a diazonium salt and a coupler compound which reacts with the diazo compound and/or the diazonium salt to form the respective colors.

In any of the embodiments described above, a light transmittance-adjusting layer and an intermediate layer may be provided.

The light transmittance-adjusting layer contains a component functioning as an ultraviolet light absorbent precursor which does not function as an ultraviolet light absorbent before the irradiation with light having wavelengths in the region required for fixation. For this reason, the light transmittance-adjusting layer has a high light transmittance and sufficiently transmits the light having wavelengths in the region required for fixation. In addition, the light transmittance-adjusting layer has a high transmittance of visible light. Accordingly, the light transmittance-adjusting layer does not hinder the fixation of the heat-sensitive layers. The characteristics of the light transmittance-adjusting layer can be selected in accordance with the characteristics of the photofixable heat-sensitive recording layers.

The ultraviolet light absorbent precursor functions as an ultraviolet light absorbent as a result of reaction caused by light or heat after the irradiation with light having wavelengths in the region required for fixation of the photofixable heat-sensitive recording layer. Accordingly, since most of the light having wavelengths in the ultraviolet region and required for fixation is absorbed by the ultraviolet light absorbent and the transmittance of the ultraviolet lay drops, the lightfastness of the heat-sensitive recording material is improved. But, since the ultraviolet light absorbent does not absorb visible light, the transmittance of visible light does not change substantially.

In the invention, a compound described, for example, in Japanese Patent Application Laid-Open (JP-A) No. 9-1928 can be used as the compound to be incorporated in the light transmittance-adjusting layer.

It is preferable that at least one light transmittance-adjusting layer is provided in the photofixable heat-sensitive recording material. It is most preferable that the light transmittance-adjusting layer is formed between a photofixable magenta heat-sensitive recording layer and, as the outer most layer, the protective layer.

An intermediate layer is provided for the prevention of color mixing between the light-sensitive, heat-sensitive recording layers. It is preferable that the intermediate layer comprises a water-soluble polymeric compound such as gelatin, phthalated gelatin, polyvinyl alcohol, or polyvinyl pyrrolidone. If necessary, the intermediate layer may contain various additives.

When a material, which has a high $O_2$ transmittance, such as laminated paper is used as a support, the lightfastness can be improved by providing a primer layer as an $O_2$ barrier layer.

In order to improve the color mixing-preventive performance and lightfastness by a smaller thickness of the intermediate layer or primer layer, it is effective to incorporate the swellable inorganic laminar compound described in the Japanese Patent Application No. 7-113825 into the intermediate layer or primer layer.

Next, a preferred layer construction of the multicolor heat-sensitive recording material of the invention is explained below. Preferably, the multicolor heat-sensitive recording material of the invention comprises a yellow-forming heat-sensitive recording layer, a cyan-forming heat-sensitive recording layer, and a magenta-forming heat-sensitive recording layer on a support in that order. Preferably, the color-forming layers include a diazo compound or the like and a coupler. More specifically, for example, a preferred construction comprises, a heat-sensitive recording layer containing a diazo compound or the like whose maximum absorption wavelength is 350 nm or less and a coupler capable of reacting with the diazo compound or the like to form a yellow color, a photofixable heat-sensitive recording layer containing a diazo compound or the like whose maximum absorption wavelength is 370±30 nm and a coupler capable of reacting with the diazo compound or the like to form a cyan color, and a photofixable heat-sensitive recording layer containing a diazo compound or the like whose maximum absorption wavelength is 430±30 nm and a coupler capable of reacting with the diazo compound or the like to form a magenta color on a support in that order. In the construction described above, although the yellow-forming heat-sensitive recording layer may be of a non-fixation type, the yellow-forming heat-sensitive recording layer may be of a photofixable heat-sensitive recording layer so as to further enhance the image stability.

In the heat-sensitive recording material of the invention, it is preferable to provide a light transmittance-adjusting layer and an outermost protective layer on a heat-sensitive layer, particularly on a magenta heat-sensitive recording layer. In particular, it is preferable to provide a light transmittance-adjusting layer, whose transmittance to the light having wavelengths within the region to be used for light-fixation diminishes after fixation, between a photofixable magenta heat-sensitive recording layer and a protective layer. In the case of such a heat-sensitive recording material, it is preferable that the light transmittance after the fixation and irradiation with light is not greater than 10% at 350 nm. In this case, the irradiation with light means the irradiation with light of 13 kJ/$m^2$ at a wavelength of 420 nm by means of a xenon-lamp forced radiation tester. More specifically, the irradiation with light means the irradiation with light of 0.9W/$m^2$ for 4.0 hours by means of Weather-Ometer Ci65 (manufactured by Atlas Electric Co.).

The color-forming components, which comprise a diazo compound or the like and a coupler and are incorporated in the heat-sensitive recording layers, may be conventionally known ones. In addition, the heat-sensitive recording materials may contain a basic substance for the acceleration of the reaction between the diazo compound or the like and the coupler, a sensitizer, etc. As described above, combinations of conventionally known diazo compounds or the like and couplers may be used in the heat-sensitive recording material of the invention. But, in order to fully exhibit the effect of the invention, combinations of diazo compounds or the like and couplers, which are suitable for a yellow heat-sensitive layer, a cyan heat-sensitive layer, and a magenta heat-sensitive layer, respectively, exist. These color-forming components and combinations thereof are explained below by way of optimum examples.

Yellow Heat-Sensitive Recording Layer

From the standpoint of effects, the maximum absorption wavelength $\lambda_{max}$ of the diazo compound or the like for use in the yellow heat-sensitive recording layer is preferably 350 nm or less and more preferably 340 nm or less. If the diazo compound or the like has $\lambda_{max}$ on a longer wavelength side relative to the above-mentioned wavelength region, the diazo compound or the like in the yellow heat-sensitive recording layer may be deactivated by the irradiation with light for the fixation of upper layers.

The diazo compound or the like in the yellow heat-sensitive layer to be formed in a position closest to the support is preferably a diazo compound represented by the following general formula (I).

General formula (I)

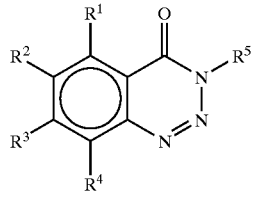

wherein $R^1$, $R^2$, $R^3$, and $R^4$ each independently represent any one selected from the group consisting of a hydrogen atom, a halogen atom, an alkyl group, an aryl group, —$OR^{51}$, —$SR^{51}$, —$COOR^{51}$, —$CONR^{51}R^{52}$, —$SO_2R^{51}$, —$SO_2NR^{51}R^{52}$, —$COR^{51}$, —$NR^{51}R^{52}$, a nitro group, and a cyano group with the proviso that $R^{51}$ and $R^{52}$ each independently represent any one selected from the group consisting of a hydrogen atom, an alkyl group, an aryl group, and an acyl group; and $R^5$ represents any one selected from the group consisting of a hydrogen atom, an alkyl group, an aryl group, —$COOR^{53}$ —$CONR^{53}R^{54}$, —$SO_2R^{53}$, —$SO_2NR^{53}R^{54}$, and —$COR^{53}$ with the proviso that $R^{53}$ and $R^{54}$ each independently represent any one selected from the group consisting of a hydrogen atom, an alkyl group, an aryl group, and an acyl group.

In the general formula (I), $R^1$, $R^2$ , $R^3$, and $R^4$ each independently represent any one selected from the group consisting of a hydrogen atom, a halogen atom, an alkyl group, an aryl group, —$OR^{51}$, —$SR^{51}$, —$COOR^{51}$, —$CONR^{51}R^{52}$, —$SO_2R^{52}$, —$SO_2NR^{51}R^{52}$, —$COR^{51}$, —$NR^{51}R^{52}$, a nitro group, and a cyano group.

In the general formula (I), the halogen atoms represented by $R^1$ to $R^4$ are preferably fluorine, chlorine, bromine, and iodine. In particular, fluorine and chlorine are preferable.

In the general formula (I), in the case where $R^1$ to $R^4$ each represents an alkyl group, the alkyl groups include unsubstituted alkyl groups and substituted alkyl groups. Further, the alkyl groups may be straight-chain or branched alkyl groups and may have an unsaturated bond.

In the general formula (I), the examples of the alkyl groups represented by $R^1$ to $R^4$ are preferably alkyl groups having 1 to 20 carbon atoms and more preferably alkyl groups having 1 to 10 carbon atoms. More specifically, preferred examples of the alkyl groups include methyl, ethyl, n-propyl, isopropyl, n-butyl, t-butyl, n-hexyl, n-octyl, 2-ethylhexyl, 3,5,5-trimethylhexyl, dodecyl, 2-chloroethyl, 2-methanesulfonylethyl, 2-methoxyethyl, 2-benzoyloxyethyl, N,N-dibutylcarbamoylmethyl, 2-ethoxycarbonylethyl, butoxycarbonylmethyl, 2-isopropyloxyethyl, 2-(2,5-di-t-amylphenoxy)ethyl, 2-phenoxyethyl, 1-(4-methoxyphenoxy)-2-propyl, 1-(2,5-di-t-amylphenoxy)-2-propyl, benzyl, α-methylbenzyl, trichloromethyl, trifluoromethyl, 2,2,2-trifluoroethy, etc.

In the general formula (I), in the case where $R^1$ to $R^4$ each represent an aryl group, the aryl groups include unsubstituted aryl groups and substituted aryl groups. The aryl groups represented by $R^1$ to $R^4$ are preferably aryl groups having 6 to 30 carbon atoms. Specifically, preferred examples of the aryl groups include phenyl, 4-methylphenyl, 2-chlorophenyl, etc.

In the general formula (I), in the case where $R^1$ to $R^4$ each represent —$OR^{51}$, —$SR^{51}$, —$COOR^{51}$, —$CONR^{51}R^{52}$, —$SO_2R^{51}$, —$SO_2NR^{51}R^{52}$, —$COR^{51}$, or —$NR^{51}R^{52}$, $R^{51}$ and $R^{52}$ each independently represent any one selected from the group consisting of a hydrogen atom, an alkyl group, an aryl group, and an acyl group.

In the general formula (I), the alkyl groups represented by $R^{51}$ and $R^{52}$ include unsubstituted alkyl groups and substituted alkyl groups. The alkyl groups represented by $R^{51}$ and $R^{52}$ are preferably alkyl groups having 1 to 30 carbon atoms and more preferably alkyl groups having 1 to 10 carbon atoms. Specifically, preferred alkyl groups are methyl, ethyl, isopropyl, sec-butyl, t-butyl, t-amyl, etc.

In the general formula (I), the aryl groups represented by $R^{51}$ and $R^{52}$ include unsubstituted aryl groups and substituted aryl groups. The aryl groups represented by $R^{51}$ and $R^{52}$ are preferably aryl groups having 6 to 30 carbon atoms. Specifically, preferred aryl groups are phenyl, 2-methylphenyl, 3-methylphenyl, 4-methylphenyl, 2-chlorophenyl, 2,5-t-amylphenyl, etc.

In the general formula (I), the acyl groups represented by $R^{51}$ and $R^{52}$ include unsubstituted acyl groups and substituted acyl groups. The acyl groups represented by $R^{51}$ and $R^{52}$ are preferably acyl groups having 1 to 30 carbon atoms and more preferably acyl groups having 1 to 10 carbon atoms. Specifically, preferred acyl groups include acetyl propanoyl, butanoyl, benzoyl, etc.

In the general formula (I), $R^5$ represents any one selected from the group consisting of a hydrogen atom, a halogen atom, an alkyl group, an aryl group, —$COOR^{53}$, —$CONR^{53}R^{54}$, —$SO_2R^{53}$, —$SO_2NR^{53}R^{54}$, and —$COR^{53}$.

In the general formula (I), the alkyl groups represented by $R^5$ include unsubstituted alkyl groups and substituted alkyl groups. The alkyl groups may be straight-chain or branched ones and may have an unsaturated bond. The alkyl groups represented by $R^5$ are preferably alkyl groups having 1 to 30 carbon atoms. More specifically, preferred examples of the alkyl groups include methyl, ethyl, n-propyl, isopropyl, n-butyl, isobutyl, 2-butyl, t-butyl, n-hexyl, n-octyl, 2-ethylhexyl, 3,5,5-trimethylhexyl, dodecyl, 2-chloroethyl, 2-methanesulfonylethyl, 2-methoxyethyl, 2-methoxypropyl, 2-benzoyloxyethyl, N,N-dibutylcarbamoylmethyl, 2-ethoxycarbonylethyl, butoxycarbonylmethyl, octyloxycarbonylmethyl, cyclohexyl, 2-isopropyloxyethyl, 2-(2,5-di-t-amylphenoxy)ethyl, 2-phenoxyethyl, 1-(4-methoxyphenoxy)-2-propyl, 1-(2,5-di-t-amylphenoxy)-2-propyl, benzyl, α-methylbenzyl, phenethyl, 3-phenylpropyl, allyl, methallyl, trichloromethyl, trifluoromethyl, 2,2,2-trifluoroethyl, etc.

In the general formula (I), the aryl groups represented by $R^5$ include unsubstituted aryl groups and substituted aryl groups. The aryl groups represented by $R^5$ are preferably aryl groups having 6 to 30 carbon atoms. Specifically, preferred examples of the aryl groups include phenyl, 2-methylphenyl, 3-methylphenyl, 4-methylphenyl, 4-ethylphenyl, 4-isopropylphenyl, etc.

In the general formula (I), in the case where $R^5$ represents —$COOR^{53}$, —$CONR^{53}R^{54}$, —$SO_2R^{53}$, —$SO_2NR^{53}R^{54}$, or —$COR^{53}$, $R^{53}$ and $R^{54}$ each independently represent any one selected from the group consisting of a hydrogen atom, an alkyl group, an aryl group, and an acyl group.

In the general formula (I), the alkyl groups represented by $R^{53}$ and $R^{54}$ include unsubstituted alkyl groups and substituted alkyl groups. The alkyl groups represented by $R^{53}$ and $R^{54}$ are preferably alkyl groups having 1 to 30 carbon atoms and more preferably alkyl groups having 1 to 10 carbon atoms. Specifically, preferred alkyl groups are methyl, ethyl, isopropyl, sec-butyl, t-butyl, t-amyl, etc.

In the general formula (I), the aryl groups represented by $R^{53}$ and $R^{54}$ include unsubstituted aryl groups and substituted aryl groups. The aryl groups represented by $R^{53}$ and $R^{54}$ are preferably aryl groups having 6 to 30 carbon atoms. Specifically, preferred aryl groups are phenyl, 2-methylphenyl, 3-methylphenyl, 4-methylphenyl, 2-chlorophenyl, 2,5-t-amylphenyl, etc.

In the general formula (I), the acyl groups represented by $R^{53}$ and $R^{54}$ include unsubstituted acyl groups and substituted acyl groups. The acyl groups represented by $R^{53}$ and $R^{54}$ are preferably acyl groups having 1 to 30 carbon atoms and more preferably acyl groups having 1 to 10 carbon atoms. Specifically, preferred acyl groups include acetyl, propanoyl, butanoyl, benzoyl, etc.

Specific examples of the diazo compounds represented by the general formula (I) are indicated below by exemplary compounds (A-1 to A-42) and by the specific examples 1 to 28 in which the combinations of $R^1$ to $R^5$ in the general formula (I) are given specifically, but it should be understood that the diazo compounds to be used in the yellow heat-sensitive recording layer are not restricted to these compounds.

A-1
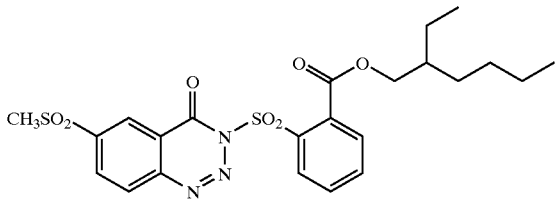
A-2
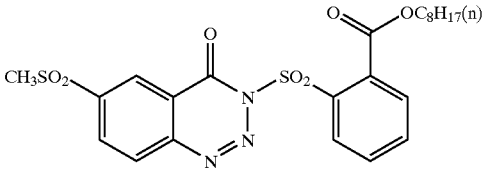
A-3
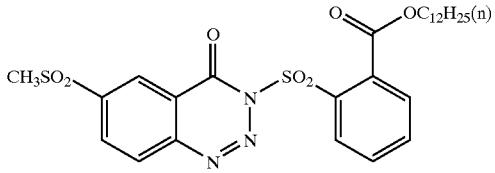
A-4
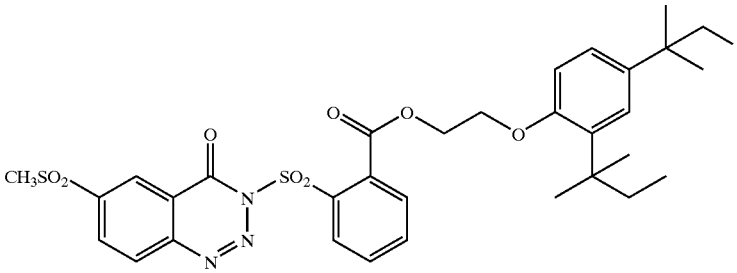
A-5
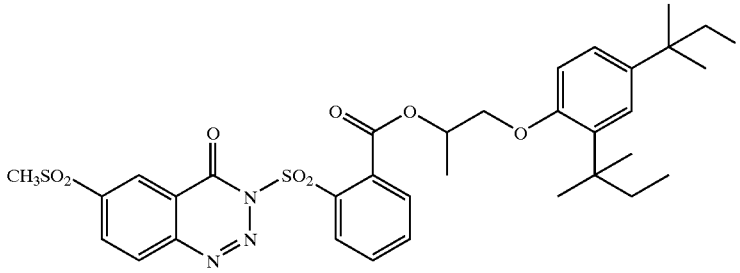
A-6
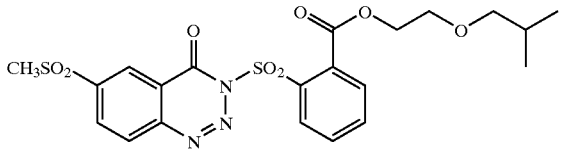
A-7
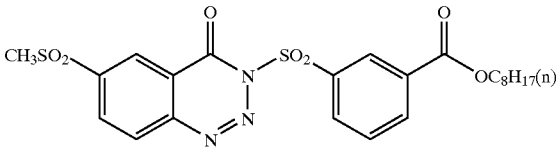
A-8
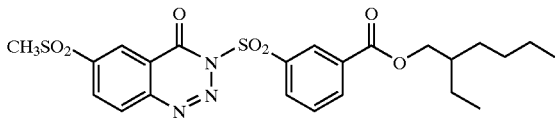
A-9
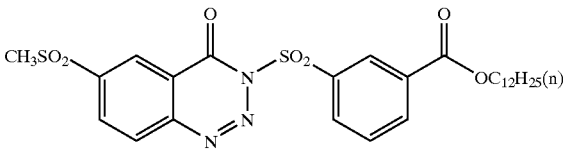
A-10
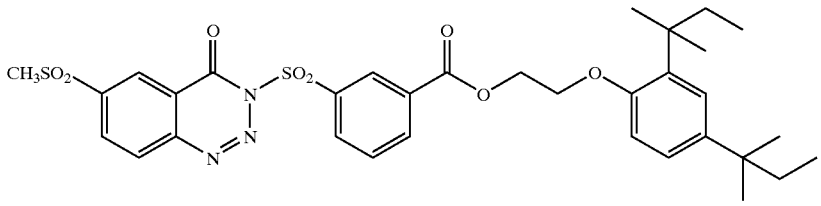

-continued
A-11
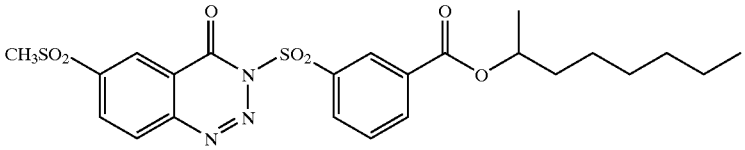
A-12
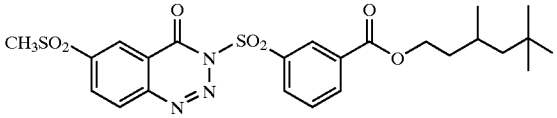
A-13
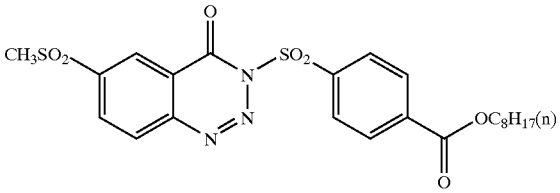
A-14
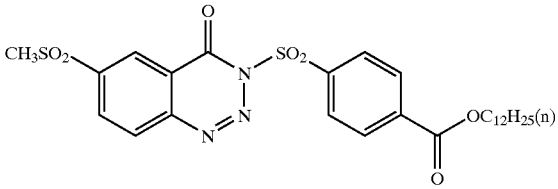
A-15
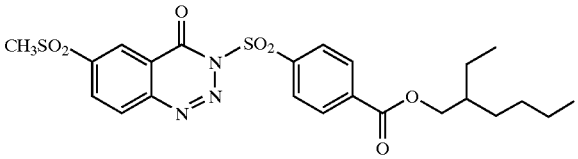
A-16
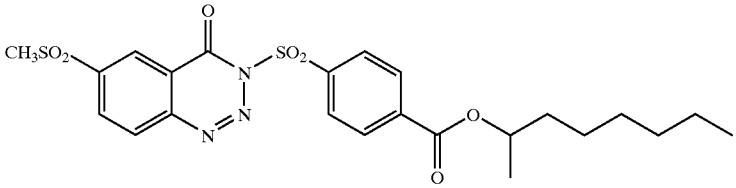
A-17
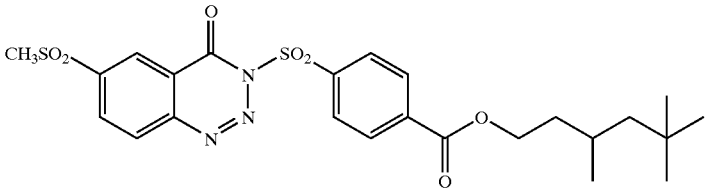
A-18
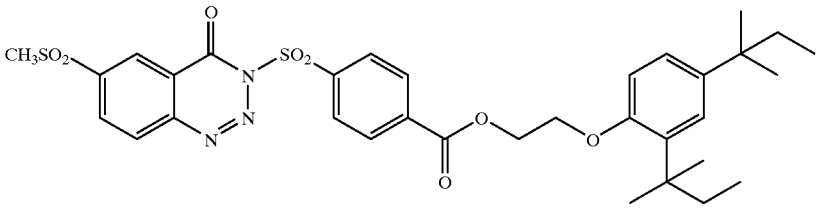
A-19
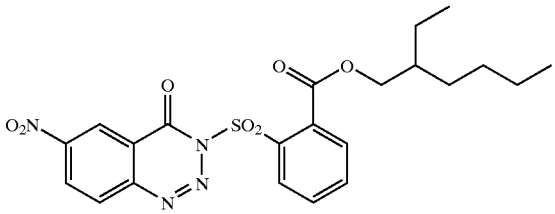
A-20
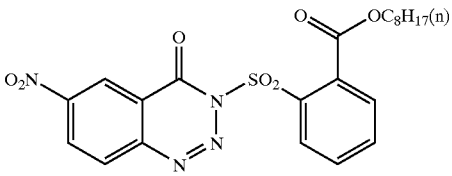

-continued
A-21
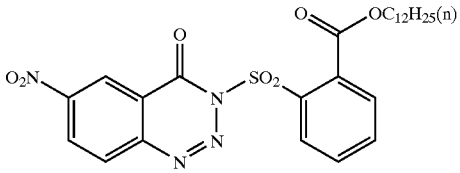
A-22
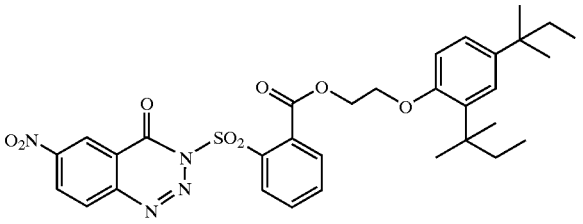
A-23
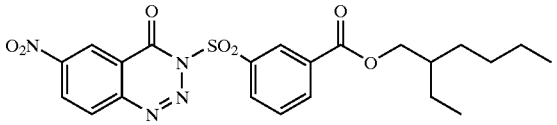
A-24
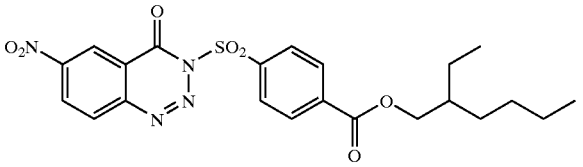
A-25
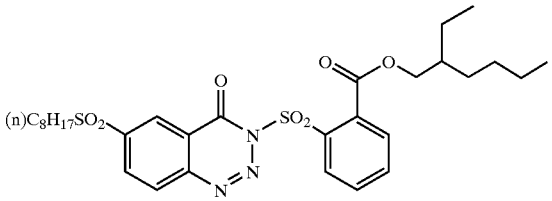
A-26
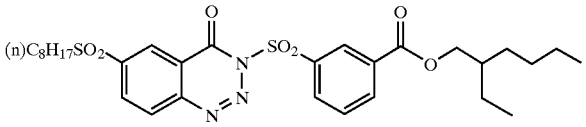
A-27
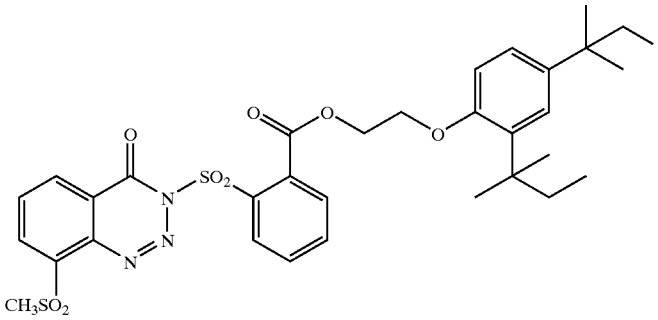
A-28
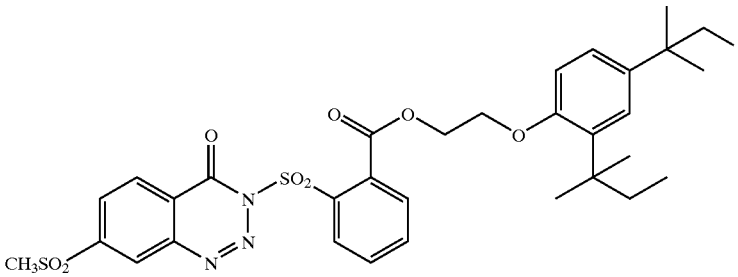
A-29
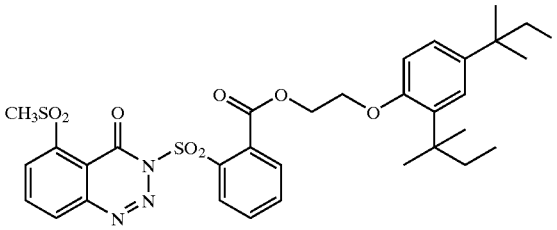
A-30
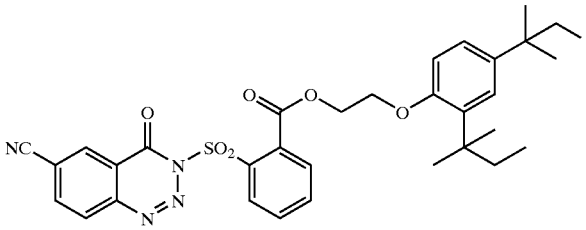

-continued
A-31
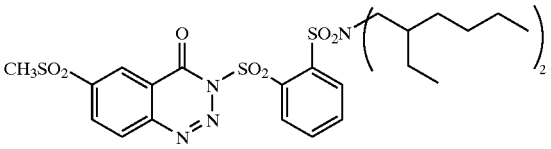
A-32
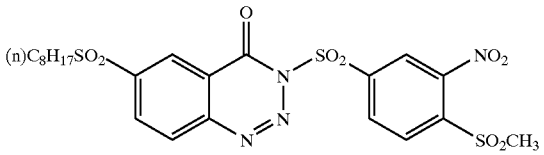
A-33
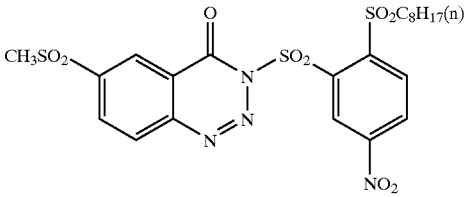
A-34
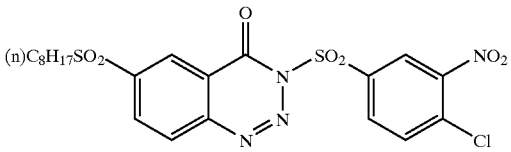
A-35
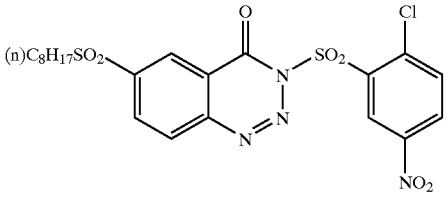
A-36
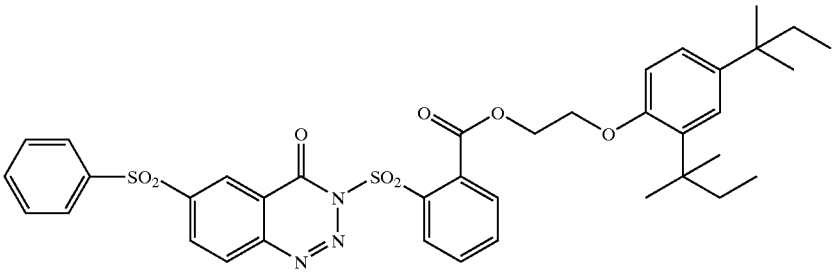
A-37
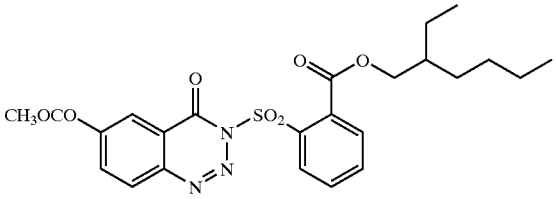
A-38
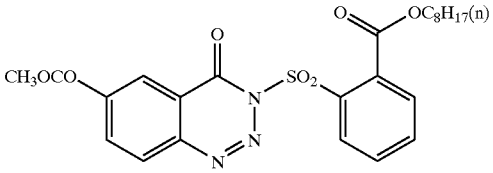
A-39
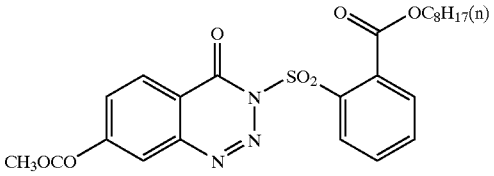
A-40
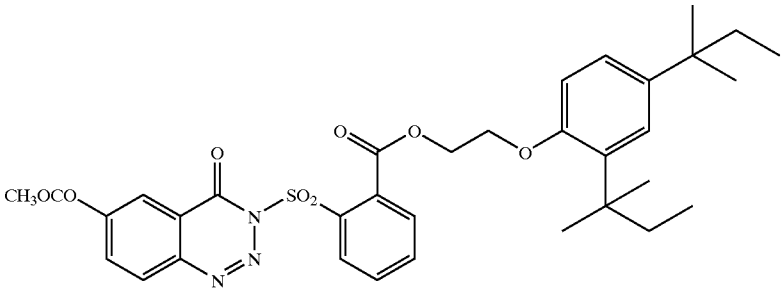

-continued
A-41
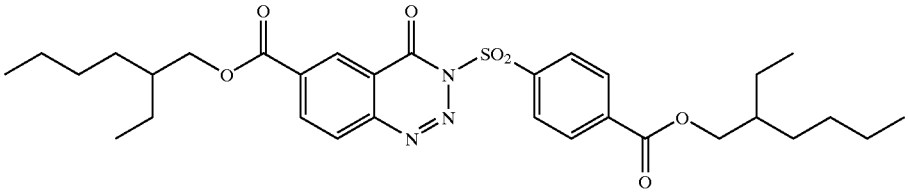
A-42
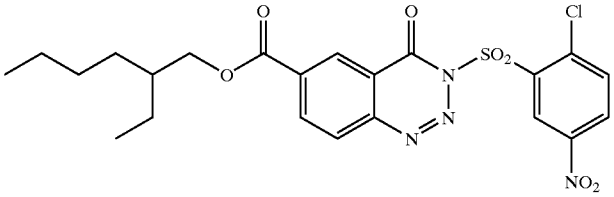
General formula (I)
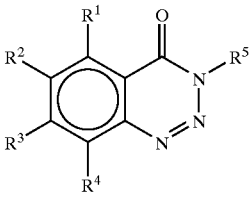
| Compound No. | $R^1$ | $R^2$ | $R^3$ | $R^4$ | $R^5$ |
|---|---|---|---|---|---|
| 1 | —H | 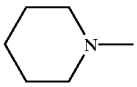 | H— | —H | 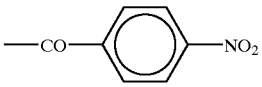 |
| 2 | —H | 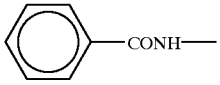 | H— | —H | 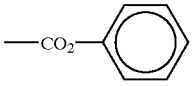 |
| 3 | —H | 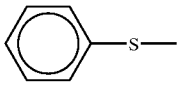 | $C_4H_9O$— | —H | 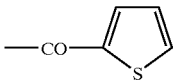 |
| 4 | —H | 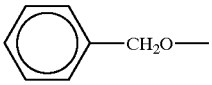 | 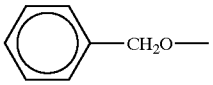 | —H | 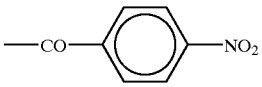 |
| 5 | —H | 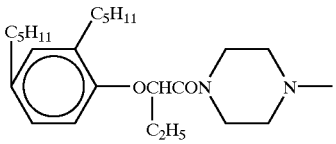 | H— | —H | 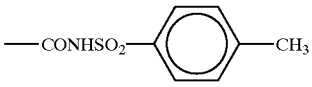 |
| 6 | —H | $C_6H_{13}O$— | $C_6H_{13}O$— | —$OC_6H_{13}$ | 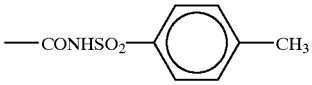 |
| 7 | —H | 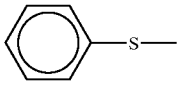 | H— | —H | 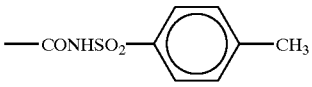 |

-continued
General formula (I)
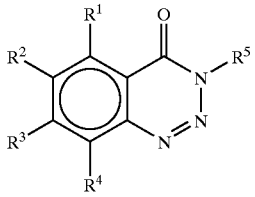
| Compound No. | $R^1$ | $R^2$ | $R^3$ | $R^4$ | $R^5$ |
|---|---|---|---|---|---|
| 8 | —H | 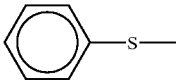 | $C_8H_{17}O$— | —H | 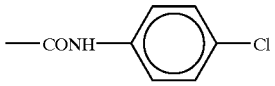 |
| 9 | —H | 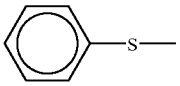 | H— | —H | 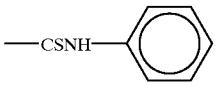 |
| 10 | —H | H— | H— | —H | 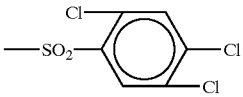 |
| 11 | —H | 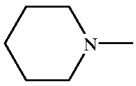 | H— | —H | 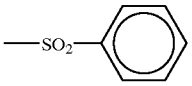 |
| 12 | —H | 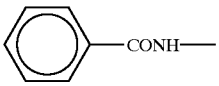 | H— | —H | 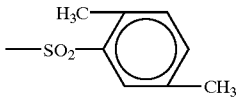 |
| 13 | —H | $(C_8H_{17})_2N$— | H— | —H | —$SO_2CH_3$ |
| 14 | —H | 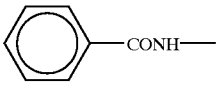 | H— | —H | —$SO_2C_8H_{17}$ |
| 15 | —H | $CH_3CONH$— | H— | —H | 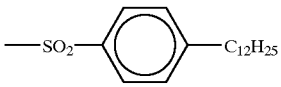 |
| 16 | —H | 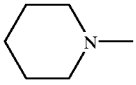 | $C_4H_9O$— | —H | 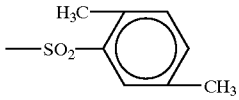 |
| 17 | —H | 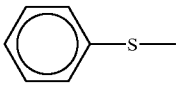 | H— | —H | 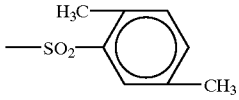 |
| 18 | —H | 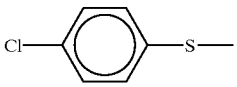 | H— | —H | 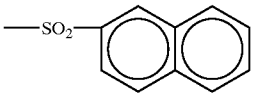 |
| 19 | —H | 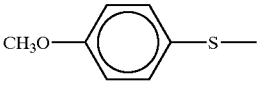 | H— | —H | 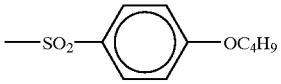 |

-continued

General formula (I)

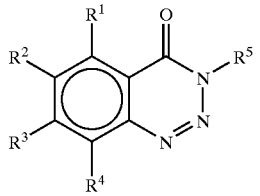

| Compound No. | $R^1$ | $R^2$ | $R^3$ | $R^4$ | $R^5$ |
|---|---|---|---|---|---|
| 20 | —H | 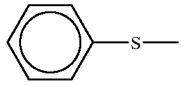 | $C_4H_9O$— | —H | 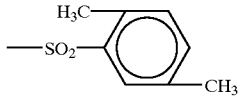 |
| 21 | —H | 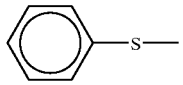 | $CH_2$=$CHCH_2O$— | —H | 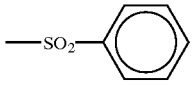 |
| 22 | —H | 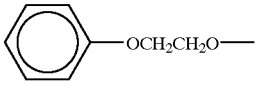 | H— | —H | 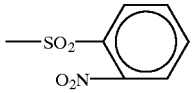 |
| 23 | —H | $C_4H_9O$— | $C_4H_9O$— | —H | 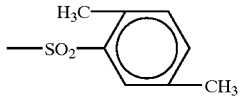 |
| 24 | —H | $C_6H_{13}O$— | $C_6H_{13}O$— | —$OC_6H_{13}$ | 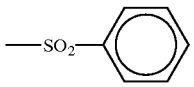 |
| 25 | —H | $C_8H_{17}O$— | H— | —$OC_8H_{17}$ | 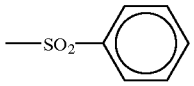 |
| 26 | —H | Cl— | 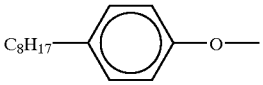 | —H | 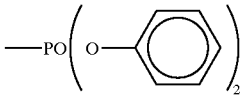 |
| 27 | —H | $C_8H_{17}O$— | $CH_3$— | —$OC_8H_{17}$ | 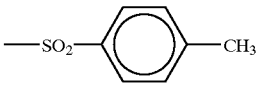 |
| 28 | —$CONH_2$ | H— | $C_{12}H_{25}O$— | —H | 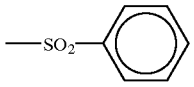 |

The yellow heat-sensitive recording layer is required to contain at least one kind of the diazo compounds represented by the general formula (I) and may contain two or more kinds of the diazo compounds represented by the general formula (I). Further, other diazo compound may be used together. The content of the diazo compound represented by the general formula (I) in the yellow heat-sensitive recording layer is 0.02 to 3 g/$m^2$ and more preferably 0.1 to 2 g/$m^2$. A content less than 0.02 g/$m^2$ is not desirable in terms of color-formability, and a content more than 3 g/$m^2$ is not desirable in terms of the thickness of the coating layer.

It is preferable that the compound represented by the general formula (I) is used together with an aromatic hydrocarbon. The aromatic hydrocarbon is preferably the one having 12 to 50, preferably 12 to 25 carbon atoms from the standpoints of solubility, ease in handling of the compound in a state to be used, etc. The aromatic hydrocarbons are preferably those represented by the general formula (II):

General formula (II)

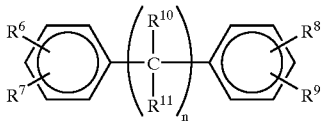

wherein $R^6$ to $R^{11}$ leach independently represent a hydrogen atom or an alkyl group; and n represents an integer of 0 to 3. $R^6$ and $R^7$, $R^8$ and $R^9$, and $R^{10}$ and $R^{11}$ may join together, respectively, to form a ring. In the case where $R^6$ to $R^{11}$ each represent an alkyl group, the alkyl groups may be straight-chain or branched ones and may have an unsaturated bond. Further, the substitution sites of $R^6$ to $R^9$ are not particularly limited.

In the general formula (II), $R^6$ to $R^9$ are preferably a hydrogen atom and alkyl groups having 1 to 8 carbon atoms. $R^{10}$ and $R^{11}$ are preferably a hydrogen atom and a methyl group. n is preferably 0 or 1.

The aromatic hydrocarbons are, for example, those given below, but it should be understood that the aromatic hydrocarbons are not restricted to these examples.

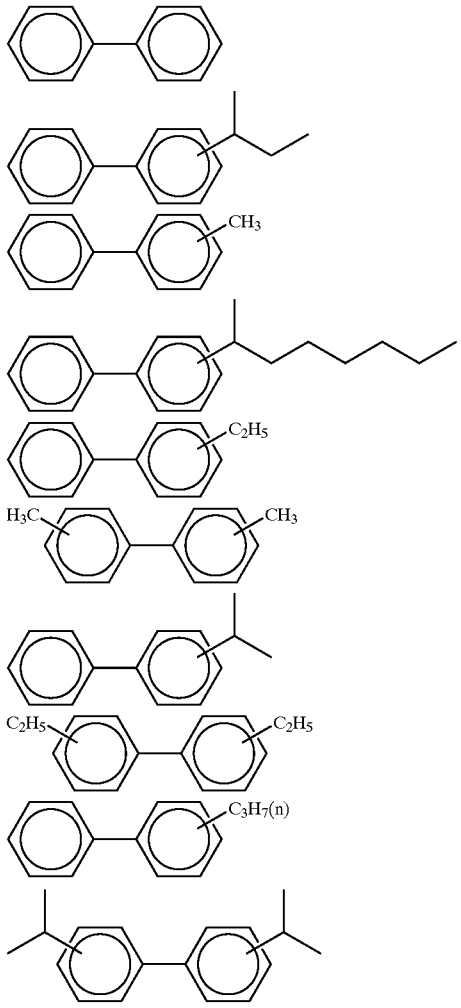

-continued

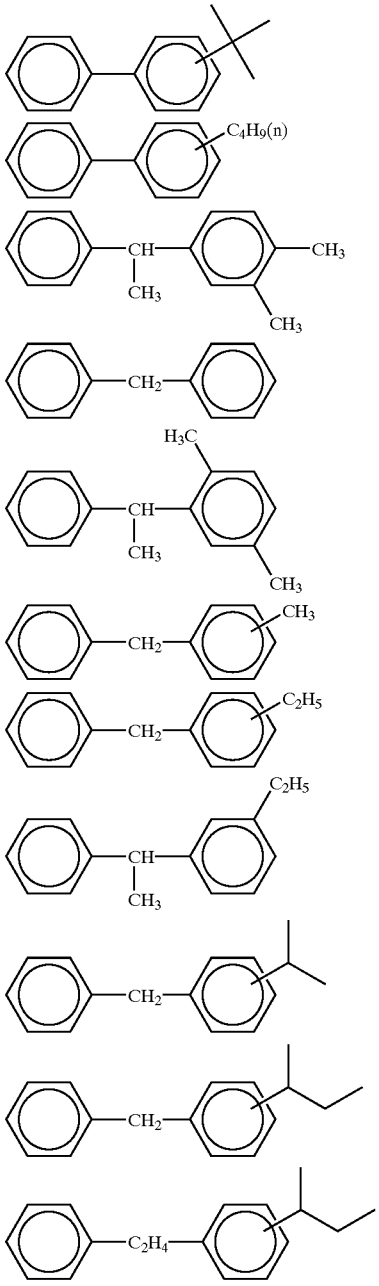

The aromatic hydrocarbons may be used alone or in a combination of two or more thereof.

Next, the coupler which reacts with the above-mentioned diazo compound to form a yellow color is explained below. The coupler that can be used in the yellow heat-sensitive recording layer may be any compound capable of coupling-reacting with a diazo compound to form a dye in a basic environment. All of so-called 4-equivalent couplers known in the field of silver halide photographic light-sensitive materials can be used as couplers in the yellow heat-sensitive recording layer. According to the desired hues of yellow, these couplers can be selected for use.

Examples of conventionally known couplers that can be used in the yellow heat-sensitive recording layer include a so-called active methylene compound having a methylene group adjacent to a carbonyl group, a phenol derivative, and a naphthol derivative. The compounds exemplified below can be used in so far as these compounds meet the purpose of the invention.

Specific examples of the conventionally known couplers include resorcinol, fluoroglycine, sodium 2,3-dihydroxynaphthalene-6-sulfonate, sodium 2-hydroxy-3-naphthalenesulfonate, 2-hydroxy-3-naphthalenesulfonic acid anilide, 1-hydroxy-2-naphthoic acid morpholinopropylamide, 2-hydroxy-3-naphthalenesulfonic acid morpholinopropylamide, 2-hydroxy-3-naphthalenesulfonic acid-2-ethylhexyloxypropylamide, 2-hydroxy-3-naphthalenesulfonic acid-2-ethylhexylamide, 5-acetamido-1-naphthol, sodium 1-hydroxy-8-acetamidonaphthalene-3,6-disulfonate, 1-hydroxy-8-acetamidonaphthalene-3,6-disulfonic acid dianilide, 1,5-dihydroxynaphthalene, 2,3-dihydroxynaphthalene, 2-hydroxy-3-naphthoic acid morpholinopropylamide, 2-hydroxy-3-naphthoic acid octylamide, 2-hydroxy-3-naphthoic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, 1,3-dicyclohexylbarbituric acid, 1,3-di-n-dodecylbarbituric acid, 1-n-octyl-3-n-octadecylbarbituric acid, 1-phenyl-3-(2,5-di-n-octyloxyphenyl)barbituric acid, 1,3-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamido-5-pyrazolone, 6-hydroxy-4-methyl-3-cyano-1-(2-ethylhexyl)-2-pyridone, 2-[3-[α-(2,4-di-tert-amylphenoxy)butanamide]benzamide]phenol, 2,4-bis(benzoylacetamino)toluene, 1,3-bis(pivaloylacetaminomethyl)benzene, benzoylacetonitrile, thenoylacetonitrile, acetoacetanilide, benzoylacetanilide, pivalolylacetanilide, 2-chloro-5-(N-n-butylsulfamoyl)-1-pivaloylacetamidobenzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, 1-(4-n-octyloxyphenyl)-3-tert-butyl-5-aminopyrazole, trifluoroacetoacetanilide, 4-hydroxycoumarin, pyrazolo[1,5-a]pyrimidinedione, 3-ethyl-6-ethoxyuracil, etc.

Details of the couplers are described in, for example, JP-A Nos. 4-201483, 7-125446, 7-96671, 7-223367, 7-22368, etc.

Further, particularly preferred examples of the coupler that can be used in the yellow heat-sensitive recording layer are the compounds represented by the following general formula (III). Details of the couplers represented by the following general formula (III) are described below.

General Formula (III)

$$E^1\text{-}CH_2\text{-}E^2$$

wherein the electron attractive groups indicated by $E^1$ and $E^2$ represent, respectively, a substituent whose Hammett substituent constant $\sigma_p$ is positive. These substituents may be the same or different. Preferred examples of the substituents include acyl groups such as an acetyl group, a propionyl group, a pivaloyl group, a chloroacetyl group, a trifluoroacetyl group, a 1-methylcyclopropylcarbonyl group, a 1-ethylcyclopropylcarbonyl group, a 1-benzylcyclopropylcarbonyl group, a benzoyl group, a 4-methoxybenzoyl group, and a thenoyl group; oxycarbonyl groups such as a methoxycarbonyl group, an ethoxycarbonyl group, a 2-methoxyethoxycarbonyl group, and a 4-methoxyphenoxycarbonyl group; carbamoyl groups such a carbamoyl group, an N,N-dimethylcarbamoyl group, an N,N-diethylcarbamoyl group, an N-phenylcarbamoyl group, an N-2,4-bis(pentyloxy)phenylcarbamoyl group, an N-2,4-bis(octyloxy)phenylcarbamoyl group, and a morpholinocarbonyl group; cyano groups; sulfonyl groups such as a methanesulfonyl group, a benzenesulfonyl group, and a toluenesulfonyl group; phosphono groups such as a diethylphosphono group; and heterocyclic groups such as a benzoxazole-2-yl group, a benzothiazole-2-yl group, a 3,4-dihydroquinazoline-4-one-2-yl group and a 3,4-dihydroquinazoline-4-sulfone-2-yl group.

In the general formula (III), the electron attractive groups indicated by $E^1$ and $E^2$ may join together to form a ring. The rings formed by $E^1$ and $E^2$ are preferably 5- to 6-membered carbocycles or heterocycles.

Specific examples of the coupling components represented by the general formula (III) of the invention are given below, but it should be understood that the invention is not restricted to these examples.

C-1

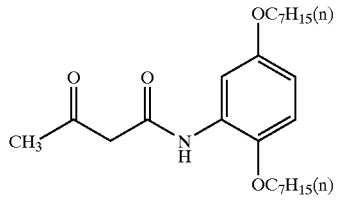

C-2

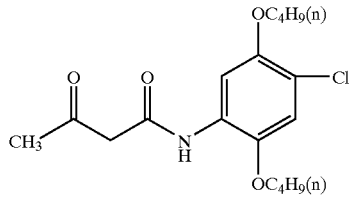

C-3

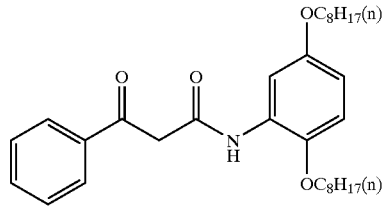

C-4

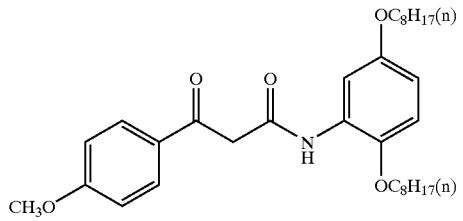

C-5

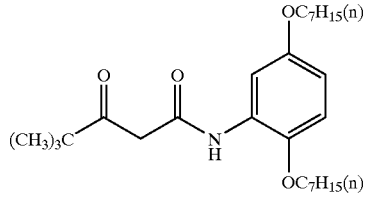

-continued
C-6
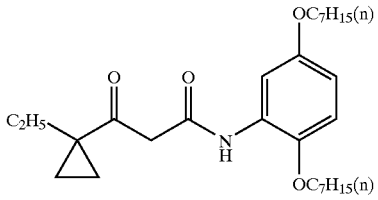
C-7
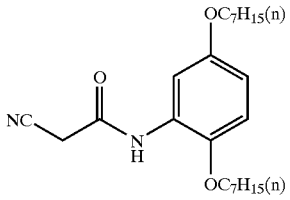
C-8
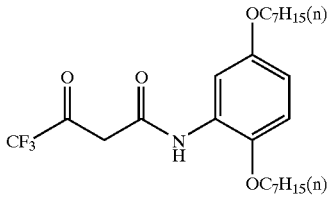
C-9
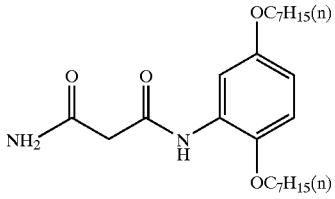
C-10
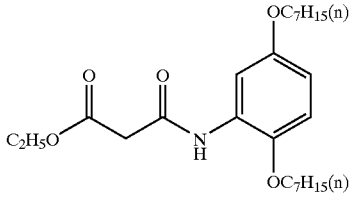
C-11
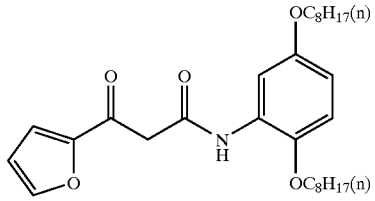
C-12
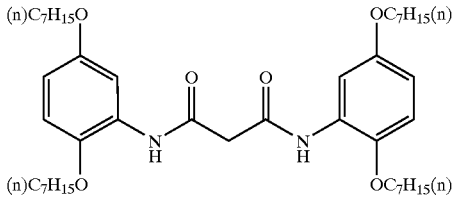
-continued
C-13
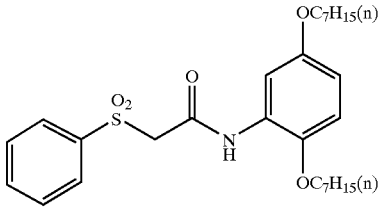
C-14
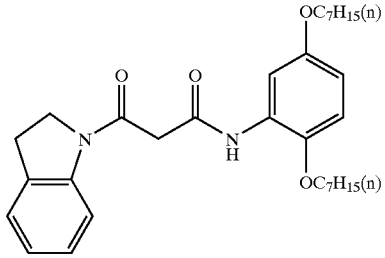
C-15
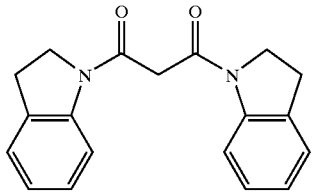
C-16
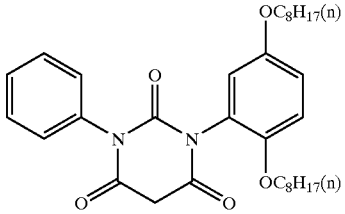
C-17
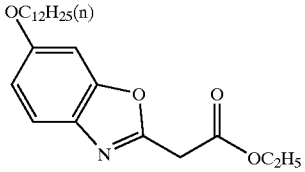
C-18
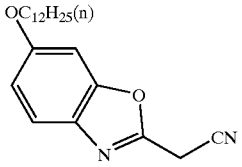
C-19
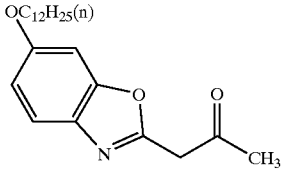
C-20
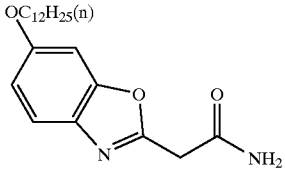

-continued
C-21
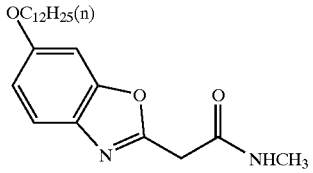
C-22
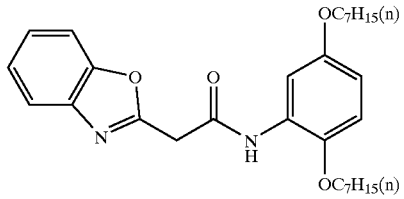
C-23
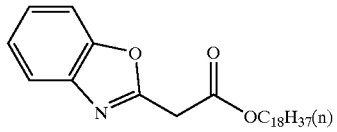
C-24
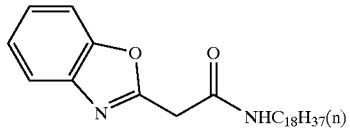
C-25
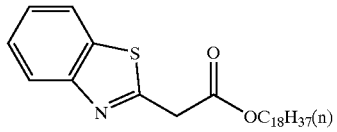
C-26
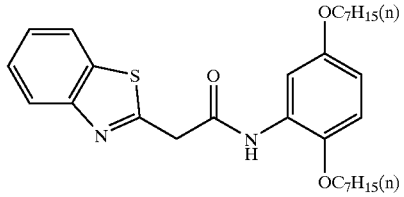
C-27
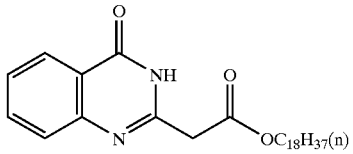
C-28
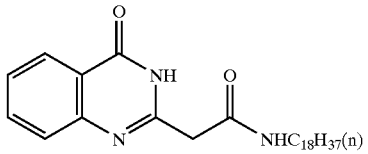
C-29
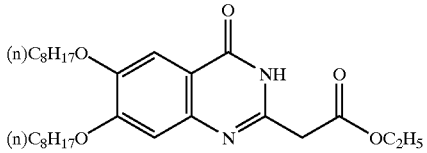
-continued
C-30
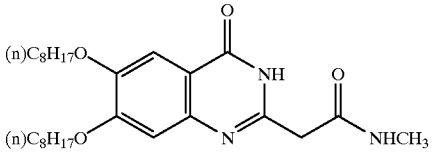
C-31
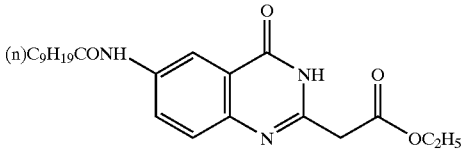
C-32
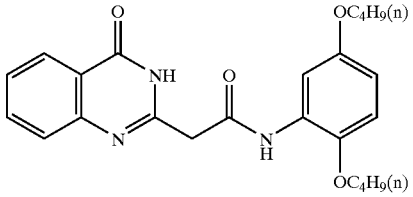
C-33
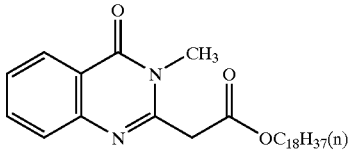
C-34
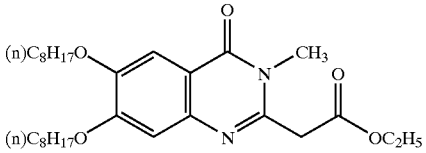
C-35
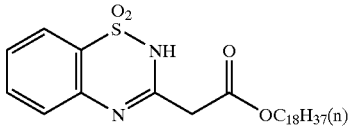
C-36
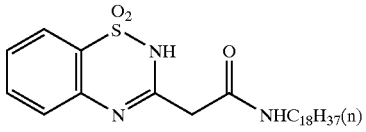
C-37
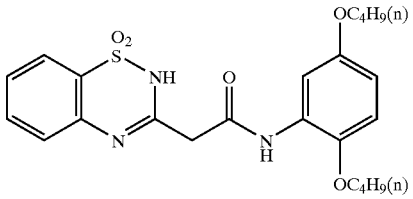
C-38
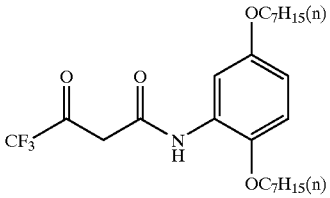

-continued
C-39
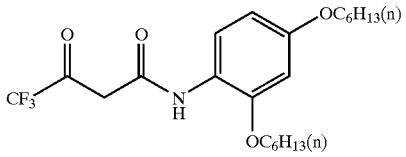
C-40
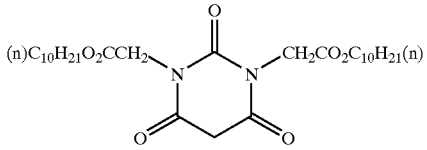
C-41
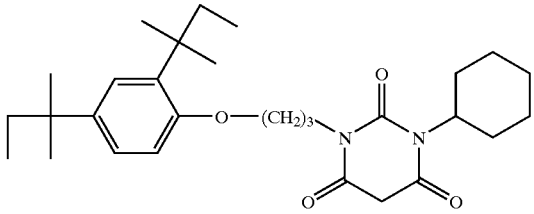
C-42
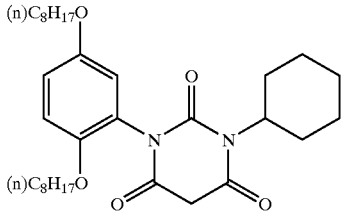
C-43
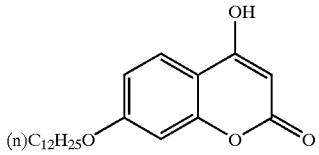
C-44
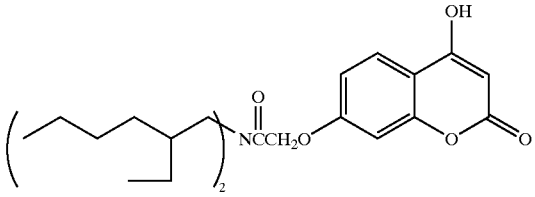
C-45
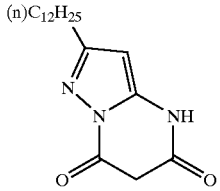
-continued
C-46
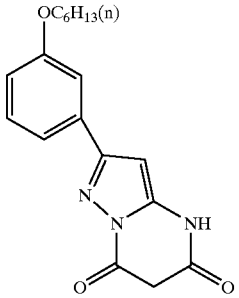
C-47
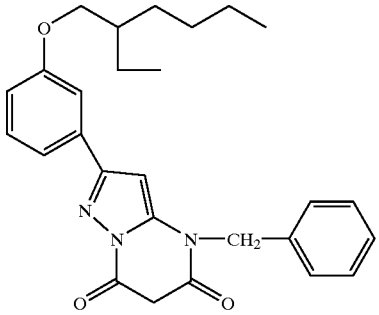
C-48
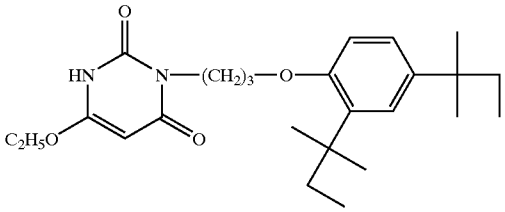
C-49
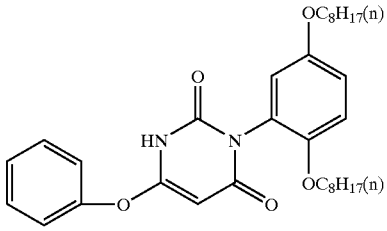
C-50
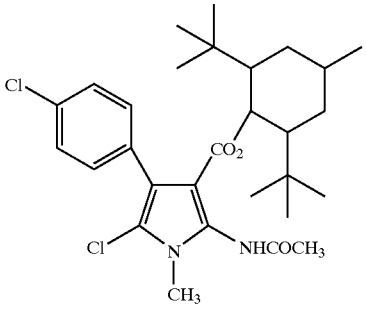

-continued
C-51
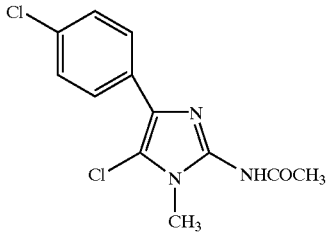
C-52
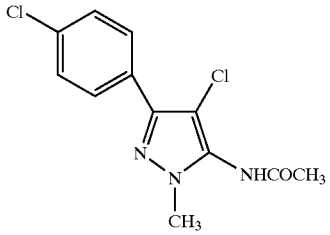
C-53
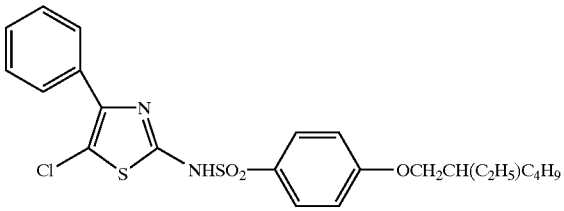
C-54
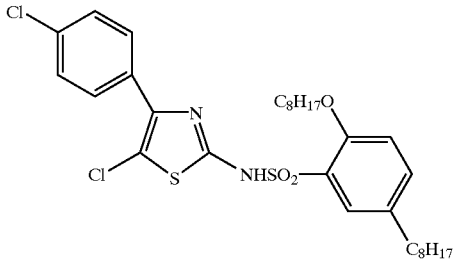
C-55
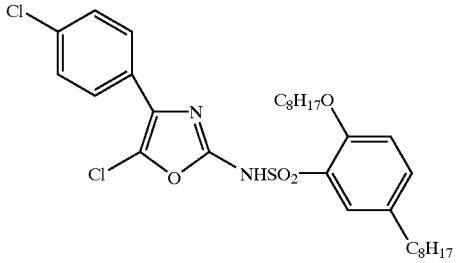
C-56
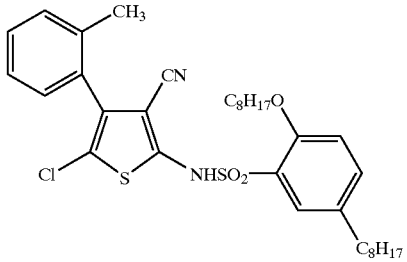
-continued
C-57
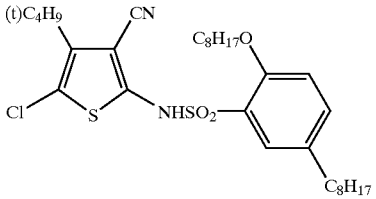
C-58
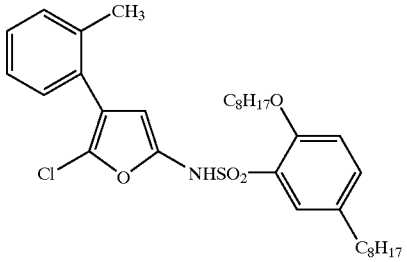
C-59
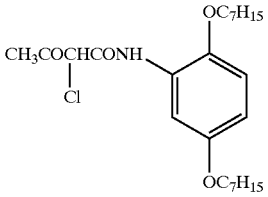
C-60
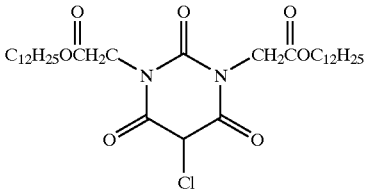
C-61
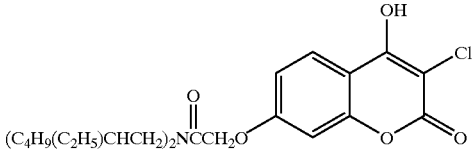
C-62
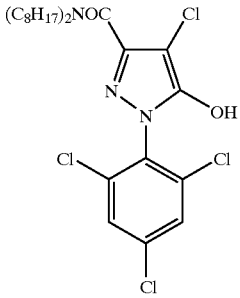
C-63
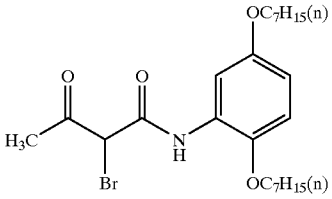

-continued

C-64

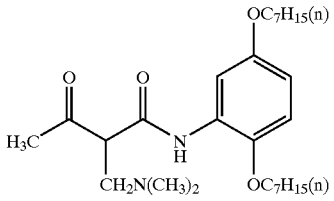

C-65

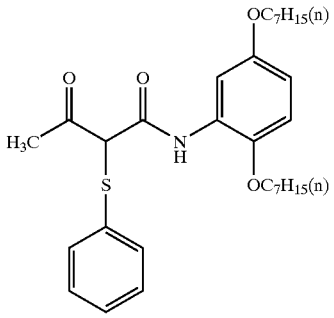

C-66

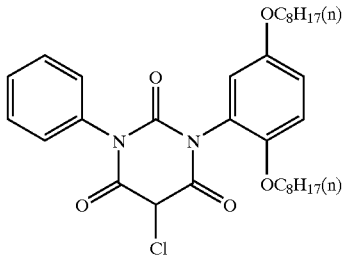

C-67

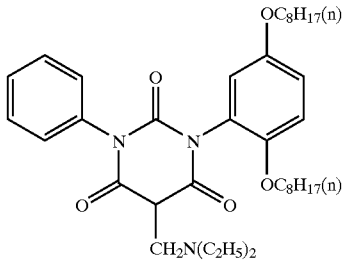

C-68

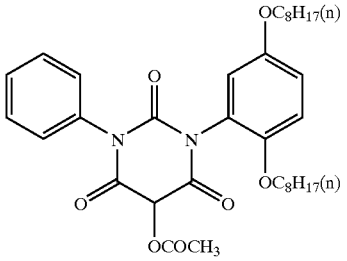

C-69

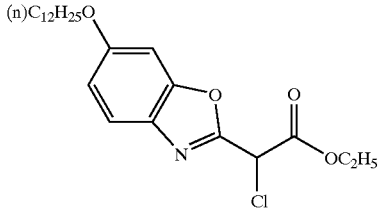

-continued

C-70

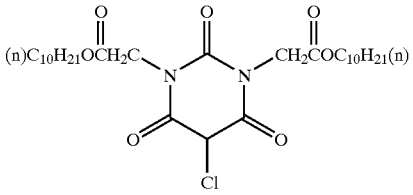

C-71

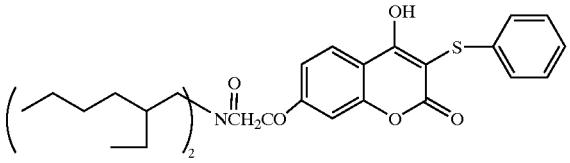

C-72

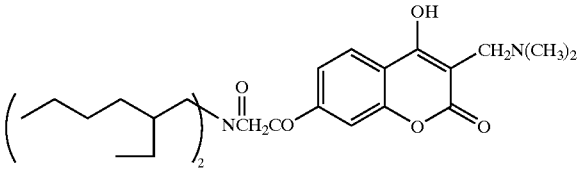

C-73

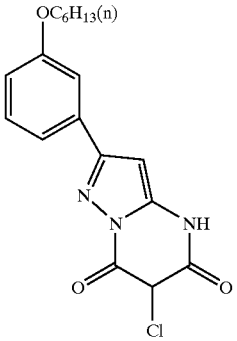

In the yellow heat-sensitive recording layer, the total amount (mol) of the coupler(s) added is preferably 1 to 10 times, and more preferably 2 to 5 times as large as the amount (mol) of the diazo compound added from the standpoint of the effects.

If the total mol of the coupler(s) added is less than the mol of the diazo compound added, sufficient color-formability may not be obtained. On the other hand, if the total mol of the coupler(s) added is more than 10 times as large as the mol of the diazo compound added, it may impair color-formability and adversely affects the thickness of the layer.

Cyan Heat-Sensitive Recording Layer

In the heat-sensitive recording layer of the invention, the cyan heat-sensitive recording layer is provided between the yellow heat-sensitive recording layer and the magenta heat-sensitive recording layer. From the standpoint of effects, the maximum absorption wavelength $\lambda_{max}$ of the diazo compound or the like for use in the cyan heat-sensitive recording layer is preferably 340 to 400 nm and more preferably 360 to 390 nm. If the diazo compound or the like has $\lambda_{max}$ on a longer wavelength side relative to the above-mentioned wavelength range, the diazo compound or the like may be deactivated by the light irradiation of the upper layer at the time of fixation. On the other hand, if the diazo compound or the like has $\lambda_{max}$ on a shorter wavelength side relative to the above-mentioned wavelength range, image fixability, image preservability, and hue in purple to cyan color formation may be adversely affected depending on the combination with a coupler.

It is preferable that the diazonium salt that can be used in the cyan heat-sensitive recording layer is a compound represented by the following general formula:

$$Ar—N_2^+.X^-$$

where Ar represents an aromatic group and $X^-$ represents an acid anion. The compound undergoes a color forming coupling reaction with a coupler upon heating. Also, the compound is decomposed and deactivated by light. The maximum absorption wavelength of the compound can be controlled by the position and kind of the substituent of the Ar group.

Specific examples of the diazonium that forms the salt include 4-(p-tolylthio)-2,5-dibutoxybenzenediazonium, 4-(4-chlorophenylthio)-2,5-dibutoxybenzenediazonium, 4-(N,N-dimethylamino)benzenediazonium, 4-(N,N-diethylamino)benzenediazonium, 4-(N,N-dipropylamino) benzenediazonium, 4-(N-methyl-N-benzylamino) benzenediazonium, 4-(N,N-dibenzylamino) benzenediazonium, 4-(N-ethyl-N-hydroxyethylamino) benzenediazonium, 4-(N,N-diethylamino)-3-methoxybenzenediazonium, 4-(N,N-dimethylamino)-2-methoxybenzenediazonium, 4-(N-benzoylamino)-2,5-diethoxybenzenediazonium, 4-morpholino-2,5-dibutoxybenzenediazonium, 4-anilinobenzenediazonium, 4-[N-(4-methoxybenzoyl)amino]-2,5-diethoxybenzenediazonium, 4-pyrrolidino-3-ethylbenzenediazonium, 4-[N-(1-methyl-2-(4-methoxyphenoxy)ethyl)-N-hexylamino]-2-hexyloxybenzenediazonium, 4-[N-(2-(4-methoxyphenoxy) ethyl)-N-hexylamino]-2-hexyloxybenzenediazonium, 2-(1-ethylpropyloxy)-4-[di-(di-n-butylaminocarbonylmethyl) amino]benzenediazonium, etc.

Among these diazonium salts, the diazonium salts represented by the following general formula (A), the following general formula (B), and the following general formula (C), respectively, are preferable from the standpoints of hue of dye, image preservability, and image fixability.

General formula (A)

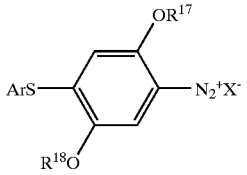

General formula (B)

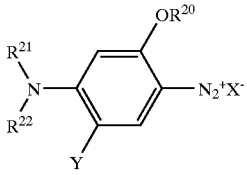

General formula (C)

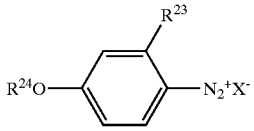

In the general formula (A), Ar represents a substituted or unsubstituted aryl group. $R^{17}$ and $R^{18}$ each independently represent a substituted or unsubstituted alkyl group or a substituted or unsubstituted aryl group and $R^{17}$ and $R^{18}$ may be the same or different.

Examples of the substituent include an alkyl group, an alkoxy group, an alkylthio group, an aryl group, an aryloxy group, an arylthio group, an acyl group, an alkoxycarbonyl group, a carbamoyl group, a carboamide group, a sulfonyl group, a sulfamoyl group, a sulfonamide group, a ureido group, a halogen atom, an amino group, a heterocyclic group, etc. These substituent groups may be further substituted.

In the general formula (B), $R^{20}$, $R^{21}$, and $R^{22}$ each independently represent a substituted or unsubstituted alkyl group or a substituted or unsubstituted aryl group, with the proviso that $R^{20}$, $R^{21}$, and $R^{22}$ may be the same or different. Y represents a hydrogen atom or an $OR^{19}$ and $R^{19}$ represents a substituted or unsubstituted alkyl group or a substituted or unsubstituted aryl group.

Examples of the substituents include an alkyl group, an alkoxy group, an alkylthio group, an aryl group, an aryloxy group, an arylthio group, an acyl group, an alkoxycarbonyl group, a carbamoyl group, a carboamide group, a sulfonyl group, a sulfamoyl group, a sulfonamide group, a ureido group, a halogen atom, an amino group, a heterocyclic group, etc.

Among these groups, from the standpoint of hue adjustment, Y is preferably a hydrogen atom or an alkyloxy group whose $R^{19}$ is an alkyl group.

In the general formula (C), $R^{23}$ and $R^{24}$ each independently represent a substituted or unsubstituted alkyl group or a substituted or unsubstituted aryl group. $R^{23}$ and $R^{24}$ may be the same or different.

Examples of the substituents include an alkyl group, an alkoxy group, an alkylthio group, an aryl group, an aryloxy group, an arylthio group, an acyl group, an alkoxycarbonyl group, a carbamoyl group, a carboamide group, a sulfonyl group, a sulfamoyl group, a sulfonamide group, a ureido group, a halogen atom, an amino group, a heterocyclic group, etc.

In the general formulae (A) to (C), $X^-$ represents an acid anion. Examples of the acid anion include a polyfluoroalkylcarboxylic acid having 1 to 9 carbon atoms, a polyfluoroalkylsulfonic acid having 1 to 9 carbon atoms, tetrafluoroboron, tetraphenylboron, hexafluorophosphoric acid, an aromatic carboxylic acid, an aromatic sulfonic acid, etc. Hexafluorophosphoric acid is preferable from the standpoint of crystallizability.

Specific examples of the diazonium salts represented by the general formula (A), the general formula (B), and the general formula (C), respectively, are given below. It should be noted, however, that the invention is not limited to these compounds.

A-1

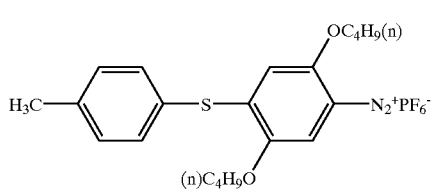

-continued

A-2

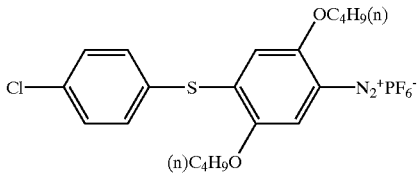

A-3

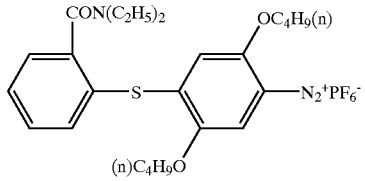

A-4

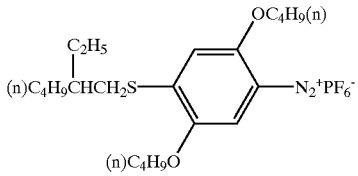

B-1

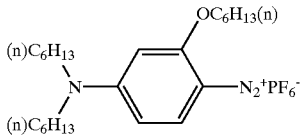

B-2

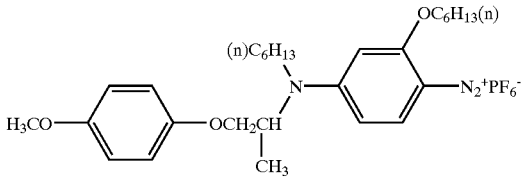

B-3

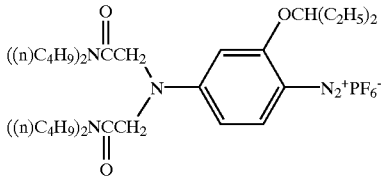

B-4

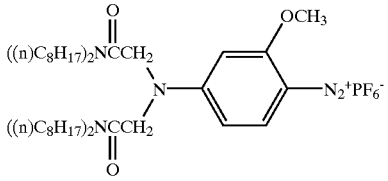

B-5

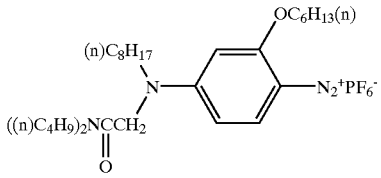

-continued

B-6

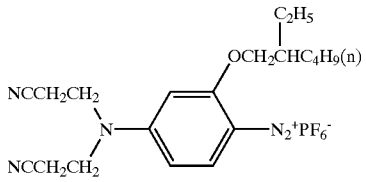

B-7

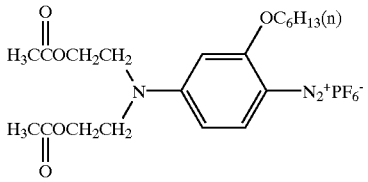

B-8

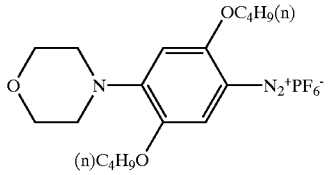

B-9

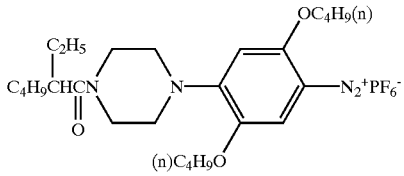

B-10

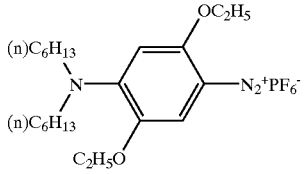

C-1

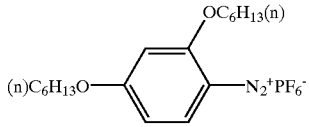

In the invention, the diazonium salts represented by the general formulae (A) to (C) may be used alone or in a combination of two or more. Further, according to purposes such as adjustment of hue, any of the diazonium salts represented by the general formulae (A) to (C) may be used in combination with a conventional diazonium salt.

The content of the diazonium salt in the heat-sensitive recording material of the invention is preferably 0.02 to 3 $g/m^2$, more preferably 0.1 to 2 $g/m^2$, in the heat-sensitive recording layer.

It is preferable that the cyan heat-sensitive recording layer contains as a coupler at least one of the compound represented by the following general formula (D), the compound represented by the following general formula (E), and the compound represented by the following general formula (F). These couplers provide a good cyan hue and a sufficient color density and improve image preservability against light or heat when coupled with a diazonium salt. Other effects to be brought about at the same time include that the color-forming reaction takes place efficiently and thus $D_{max}$ is produced by a smaller amount of a diazonium salt and that the fixation sensitivity, stains, etc. can be reduced because the amount of the diazonium salt is reduced.

General formula (D)

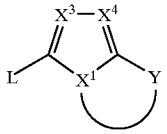

General formula (E)

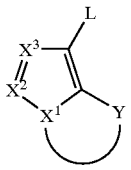

General formula (F)

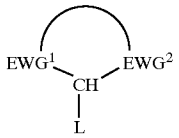

In the general formulae (D) to (F), $X^1$, $X^2$, $X^3$, and $X^4$ each independently represent an atomic group required for the formation of a 5-membered aromatic heterocyclic group. Y represents an amino group, a substituted amino group, a hydroxyl group, an alkoxy group, or an alkyl group that may have a substituent. L represents a substituent that can leave at the time of coupling with a diazonium salt. $EWG^1$ and $EWG^2$ each independently represent an electron attractive group. $X^1$ and Y, and $EWG^1$ and $EWG^2$ may join together, respectively, to form a heterocycle.

Among the compounds represented by the general formulae (D) to (F), particularly preferable are the pyrrolopyrimidineone compounds represented by the following general formula (G) and the pyrrolotriazineone compounds represented by the following general formula (H).

General formula (G)

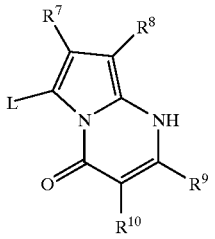

General formula (H)

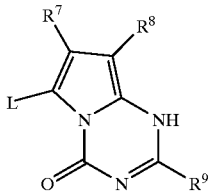

In the general formulae (G) and (H), $R^7$ and $R^8$ each independently represent a hydrogen atom, a halogen atom, an aryl group, an alkyl group, a cyano group, an acyl group, a carbamoyl group, an alkoxycarbonyl group, an aryloxycarbonyl group, an alkylsulfonyl group, or an arylsulfonyl group. $R^9$ represents an amino group, a substituted amino group, a hydroxyl group, an acyloxy group, an arylcarboxyl group, an alkoxy group, an aryloxy group, an alkylthio group, or an arylthio group. $R^{10}$ represents a hydrogen atom, a halogen atom, or an electron attractive group whose Hammett substituent constant $\sigma_p$ is 0.2 or more. L represents a substituent that can leave when the compound reacts with a diazonium salt.

Among the substituents represented by $R^7$ and $R^8$, preferably at least one of $R^7$ and $R^8$ is an electron attractive group whose Hammett substituent constant $\sigma_p$ is 0.20 or more. More preferably at least one of $R^7$ and $R^8$ is an electron attractive group whose Hammett substituent constant $\sigma_p$ is 0.35 or more.

Among the electron attractive groups each having a Hammett substituent constant $\sigma_p$ of 0.20 or more, preferred examples of the groups include, but are not limited to, a cyano group (the constant $\sigma_p$ is 0.66), a perfluoroalkyl group (e.g., trifluoromethyl group whose constant $\sigma_p$ is 0.54), an acyl group (e.g., acetyl group whose constant $\sigma_p$ is 0.50 and a benzoyl group whose constant $\sigma_p$ is 0.43), a carbamoyl group (the constant $\sigma_p$ is 0.36), an alkoxycarbonyl group (e.g., ethoxycarbonyl group whose constant $\sigma_p$ is 0.45), etc.

Examples of the halogen atom include a fluorine atom, a chlorine atom, a bromine atom, etc. Among these halogen atoms, a fluorine atom and a chlorine atom are preferable.

In the general formula (G), preferred examples of the electron attractive group represented by $R^{10}$ whose Hammett substituent constant $\sigma_p$ is 0.2 or more include, but are not limited to, an aryl group, a cyano group, an acyl group, a carbamoyl group, an alkoxycarbonyl group, an aryloxycarbonyl group, an alkylsulfonyl group, an arylsulfonyl group, an alkylphosphoryl group, an arylphosphoryl group, a perfluoroalkyl group, etc.

Details of the pyrrolopyrimidineone compounds and the pyrrolotriazineone compounds are described in the specifications of Japanese Patent Application Nos. 11-101546, 11-114929, and 11-317792. All of the compounds described in these specifications can be advantageously used in the invention.

Specific examples of the couplers represented by the general formulae (D) to (F) are given below, but it should be understood that the invention is not restricted to these examples.

C-74

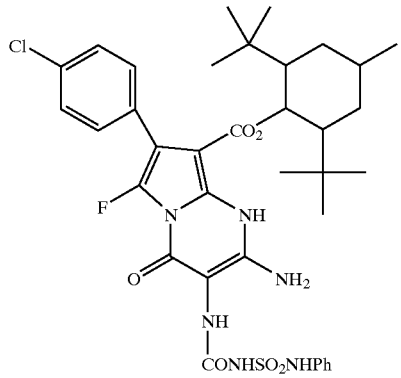

-continued
C-75
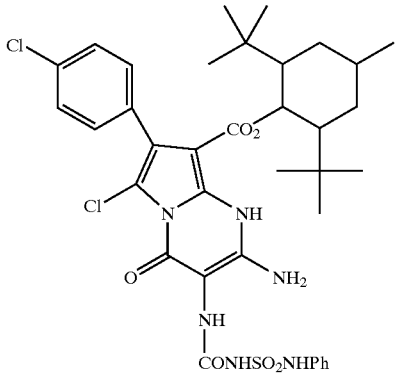
C-76
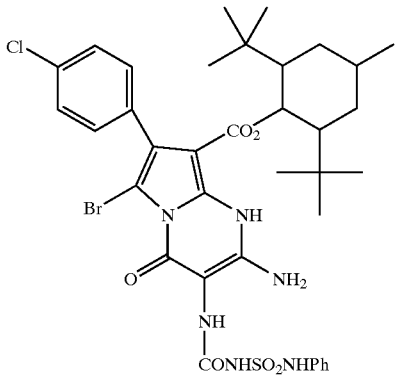
C-77
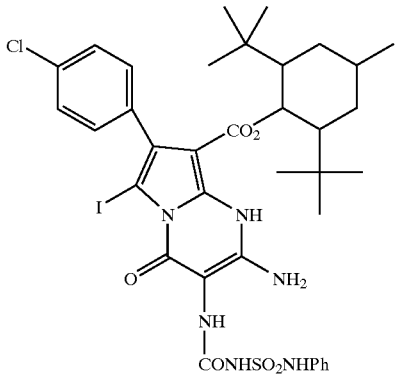
C-78
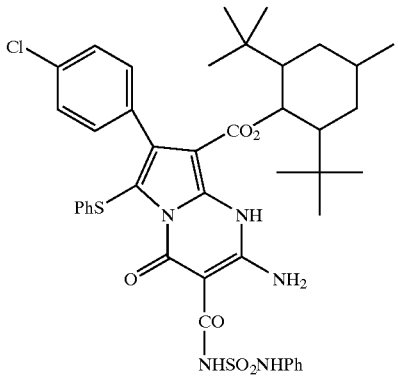
-continued
C-79
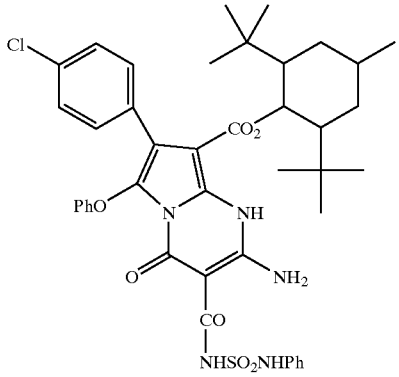
C-80
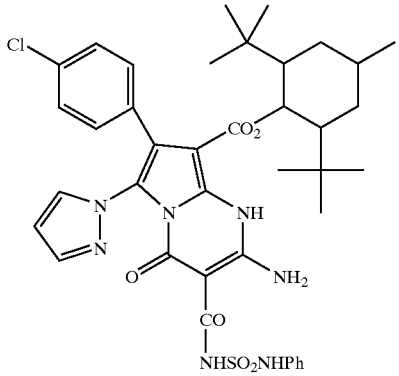
C-81
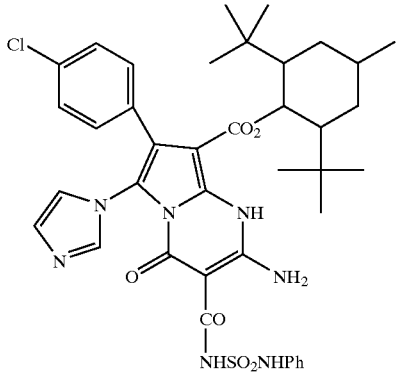
C-82
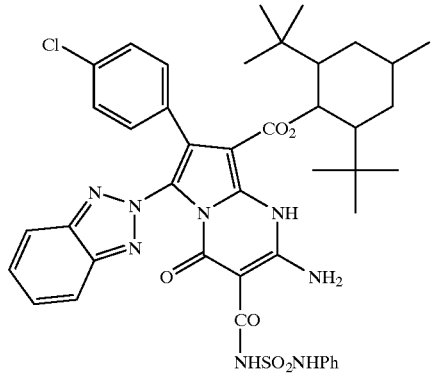

-continued
C-83
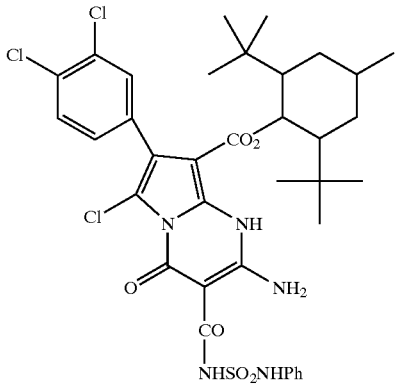
C-84
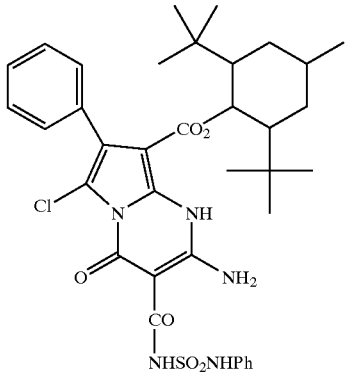
C-85
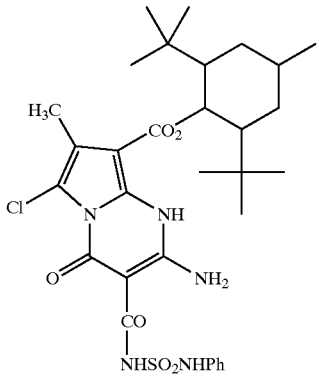
C-86
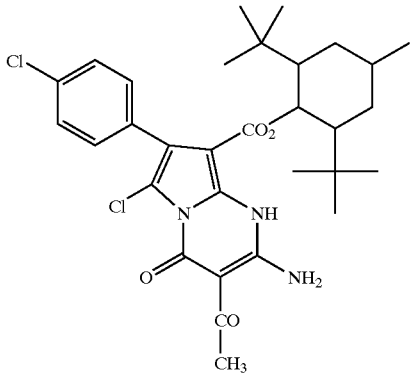
-continued
C-87
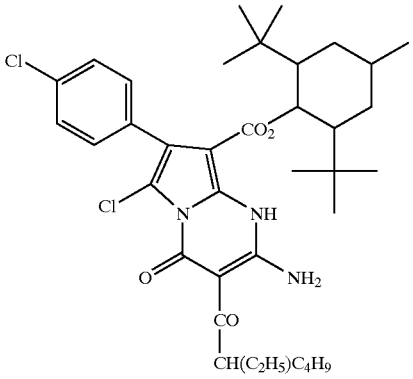
C-88
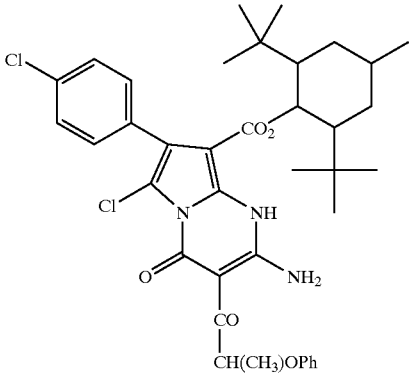
C-89
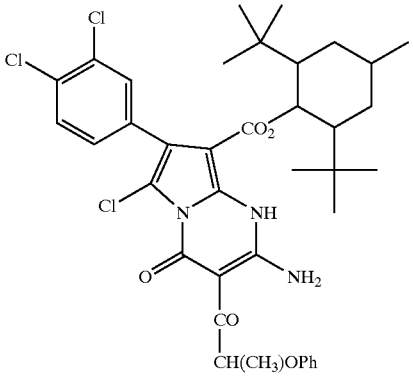
C-90
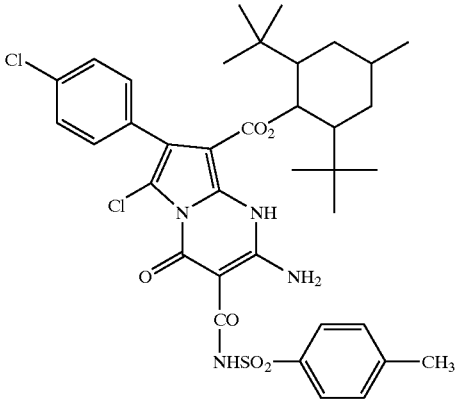

-continued
C-91
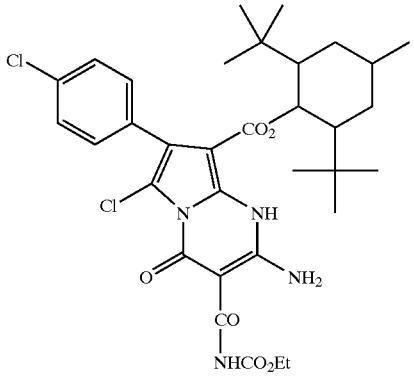
C-92
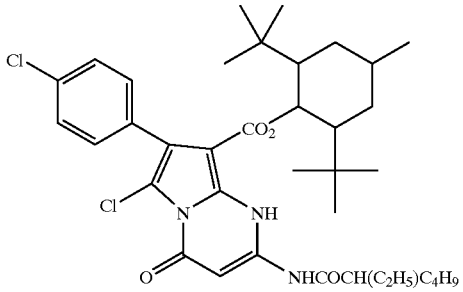
C-93
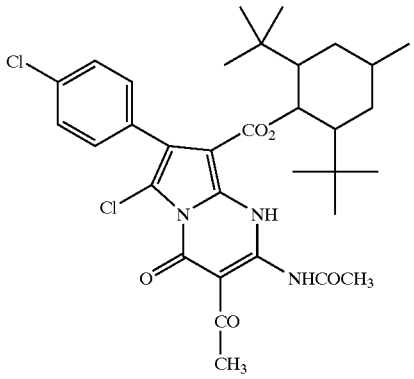
C-94
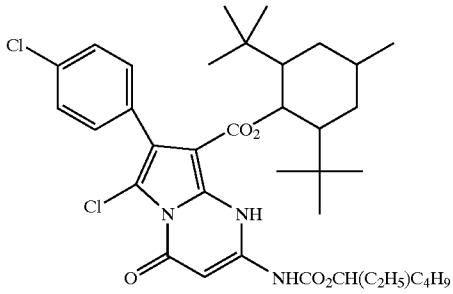
C-95
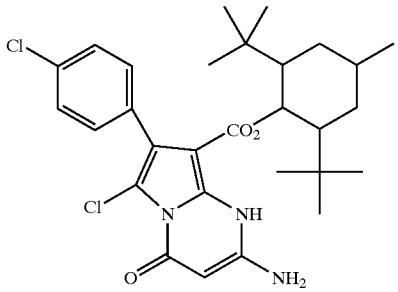
-continued
C-96
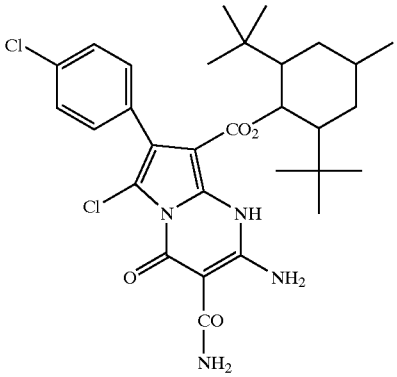
C-97
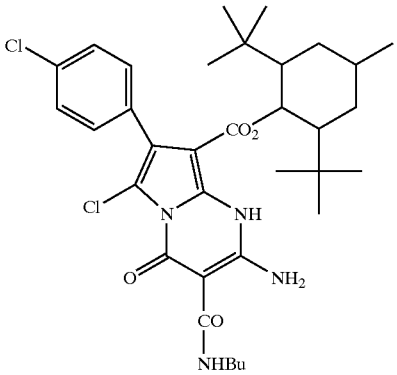
C-98
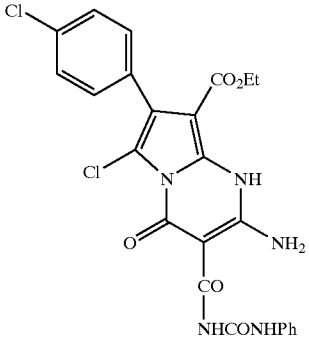
C-99
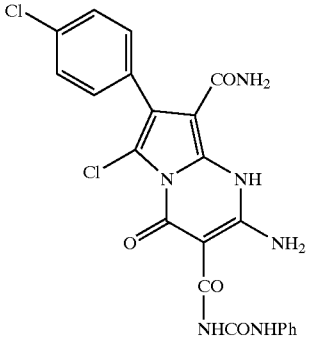

-continued
C-100
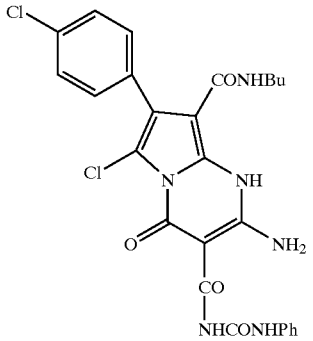
C-101
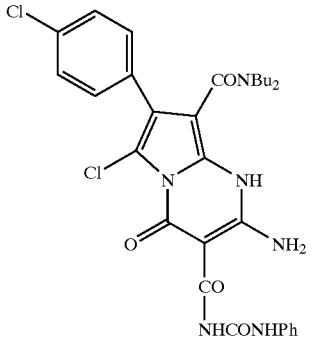
C-102
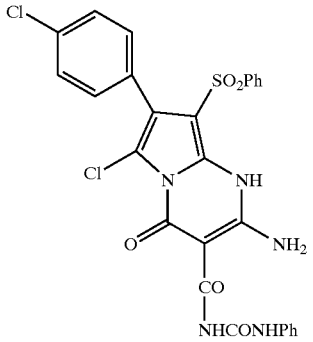
C-103
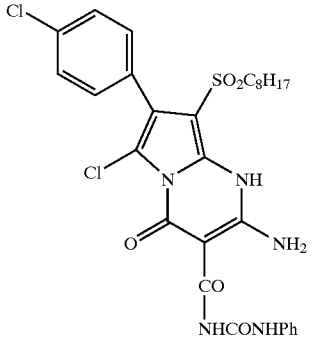
-continued
C-104
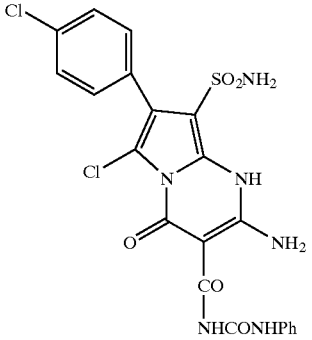
C-105
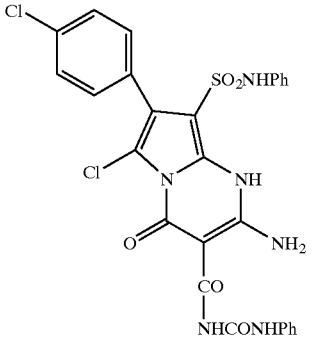
C-106
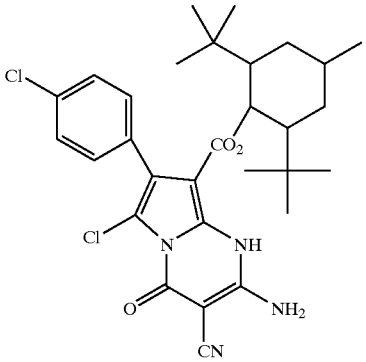
C-107
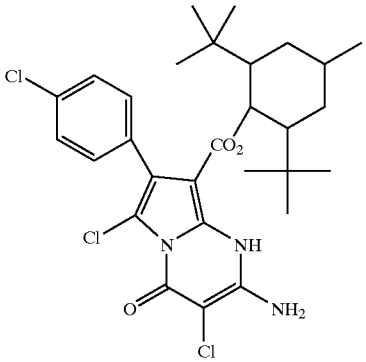

-continued
C-108
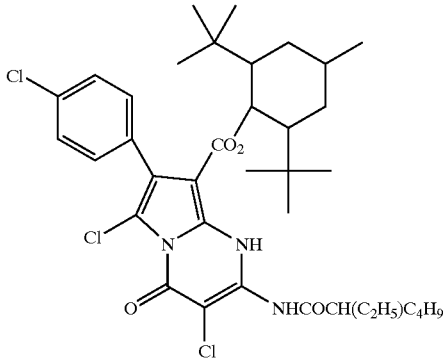
C-109
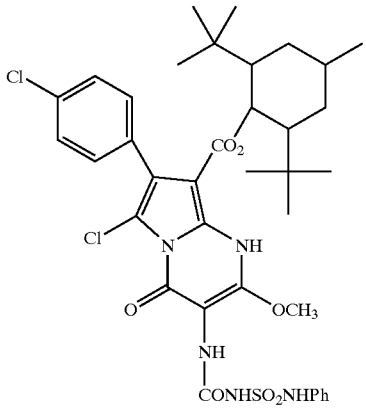
C-110
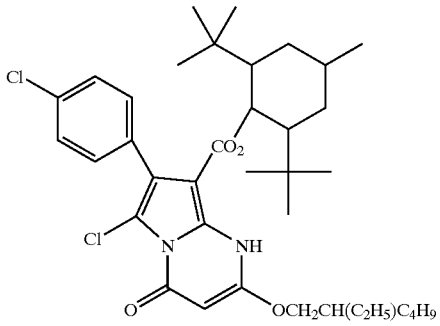
C-111
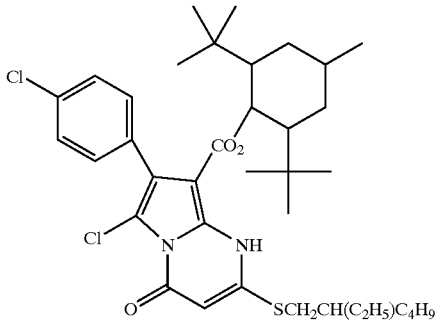
-continued
C-112
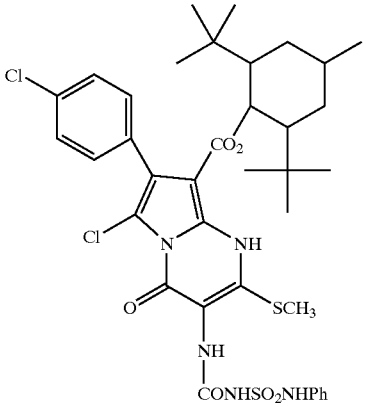
C-113
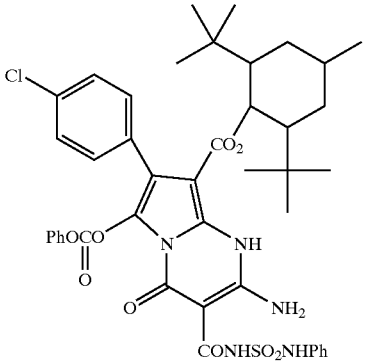
C-114
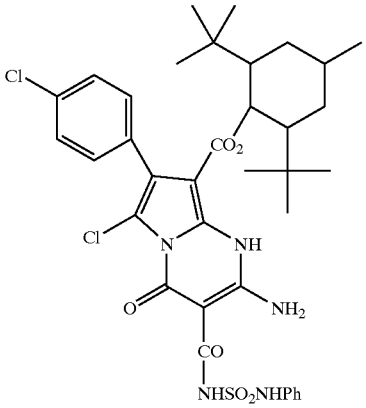
C-115
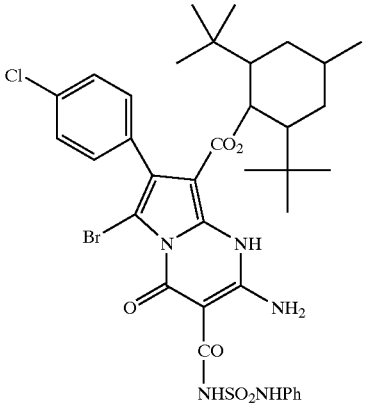

-continued
C-116
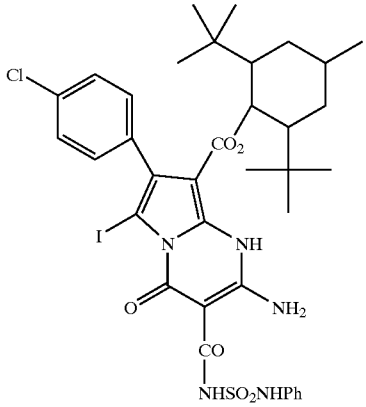
C-117
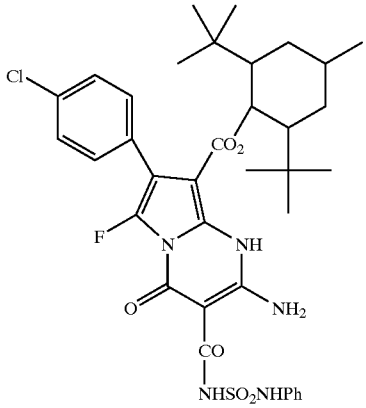
C-118
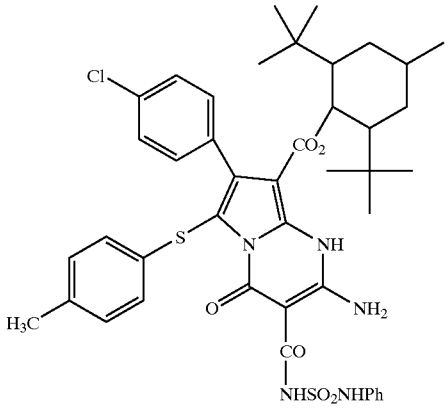
C-119
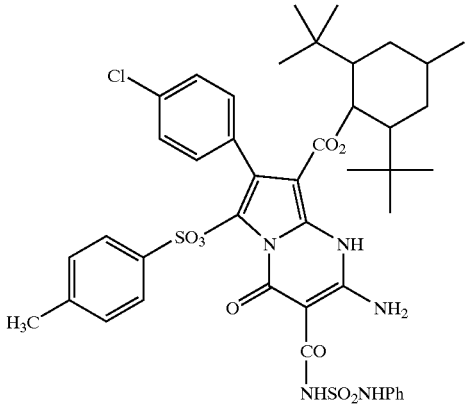
-continued
C-120
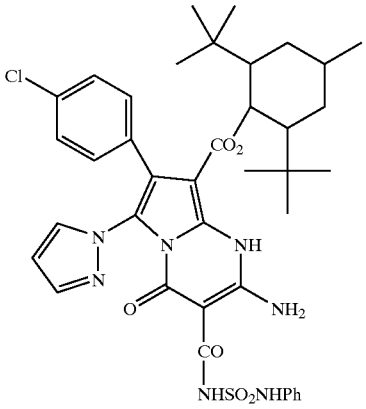
C-121
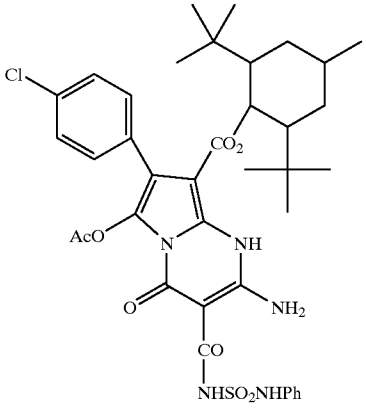
C-122
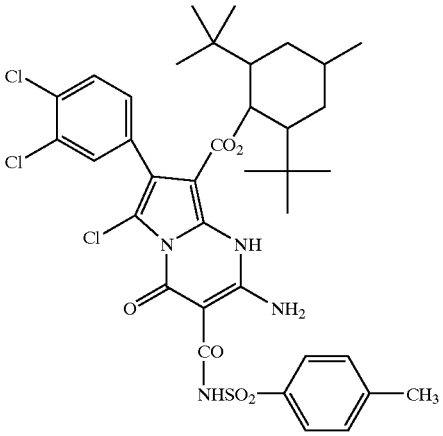
C-123
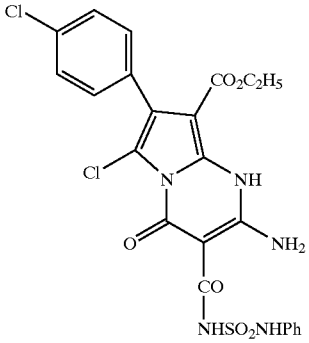

C-124
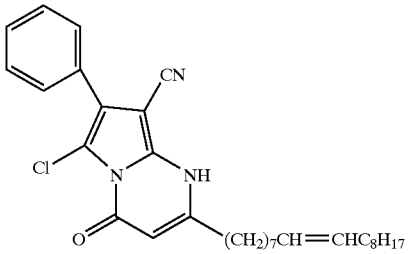
C-125
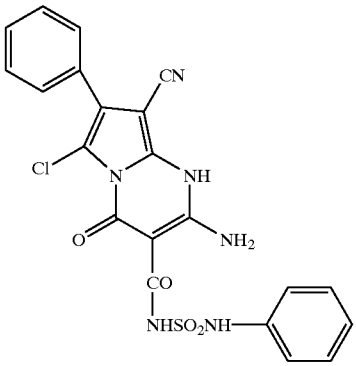
C-126
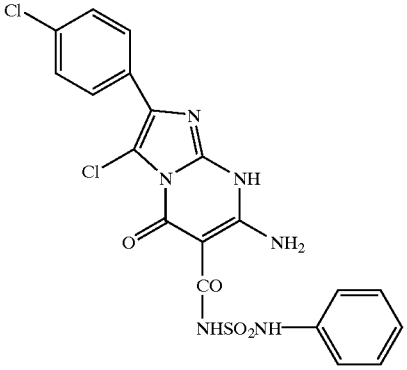
C-127
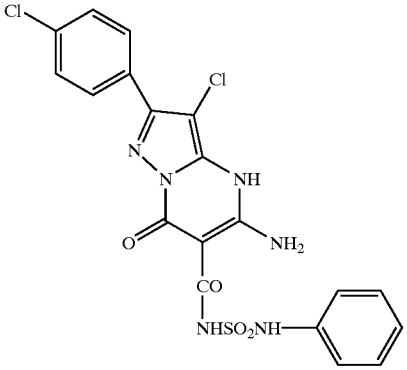
C-128
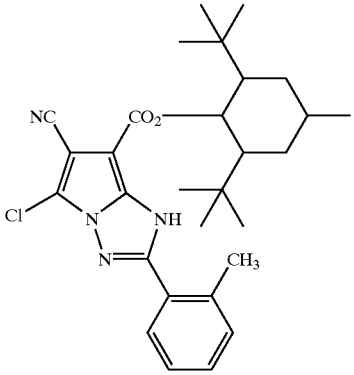
C-129
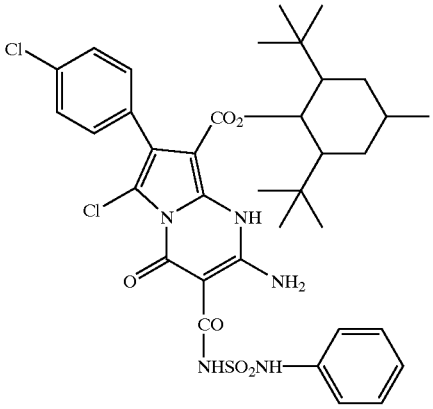
C-130
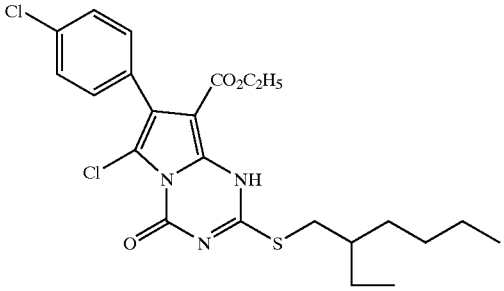
C-131
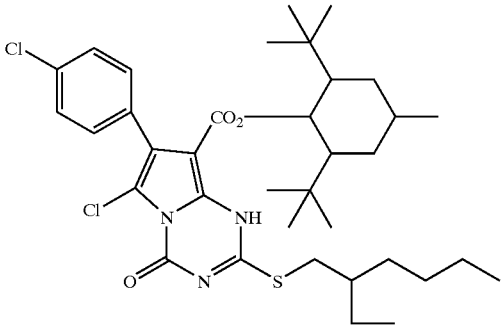

-continued
C-132
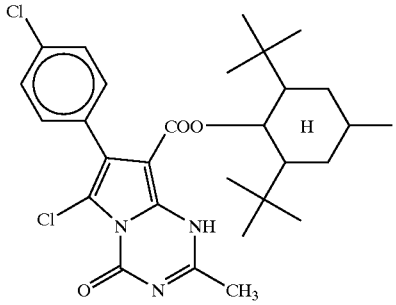
C-133
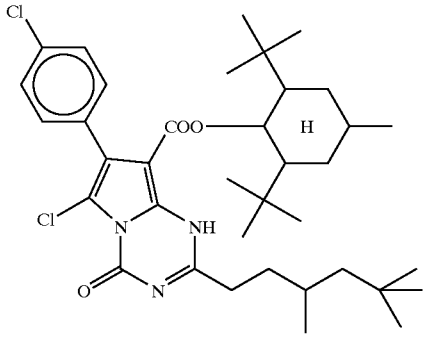
C-134
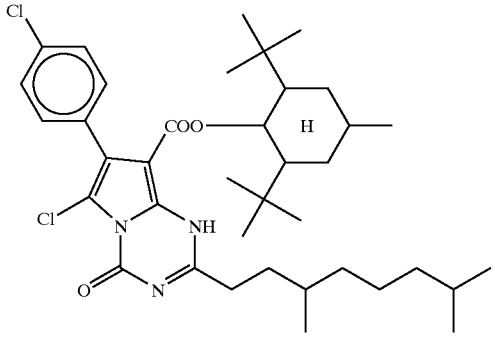
C-135
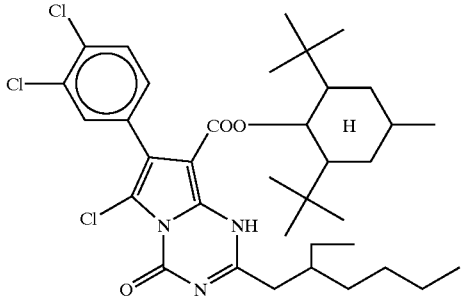
-continued
C-136
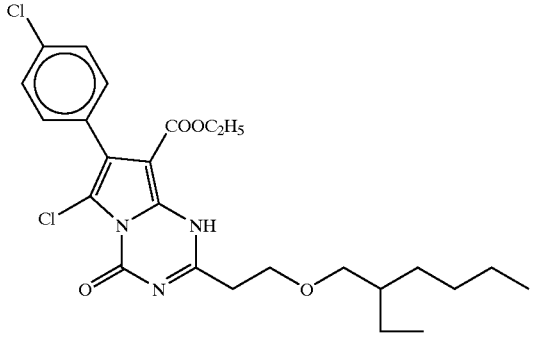
C-137
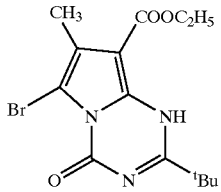
C-138
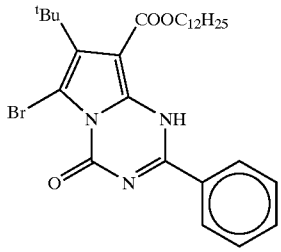
C-139
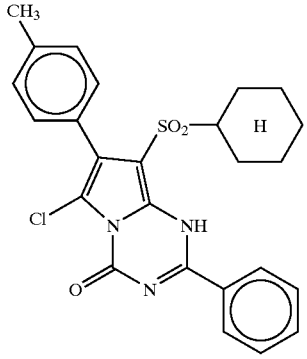
C-140
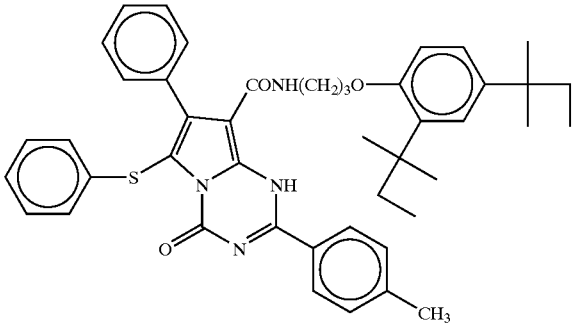

-continued
C-141
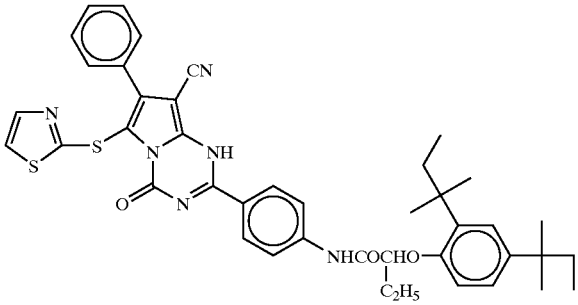
C-142
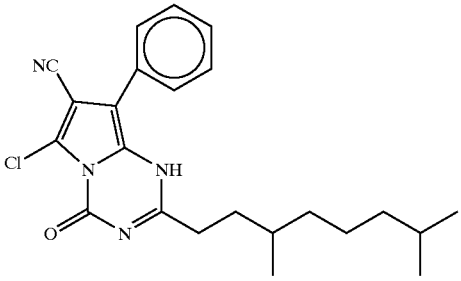
C-143
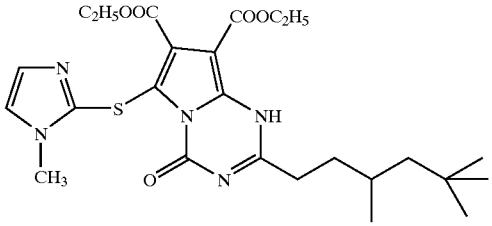
C-144
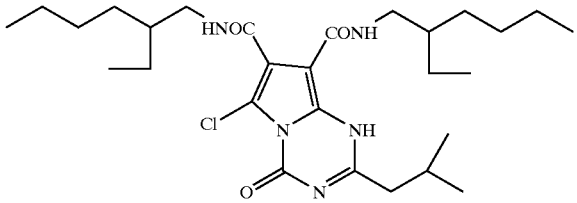
C-145
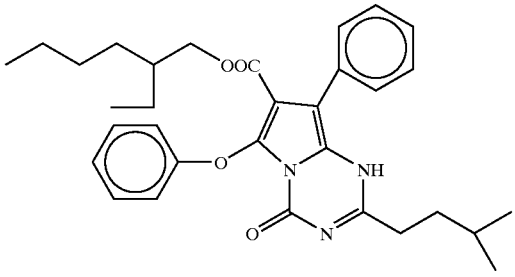
-continued
C-146
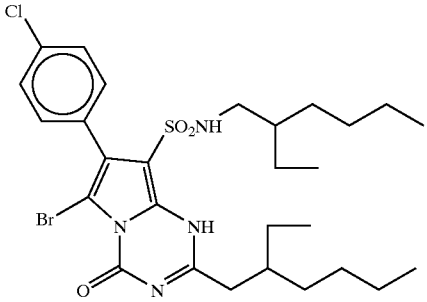
C-147
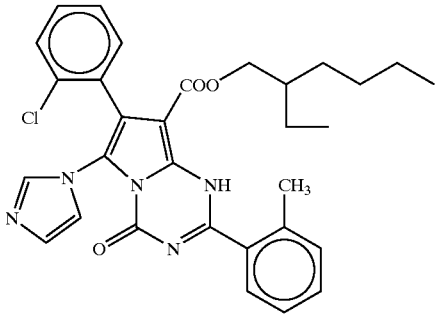
C-148
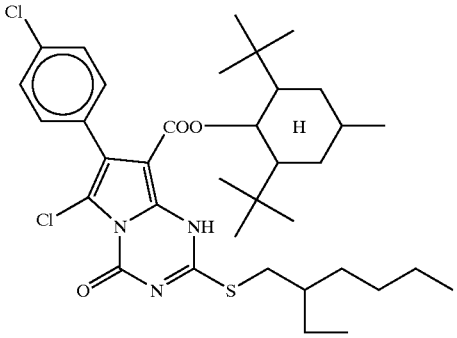
C-149
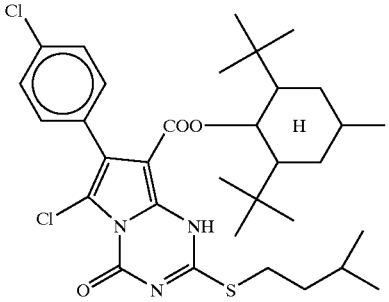
C-150
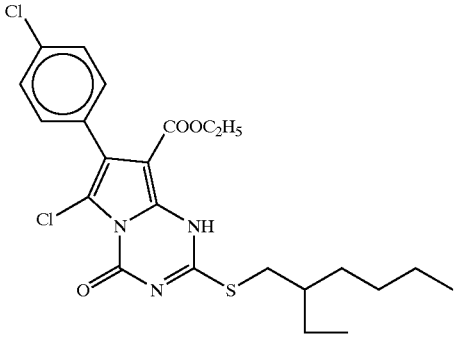

C-151
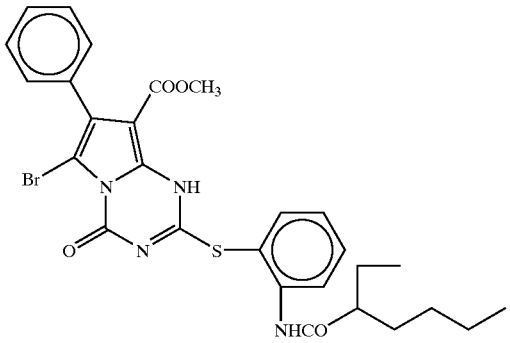
C-152
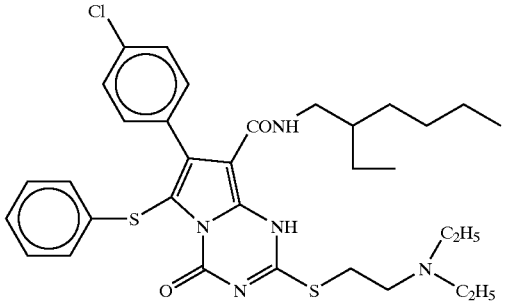
C-153
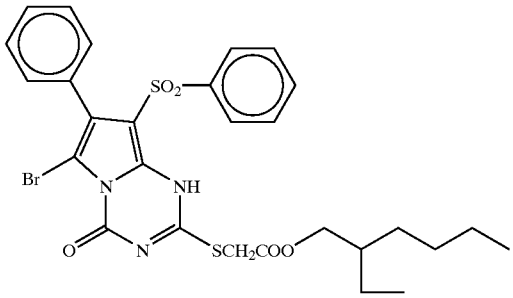
C-154
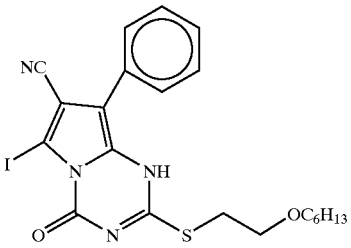
C-155
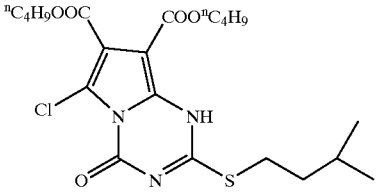
C-156
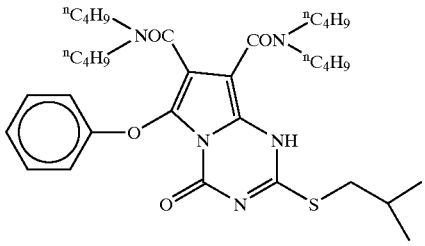
C-157
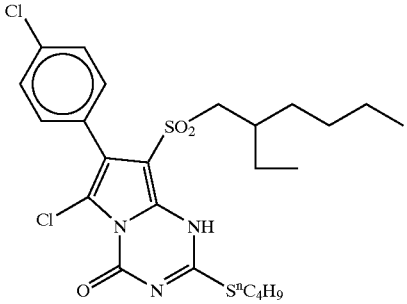
C-158
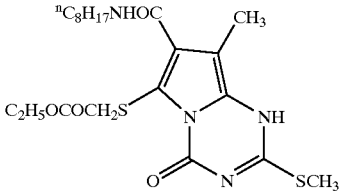
C-159
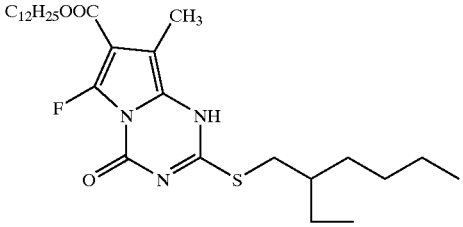
C-160
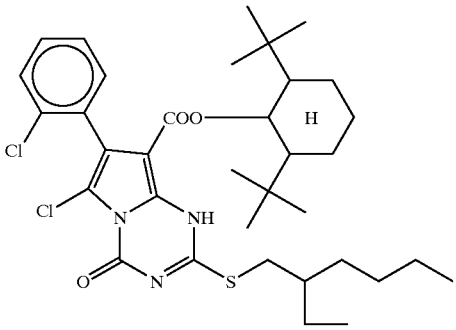

-continued
C-161
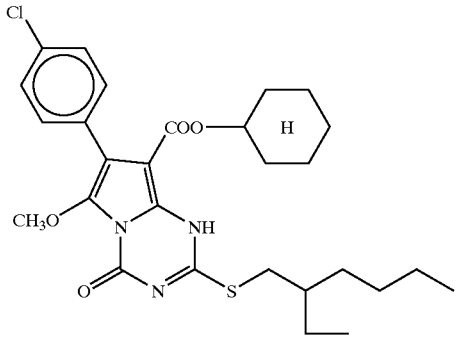
C-162
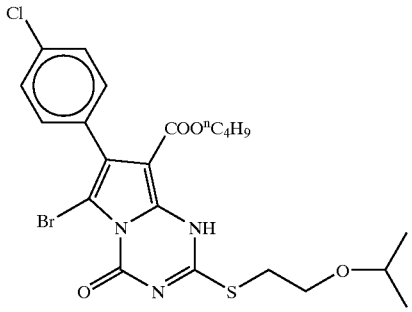
C-163
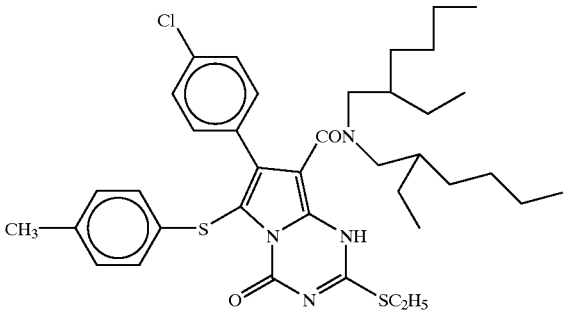
C-164
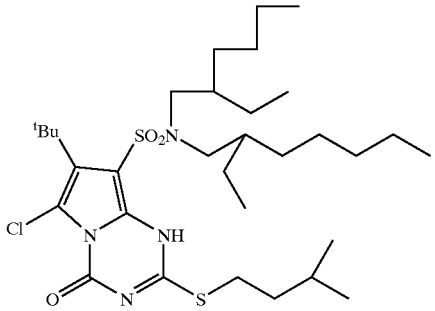
C-165
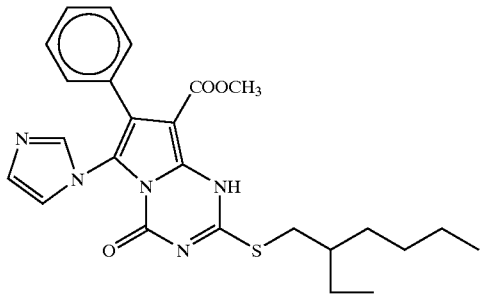
-continued
C-166
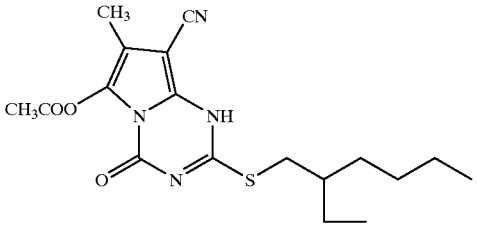
C-167
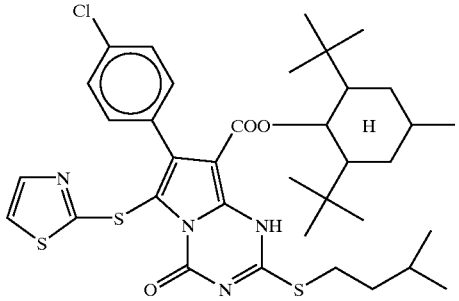
C-168
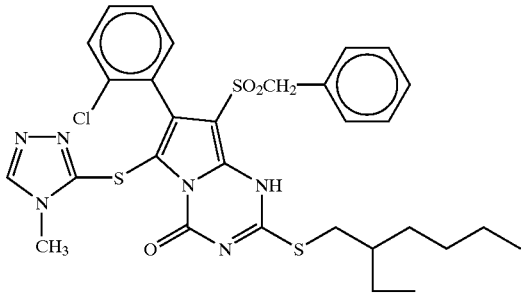
C-169
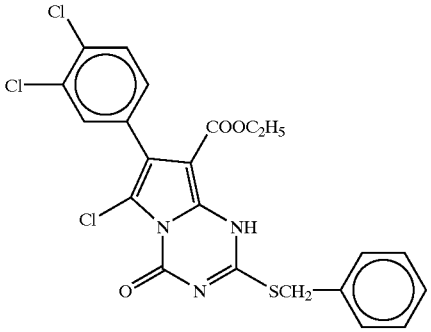
C-170
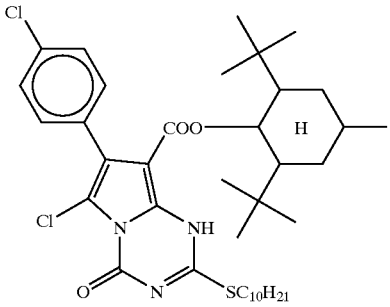

-continued
C-171
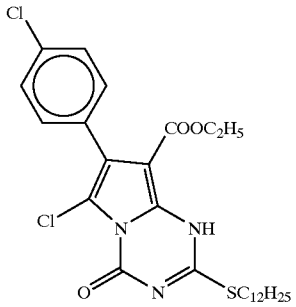
C-172
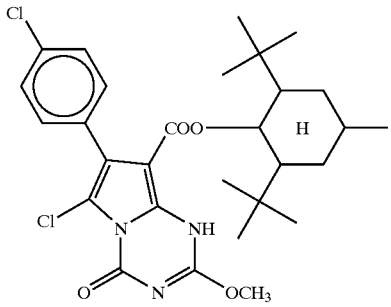
C-173
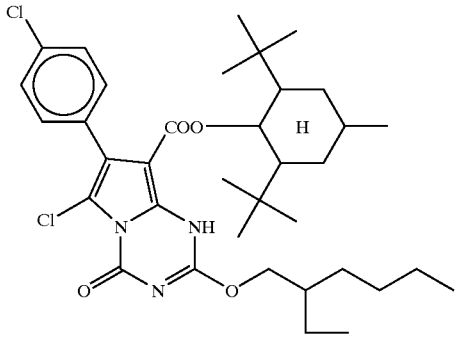
C-174
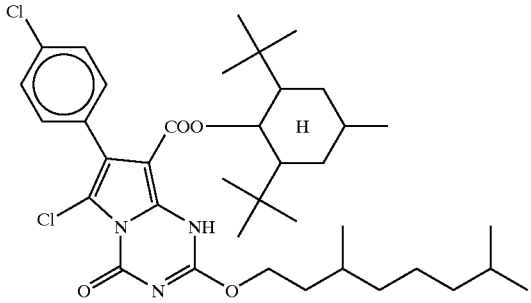
C-175
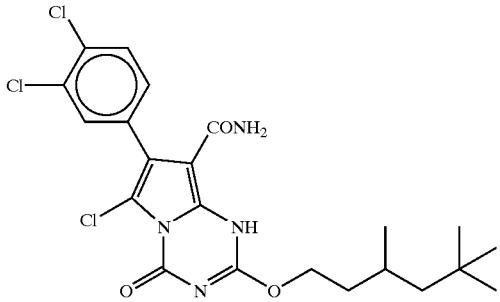
-continued
C-176
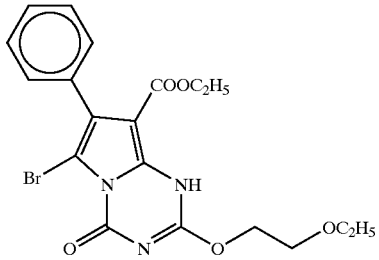
C-177
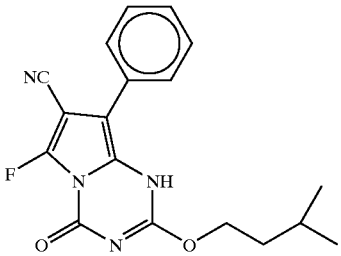
C-178
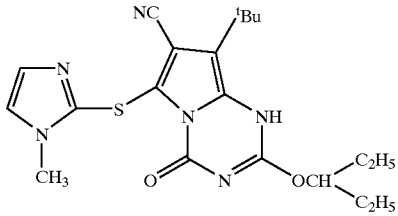
C-179
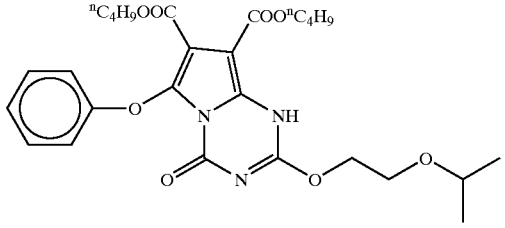
C-180
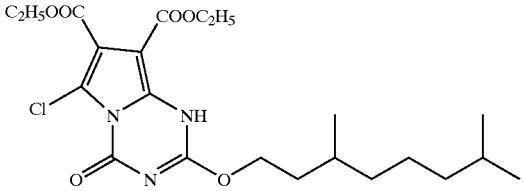
C-181
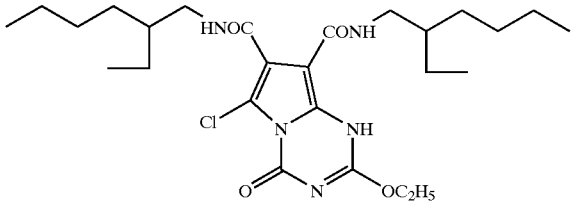

-continued
C-182
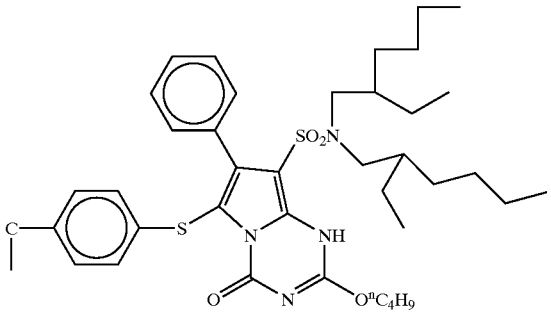
C-183
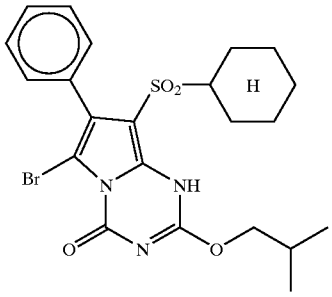
C-184
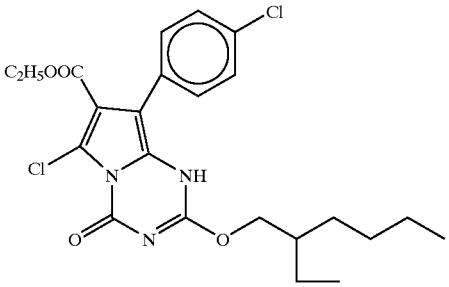
C-185
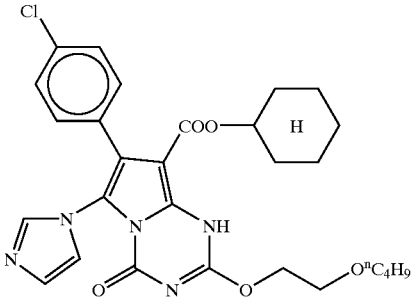
C-186
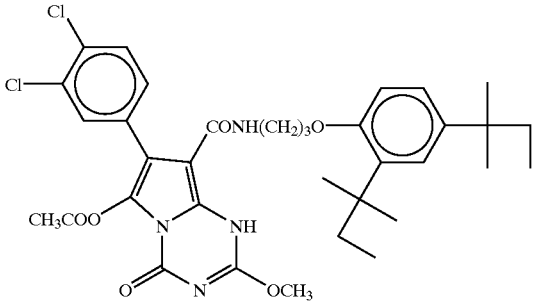
-continued
C-187
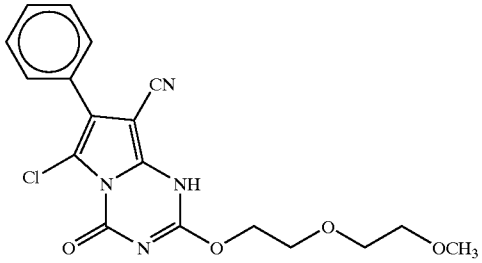
C-188
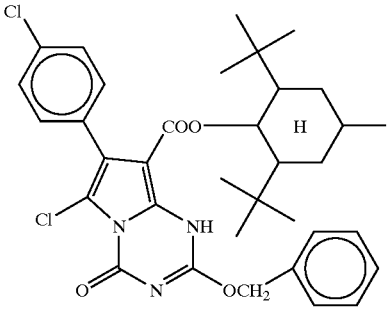
C-189
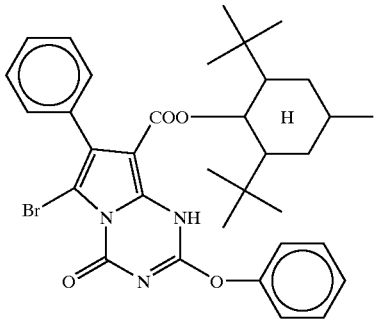
C-190
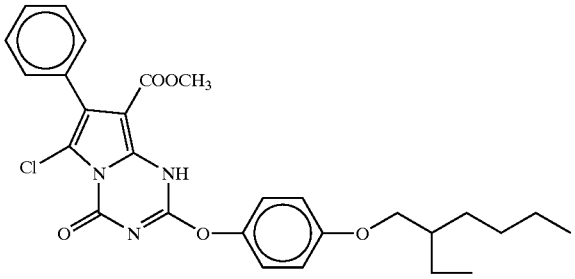
C-191
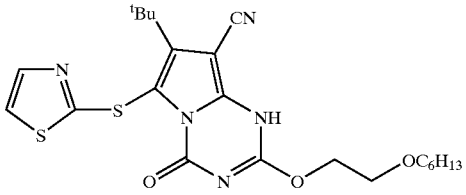

-continued
C-192
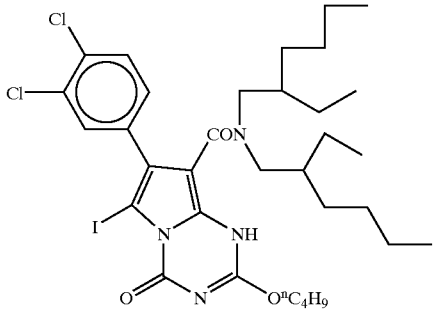
C-193
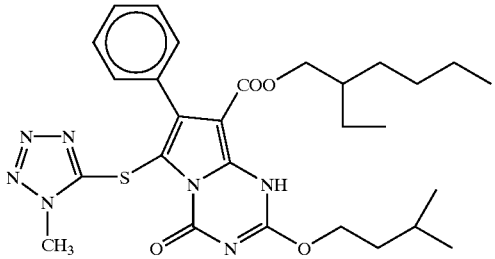
C-194
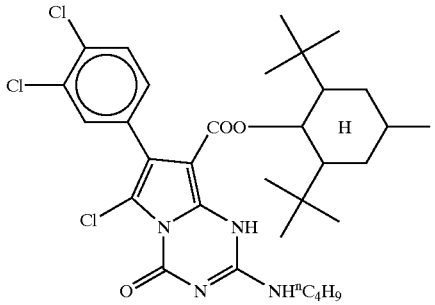
C-195
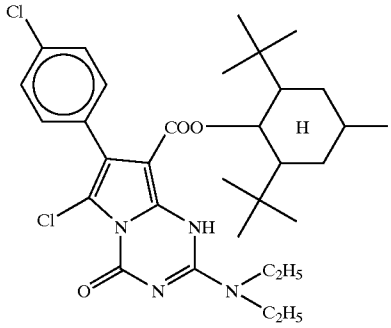
C-196
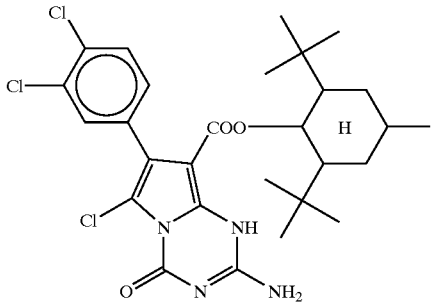
-continued
C-197
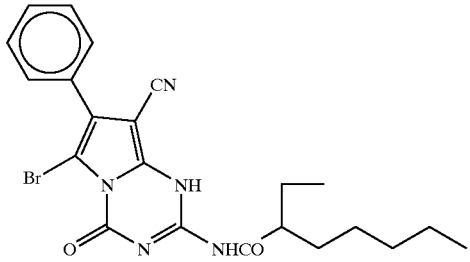
C-198
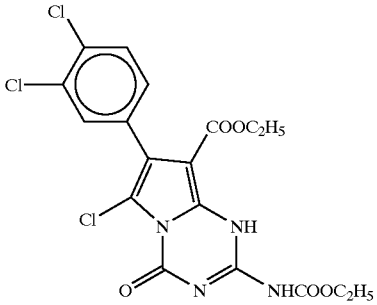
C-199
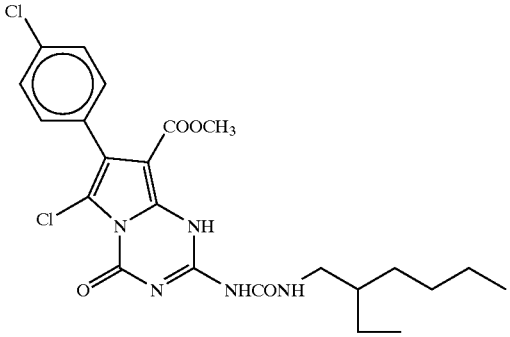
C-200
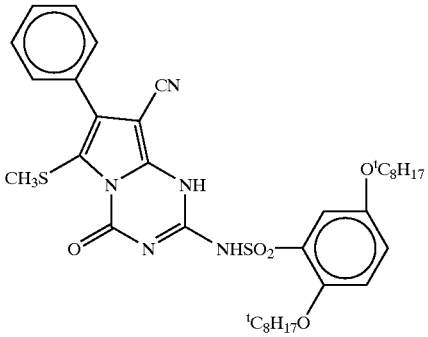
C-201
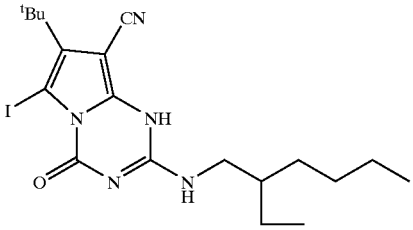

-continued

C-202

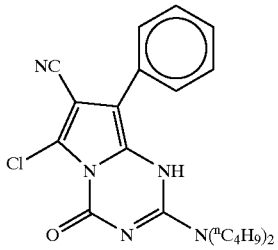

C-203

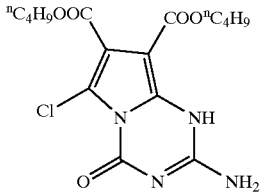

C-204

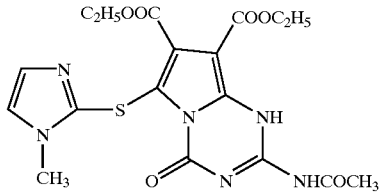

C-205

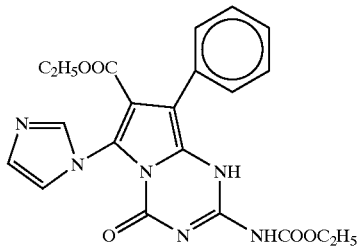

C-206

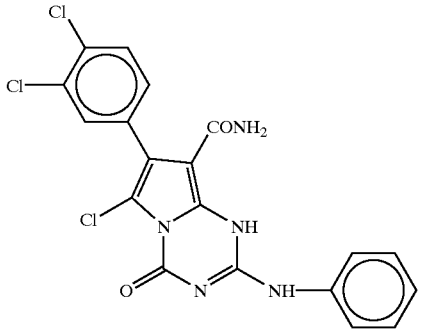

C-207

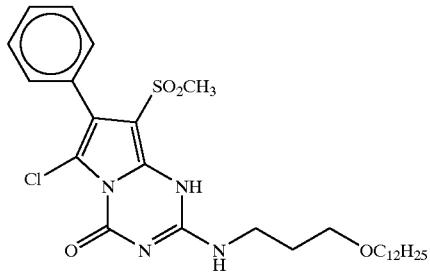

-continued

C-208

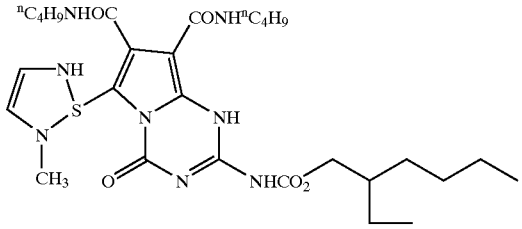

C-209

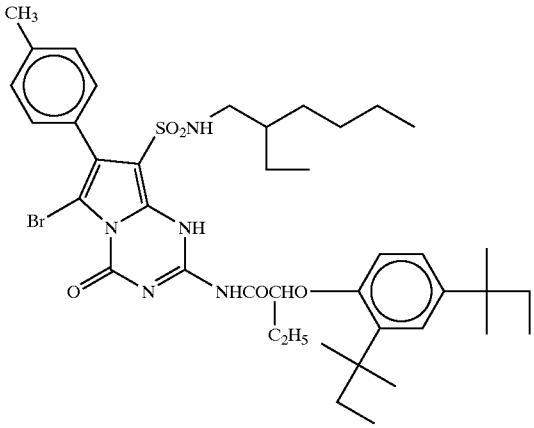

The above-mentioned couplers that can be used in the cyan heat-sensitive recording layer may be used together with a conventionally known coupler according to purposes such as adjustment of hue. Examples of the conventionally known coupler that can be used together include a so-called active methylene compound having a methylene group adjacent to a carbonyl group, a phenol derivative, and a naphthol derivative. The compounds exemplified below can be used in so far as these compounds meet the purpose of the invention. Examples of the conventionally known couplers include the conventionally known couplers exemplified for use in the yellow heat-sensitive recording layer.

In the heat-sensitive recording material of the invention, for the purpose of accelerating the coupling reaction, it is preferable that the heat-sensitive recording layer contains a reducing agent such as aminophenol compounds, phenol compounds, catechol compounds, hydroquinone compounds, amine compounds, hydroxylamine compounds, alcohol compounds, thiol compounds, sulfide compounds, an alkali metal, an alkaline earth metal, a metal hydride, hydrazine compounds, phenidone compounds, aniline compounds, phenylether compounds, an L-ascorbic acid, etc. Among these reducing agents, hydroquinone compounds, catechol compounds, aminophenol compounds are preferable. Specific examples of these reducing agents include, but are not limited to, the exemplary compounds (R-1) to (R-55) described in paragraphs [0067] to [0070] in the specification of Japanese Patent Application No. 2000-116580.

These reducing agents may be dispersed as fine solid particles in the recording layer. The reducing agent may also be used as an emulsion prepared by dissolving the reducing agent alone in an oil. Further, the reducing agent may be added to the oil phase of the emulsion of a coupler. Still further, when the diazo compound or the coupler is enclosed in microcapsules, the reducing agent may be added to the interior of the microcapsules or to both the interior and the exterior of the microcapsules.

The content (mol) of the reducing agent is preferably 1 to 10 times, and more preferably 1 to 4 times as large as the amount (mol) of the diazo compound. When the mol of the reducing agent added is less than that of the diazo compound, color-formability or image preservability may not be sufficiently improved. When the mol of the reducing agent added is more than 10 times the mol of the diazo compounds, the improvement of color-formability may become inconsequential or the preservability of the heat-sensitive recording material may be reduced.

In the cyan heat-sensitive recording layer, the total mol of the coupler(s) added is preferably 0.2 to 8 times, and more preferably 1 to 5 times as large as the mol of the diazonium salt added in the cyan heat-sensitive recording layer from the standpoint of the effects.

When the total mol of the coupler(s) added is less than 0.2 times as large as the mol of the diazonium compound added, sufficient color-formability may not be obtained. On the other hand, when the total mol of the coupler(s) added is more than 8 times, the coatability may deteriorate.

The coupler for use in the invention can be used as a solid-state dispersion prepared by dispersing the coupler together with other components in the presence of a water-soluble polymer in a sand mill or the like. But, it is preferable that the coupler is used as an emulsion prepared by emulsifying the coupler in the presence of a suitable emulsifying aid. The solid-state dispersing method and the emulsifying method are not particularly limited, and methods hitherto known can be employed. The details of these methods are described in JP-A Nos. 59-190886, 2-141279, and 7-17145.

Magenta Heat-Sensitive Recording Layer

The magenta heat-sensitive recording layer is provided as the outermost layer (uppermost layer) of the heat-sensitive recording layers in the heat-sensitive recording material of the invention. From the standpoint of effects, the maximum absorption wavelength $\lambda_{max}$ of the diazo compound or the like for use in the magenta heat-sensitive recording layer is preferably 460 nm or less and more preferably 430 to 460 nm. If the diazo compound or the like has $\lambda_{max}$ on a longer wavelength side relative to the above-mentioned wavelength region, the preservability of the raw heat-sensitive recording material may become inferior. On the other hand, if the diazo compound or the like has $\lambda_{max}$ on a shorter wavelength side relative to the above-mentioned wavelength region, the fixation rate may be reduced. It is preferable that the diazo compound or the like that can be used in the magenta heat-sensitive recording layer is a diazonium salt represented by the following general formula (8):

General formula (8)

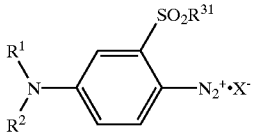

wherein $R^1$ and $R^2$ each represent a hydrogen atom, an alkyl group, or an aryl group; $R^{31}$ represents an alkyl group or an aryl group; and $X^-$ represents an acid anion.

In the general formula (8), $R^1$, $R^2$, and $R^{31}$ each represent a hydrogen atom, an alkyl group, or an aryl group; and $X^-$ represents an acid anion. Since $R^1$ and $R^2$ in the general formula (8) are same as $R^1$ and $R^2$, respectively, in the following general formula (1), $R^1$ and $R^2$ will be described later. The alkyl group represented by $R^{31}$ in the general formula (8) may have a substituent and is preferably an alkyl group having 1 to 30 carbon atoms. More specifically, preferred examples of the alkyl groups are methyl, ethyl, n-propyl, isopropyl, n-butyl, t-butyl, sec-butyl, isobutyl, n-pentyl, 2-pentyl, 3-pentyl, isopentyl, n-hexyl, n-octyl, 2-ethylhexyl, 3,5,5-trimethylhexyl, n-dodecyl, cyclohexyl, benzyl, 2-chlorobenzyl, 2-methylbenzyl, 3-chlorobenzyl, 3-methylbenzyl, 3-methoxybenzyl, α-methylbenzyl, allyl, 2-chloroethyl, methoxycarbonylmethyl, methoxycarbonylethyl, and butoxycarbonylethyl. The aryl group represented by $R^{31}$ may have a substituent and is preferably an aryl group having 6 to 30 total carbon atoms. Specifically, preferred examples of the aryl groups include phenyl, 4-methylphenyl, 3-methylphenyl, 2-methylphenyl, 4-chlorophenyl, and 2-chlorophenyl. It is particularly preferable that the diazonium salt represented by the general formula (8) is a diazonium salt represented by the following general formula (1):

General formula (1)

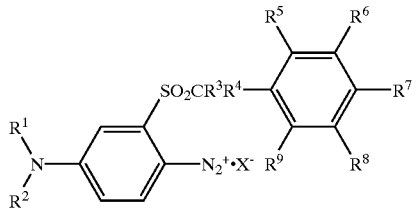

In the general formula (1), $R^1$ and $R^2$ each independently represent a hydrogen atom, an alkyl group, or an aryl group.

The alkyl group is preferably an alkyl group having 1 to 20 carbon atoms and may be unsubstituted or may have a substituent. More specifically, preferred examples of the alkyl group include methyl, ethyl, n-propyl, isopropyl, n-butyl, t-butyl, n-hexyl, n-octyl, 2-ethylhexyl, 3,5,5-trimethylhexyl, n-decyl, n-dodecyl, 2-chloroethyl, 2-methanesulfonylethyl, 2-methoxyethyl, N,N-dibutylcarbamoylmethyl, 2-ethoxycarbonylethyl, butoxycarbonylmethyl, 2-isopropyloxyethyl, 2-(2,5-di-t-amylphenoxy)ethyl, 2-phenoxyethyl, 1-(4-methoxyphenoxy)-2-propyl, 1-(2,5-di-t-amylphenoxy)-2-propyl, allyl, benzyl, α-methylbenzyl, 4-chlorobenzyl, 2-chlorobenzyl, 3,4-dichlorobenzyl, 4-fluorobenzyl, trichloromethyl, trifluoromethyl, 2,2,2-trifluoromethyl, etc.

The aryl group is preferably an aryl group having 6 to 30 carbon atoms and may be unsubstituted or may have a substituent. Examples of the aryl groups include phenyl, 4-methylphenyl, 2-chlorophenyl, etc.

Among these aryl groups, aryl groups having 6 to 10 carbon atoms are preferable. In particular, a phenyl group and a 4-methylphenyl group are preferable.

In the general formula (1), in the case where both $R^1$ and $R^2$ are alkyl groups, $R^1$ and $R^2$ may join together to form a ring structure that contains a nitrogen. Examples of such cyclic group include a pyrrolidino group, a piperidino group, a morpholino group, a 4-octanoylpiperadino group, a 4-(2-(2,4-di-t-amylphenoxy))butanoylpiperadino group, a 4-(2-(n-octyloxy)-5-t-octylphenyl)sulfonylpiperadino group, a hexamethyleneimino group, an indolino group, etc. Among these groups, a pyrrolidino group and a hexamethyleneimino group are preferable.

It is more preferable that at least one of $R^1$ and $R^2$ in the general formula (1) is a methyl group.

$R^3$ and $R^4$ in the general formula (1) each independently represent a hydrogen atom, an alkyl group, an aryl group, or a halogen atom. The alkyl group and the aryl group have the same meaning as in the case of $R^1$ and $R^2$. It is more preferable that at least one of $R^3$ and $R^4$ in the general formula (1) is a methyl group.

Examples of the halogen atom include a fluorine atom, a chlorine atom, a bromine atom, and an iodine atom. Among these halogen atoms, a fluorine atom and a chlorine atom are preferable.

$R^5$, $R^6$, $R^7$, $R^8$, and $R^9$ in the general formula (1) each independently represent a hydrogen atom, an alkyl group, an aryl group, a halogen atom, an alkoxy group, an aryloxy group, an alkoxycarbonyl group, an acyloxy group, a carbamoyl group, an amido group, a cyano group, an alkylthio group, an arylthio group, an alkylsulfonyl group, or an arylsulfonyl group, with the proviso that at least one of $R^5$~$R^9$ represents a halogen atom.

The alkyl group and the aryl group have the same meaning as in the case of $R^1$ and $R^2$. The halogen atom has the same meaning as in the case of $R^3$ and $R^4$.

The alkoxy group is preferably an alkoxy group having 1 to 20 carbon atoms. The alkoxy group may be unsubstituted or may have a substituent. Examples of the alkoxy group include a methoxy group, an ethoxy group, an n-butoxy group, a t-butoxy group, a hexyloxy group, an octyloxy group, a 2-ethylhexyloxy group, a trifluoromethoxy group, a 2-ethoxyethoxy group, a 2-chloroethoxy group, a 2-phenoxyethoxy group, a benzyloxy group, a 2-chlorobenzyloxy group, 4-chlorobenzyloxy group, a 3,4-dichlorobenzyloxy group, an allyloxy-2,4-di-t-amylphenoxyethoxy group, a 2,4-di-t-amylphenoxybutoxy group, etc.

Among these groups, an alkoxy group having 1 to 10 carbon atoms is more preferable. A methoxy group, an ethoxy group, an n-butoxy group, and a benzyloxy group are particularly preferable.

The aryloxy group is preferably an aryloxy group having 6 to 20 carbon atoms. The aryloxy group may be unsubstituted or may have a substituent. Examples of the aryloxy group include a phenoxy group, a 4-methylphenoxy group, a 4-methoxyphenoxy group, a 4-chlorophenoxy group, a 2-chlorophenoxy group, a 2,4-di-t-amylphenoxy group, etc.

Among these groups, an aryloxy group having 6 to 10 carbon atoms is more preferable. A phenoxy group, a 4-methylphenoxy group, and a 4-methoxyphenoxy group are particularly preferable.

The alkoxycarbonyl group is preferably an alkoxycarbonyl group having 2 to 20 carbon atoms. The alkoxycarbonyl group may be unsubstituted or may have a substituent. Examples of the alkoxycarbonyl group include a methoxycarbonyl group, an ethoxycarbonyl group, an n-butoxycarbonyl group, a 2-ethoxyethoxycarbonyl group, etc.

Among these groups, an alkoxycarbonyl group having 2 to 10 carbon atoms is more preferable. A methoxycarbonyl group, an ethoxycarbonyl group, and an n-butoxycarbonyl group are particularly preferable.

The acyloxy group is preferably an acyloxy group having 2 to 20 carbon atoms. The acyloxy group may be unsubstituted or may have a substituent. Examples of the acyloxy group include an acetyloxy group, a butanoyloxy group, a chloroacetyloxy group, a phenoxyacetyloxy group, a benzoyloxy group, etc.

Among these groups, an acyloxy group having 3 to 10 carbon atoms is more preferable. An acetyloxy group, a phenoxyacetyloxy group, and a benzoyloxy group are particularly preferable.

The carbamoyl group is preferably a carbamoyl group having 1 to 20 carbon atoms. The carbamoyl group may be unsubstituted or may have a substituent. Examples of the carbamoyl group include an unsubstituted carbamoyl group, an N,N-dimethylcarbamoyl group, a piperidinocarbonyl group, an N,N-di(2-ethylhexyl)carbamoyl group, etc.

Among these groups, a carbamoyl group having 1 to 10 carbon atoms is more preferable. An unsubstituted carbamoyl group and a piperidinocarbonyl group are particularly preferable.

The amido group is preferably an amido group having 2 to 20 carbon atoms. The amido group may be unsubstituted or may have a substituent. Examples of the amido group include an acetylamino group, a butanoylamino group, a pivaloylamino group, an octanoylamino group, a benzoylamino group, etc.

Among these groups, an amido group having 2 to 10 carbon atoms is more preferable. An acetylamino group and a butanoylamino group are particularly preferable.

The alkylthio group is preferably an alkylthio group having 1 to 20 carbon atoms. The alkylthio group may be unsubstituted or may have a substituent. Examples of the alkylthio group include a methylthio group, an ethylthio group, a butylthio group, an octylthio group, a 2-ethylhexylthio group, a dodecylthio group, a benzylthio group, etc.

Among these groups, an alkylthio group having 1 to 10 carbon atoms is more preferable. A methylthio group, an ethylthio group, a butylthio group, and a benzylthio group are particularly preferable.

The arylthio group is preferably an arylthio group having 6 to 20 carbon atoms. The arylthio group may be unsubstituted or may have a substituent. Examples of the arylthio group include a phenylthio group, 4-chlorophenylthio group, a 2-chlorophenylthio group, and a 4-methylthio group, etc.

Among these groups, an arylthio group having 6 to 10 carbon atoms is more preferable. A phenylthio group and a 2-chlorophenylthio group are particularly preferable.

The alkylsulfonyl group is preferably an alkylsulfonyl group having 1 to 20 carbon atoms. The alkylsulfonyl group may be unsubstituted or may have a substituent. Examples of the alkylsulfonyl group include a methylsulfonyl group, an ethylsulfonyl group, a butylsulfonyl group, an octylsulfonyl group, a dodecylsulfonyl group, a benzylsulfonyl group, etc.

Among these groups, an alkylsulfonyl group having 1 to 10 carbon atoms is more preferable. A methylsulfonyl group, an ethylsulfonyl group, a butylsulfonyl group, and a benzylsulfonyl group are particularly preferable.

The arylsulfonyl group is preferably an arylsulfonyl group having 6 to 20 carbon atoms. The arylsulfonyl group may be unsubstituted or may have a substituent. Examples of the arylsulfonyl group include a phenylsulfonyl group, a 4-chlorophenylsulfonyl group, a 2-chlorophenylsulfonyl group, a 4-methylsulfonyl group, etc.

Among these groups, an arylsulfonyl group having 6 to 10 carbon atoms is more preferable. A phenylsulfonyl group and a 2-chlorophenylsulfonyl group are particularly preferable.

In the general formula (1), in the case where the groups represented by $R^1$ to $R^9$ have substituents, the substituents may each be any one of the diazonium salt represented by the general formula (1) or by the general formula (2) or (6) that will be described later. That is, a dimer of diazonium salts or a polymer having units more than the dimer may be formed.

In the general formula (1), $X^-$ represents ananion. The anion may be an inorganic anion or an organic anion.

Preferred examples of the inorganic anion include a hexafluorophosphate ion, a borofluoride ion, a chloride ion, a sulfate ion, and a hydrogensulfate ion. Among these anions, a hexafluorophosphate ion and a borofluoride ion are preferable.

Preferred examples of the organic anion include a polyfluoroalkylsulfonate ion, a polyfluoroalkylcarboxylate ion, a tetraphenylborate ion, an aromatic carboxylate ion, and an aromatic sulfonate ion. Among these anions, a polyfluoroalkylsulfonate ion is more preferable.

Among the diazonium salts represented by the general formula (1), a diazonium salt represented by the following general formula (2) is preferable.

General formula (2)

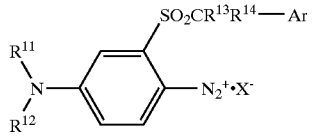

In the general formula (2), $R^{11}$ and $R^{12}$ each independently represent an alkyl group. The alkyl group has the same meaning as in the case of $R^1$ and $R^2$ in the general formula (1). $R^{13}$ and $R^{14}$ each independently represent a hydrogen atom, an alkyl group, or a halogen atom, and the alkyl group has the same meaning as in the case of $R^1$ and $R^2$ and the halogen atom has the same meaning as in the case of $R^3$ and $R^4$ in the general formula (1). $X^-$ represents an anion and has the same meaning as in the general formula (1). It is preferable that at least one of $R^{11}$ and $R^{12}$ and at least one of $R^{13}$ and $R^{14}$ are, respectively, a methyl group.

Ar in the general formula (2) represents the following general formula (3), (4), or (5).

General formula (3)

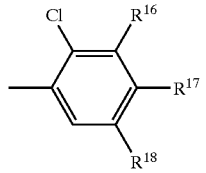

General formula (4)

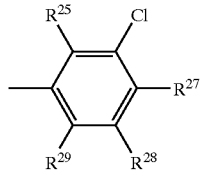

General formula (5)

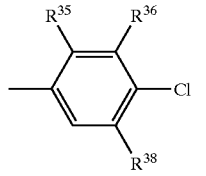

$R^{16}$, $R^{17}$, and $R^{18}$ in the general formula (3) each independently represent a hydrogen atom, an alkyl group, an aryl group, a halogen atom, an alkoxy group, or an aryloxy group. $R^{25}$, $R^{27}$, $R^{28}$ , and $R^{29}$ in the general formula (4) each independently represent a hydrogen atom, an alkyl group, an aryl group, a halogen atom, an alkoxy group, or an aryloxy group, with the proviso that at least one of $R^{25}$ and $R^{29}$ represents a hydrogen atom. $R^{35}$, $R^{36}$, and $R^{38}$ in the general formula (5) each independently represent a hydrogen atom, an alkyl group, an aryl group, an alkoxy group, or an aryloxy group.

In the general formulae (3) to (5), the alkyl groups and aryl groups have the same meaning as in the case of $R^1$ and $R^2$ in the general formula (1); the halogen atom has the same meaning as in the case of $R^3$ and $R^4$ in the general formula (1); and the alkoxy groups and aryloxy groups have the same meaning as in the case of $R^5$ to $R^9$ in the general formula (1).

Among the diazonium salts represented by the general formula (2), a diazonium salt represented by the following general formula (6) is preferable.

General formula (6)

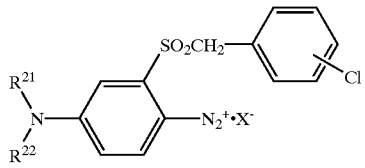

In the general formula (6), $R^{21}$ and $R^{22}$ each independently represent an alkyl group and $X^-$ represents an anion, and the alkyl group and the anion have the same meaning as in the case of $R^1$, $R^2$ , and $X^-$ in the general formula (1). It is preferable that at least one of $R^{21}$ and $R^{22}$ is a methyl group.

The diazonium salt represented by the following general formula (9) is also desirable as a diazonium salt compound that can be used in the magenta heat-sensitive recording layer.

General formula (9)

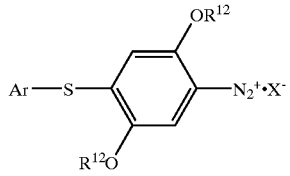

In the general formula (9), Ar represents an aryl group; and $R^{11}$ and $R^{12}$ each represent a substituted or unsubstituted alkyl group having 1 to 18 carbon atoms or a substituted or unsubstituted aryl group having 6 to 20 carbon atoms. In the general formula (9), $R^{11}$ and $R^{12}$ may be the same or different. $X^-$ represents an acid anion.

Specific examples of the diazonium salts represented by the general formulae (1), (2), (6), (8) and (9), respectively, are given below. It should be noted, however, that the invention is not limited to these compounds.

A-43

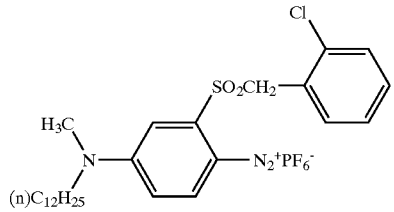

-continued
A-44
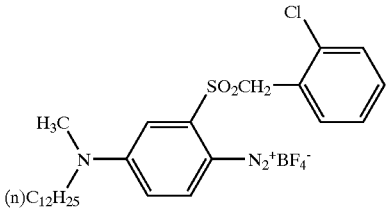
A-45
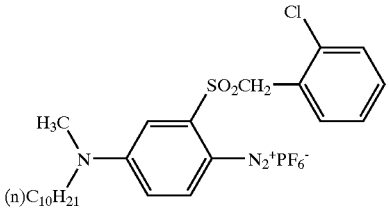
A-46
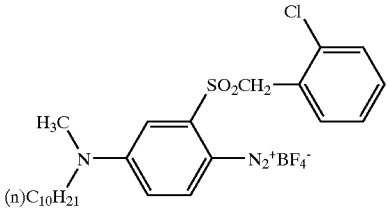
A-47
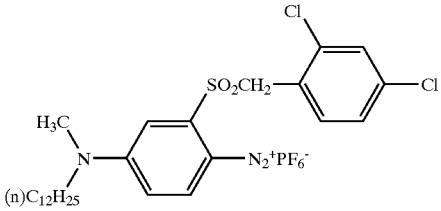
A-48
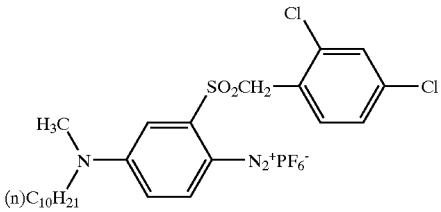
A-49
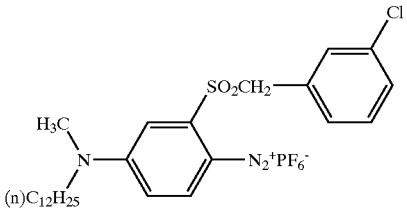
A-50
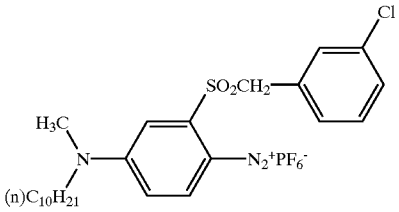
-continued
A-51
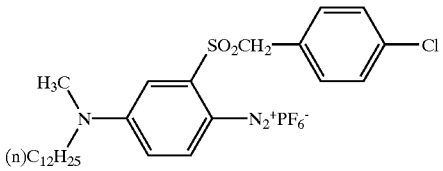
A-52
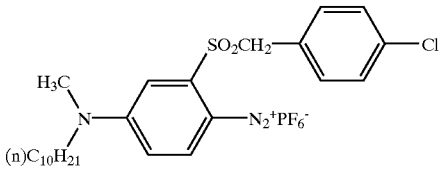
A-53
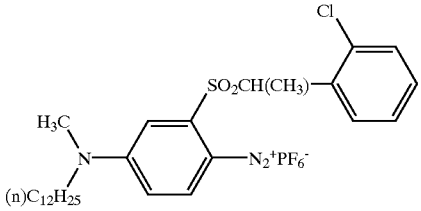
A-54
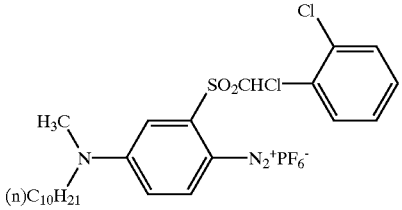
A-55
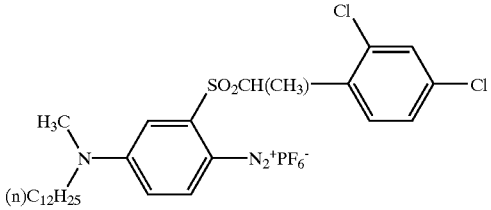
A-56
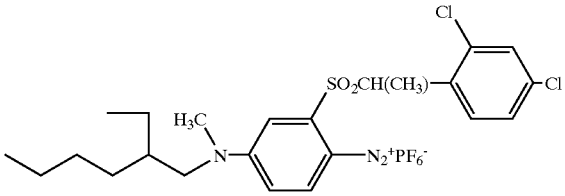
A-57
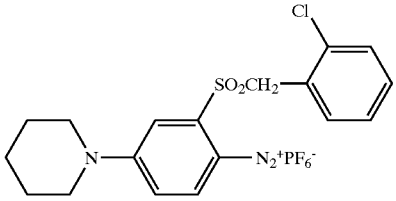

-continued
A-58
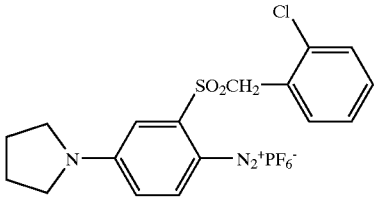
A-59
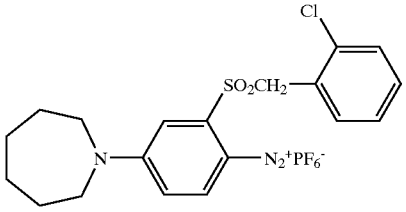
A-60
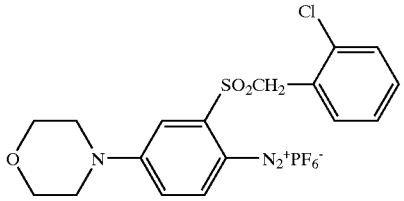
A-61
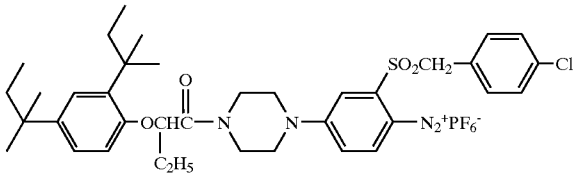
A-62
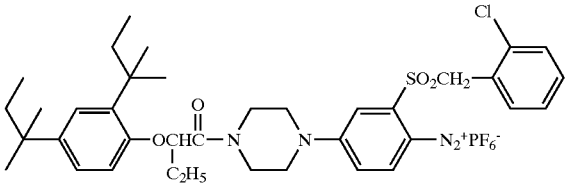
A-63
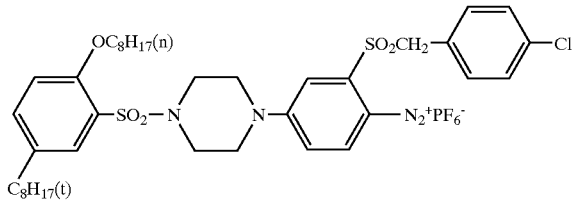
A-64
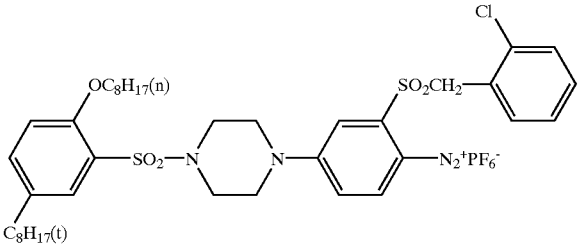
-continued
A-65
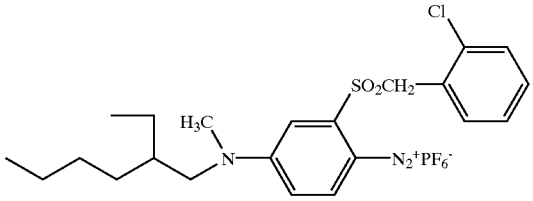
A-66
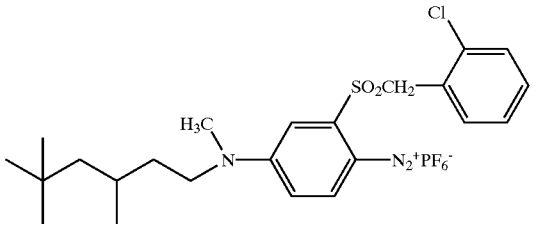
A-67
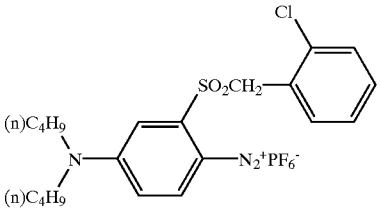
A-68
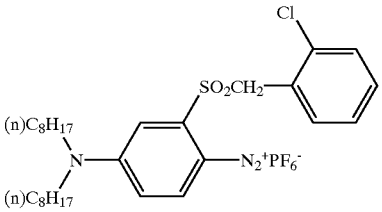
A-69
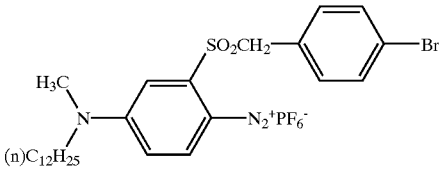
A-70
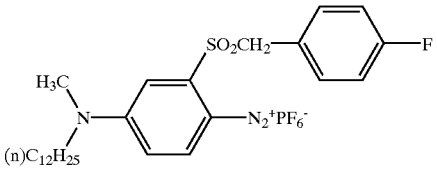
A-71
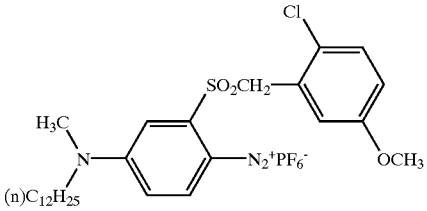

-continued

A-72

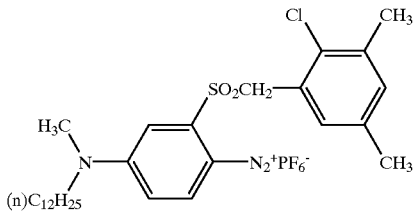

A-73

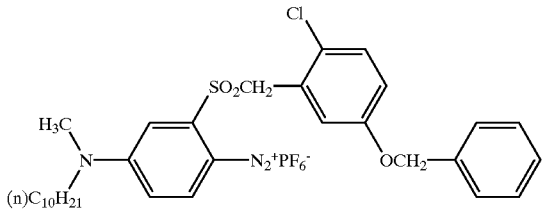

A-74

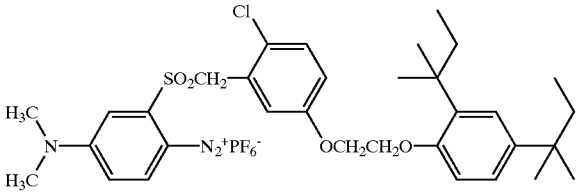

A-75

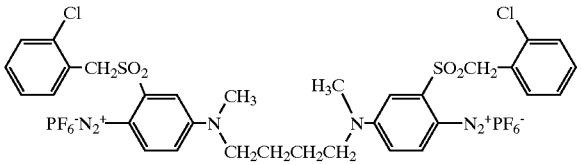

A-76

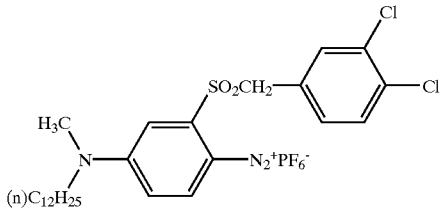

A-77

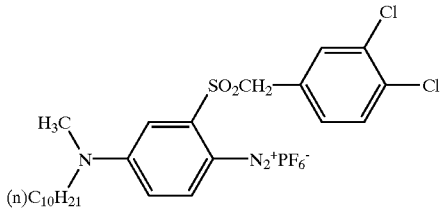

A-78

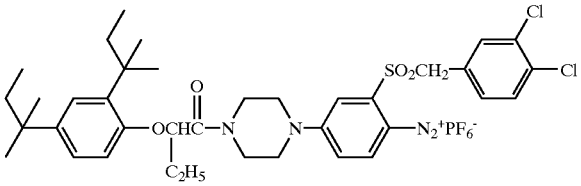

-continued (3)-1

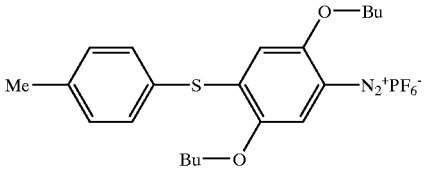

(3)-2

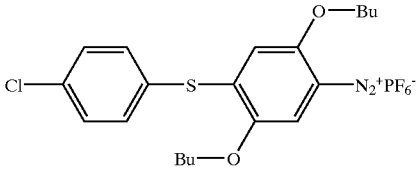

(3)-3

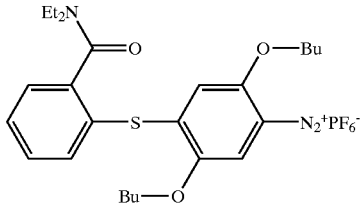

(3)-4

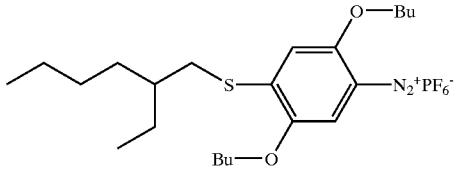

(4)-1

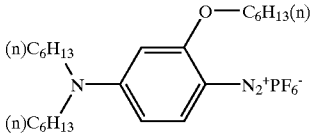

(4)-2

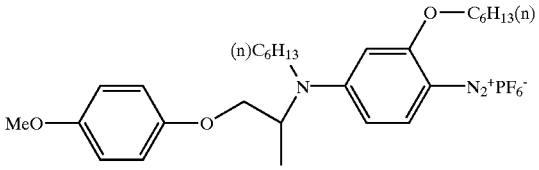

The diazonium salt that is represented by any one of the general formulae (1), (2), and (6) can be prepared by a conventionally known method. That is, the diazonium salt can be synthesized by the diazotization of a corresponding aniline in an acidic solvent by use of sodium nitrite, nitrosylsulfuric acid, isoamyl nitrite, etc.

The diazonium salt that is represented by any one of the general formulae (1), (2), and (6) may be in any of an oily state and a crystalline state. In view of ease in handling, an diazonium salt that is in a crystalline state at room temperature is preferable.

These diazonium salts may be used alone, in a combination of two or more, or in combination with a conventional diazonium salt.

The content of the diazonium salt in the light-sensitive heat-sensitive recording layer of a light-sensitive heat-sensitive recording material is preferably 0.02 to 5 g/m$^2$, more preferably 0.1 to 4 g/m$^2$, from the viewpoint of the density of the color to be formed.

It is also possible to stabilize the diazonium salt by the formation of a complex compound thereof by use of zinc chloride, cadmium chloride, tin chloride, or the like.

The diazonium salt that is represented by any one of the general formulae (1), (2), and (6) reacts with a coupler that will be described later and provides a color having a high density. On the other hand, since the diazonium salt can be rapidly decomposed due to its excellent photodecomposability in the wavelength range of 380 to 460 nm of a fluorescent lamp or the like and thus the fixation can be completed sufficiently even by light irradiation of a short time, the diazonium salt is very useful as a color-forming component for a photofixable light-sensitive heat-sensitive recording material.

Next, the coupler (i.e., coupling component) to be used in the magenta heat-sensitive recording layer is explained below.

The coupler may be any compound capable of coupling-reacting with a diazonium compound to form a dye in a basic environment and/or a neutral environment. All of so-called 4-equivalent couplers for silver halide photographic photosensitive materials can be used as the couplers in the magenta heat-sensitive recording layers. According to the desired hues of magenta, these couplers can be selected. Examples of the coupler include a so-called active methylene compound having a methylene group adjacent to a carbonyl group, a phenol derivative, and a naphthol derivative. Specific examples of the couplers include the conventionally known couplers exemplified as those for the yellow heat-sensitive recording layer. These couplers can be used in so far as these couplers meet the purpose of the invention.

Among the couplers listed above, in particular the compounds represented by the following general formula (7) or tautomers thereof are preferable.

The details of the couplers represented by the general formula (7) are given below.

General formula (7)

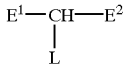

wherein $E^1$ and $E^2$ each independently represent an electron attractive group. $E^1$ and $E^2$ may join together to form a ring. L represents a substituent that can leave at the time of coupling with a diazo compound.

The electron attractive groups represented by $E^1$ and $E^2$ mean, respectively, a substituent whose Hammett substituent constant $\sigma_p$ is positive. These substituents may be the same or different. Preferred examples of the substituents include acyl groups such as an acetyl group, a propionyl group, a pivaloyl group, a chloroacetyl group, a trichloroacetyl group, a trifluoroacetyl group, a 1-methylcyclopropylcarbonyl group, a 1-ethylcyclopropylcarbonyl group, a 1-benzylcyclopropylcarbonyl group, a benzoyl group, a 4-methoxybenzoyl group, and a thenoyl group; oxycarbonyl groups such as a methoxycarbonyl group, an ethoxycarbonyl group, a 2-methoxyethoxycarbonyl group, and a 4-methoxyphenoxycarbonyl group; carbamoyl groups such a carbamoyl group, an N,N-dimethylcarbamoyl group, an N,N-diethylcarbamoyl group, an N-phenylcarbamoyl group, an N-[2,4-bis(pentyloxy)phenyl]carbamoyl group, an N-[2,4-bis(octyloxy)phenyl]carbamoyl group, and a morpholinocarbonyl group; alkylsulfonyl or arylsulfonyl groups such as a methanesulfonyl group, a benzenesulfonyl group, and a toluenesulfonyl group; phosphono groups such as a diethylphosphono group; heterocyclic groups such as a benzoxazole-2-yl group, a benzothiazole-2-yl group, a 3,4-dihydroquinazoline-4-one-2-yl group, and a 3,4-dihydroquinazoline-4-sulfone-2-yl group; nitro group; imino group; and cyano group.

The electron attractive groups represented by $E^1$ and $E^2$ may join together to form a ring. The rings formed by $E^1$ and $E^2$ are preferably 5- to 6-membered carbocycles or heterocycles.

In the general formula (7), L represents a substituent that can leave at the time of coupling with a diazonium salt. It is preferable that the group represented by L is a halogen atom, an alkylthio group which may have a substituent, an arylthio group which may have a substituent, an alkyl group which may have a substituent, an alkoxy group which may have a substituent, an aryloxy group which may have a substituent, an arylsulfonyloxy group which may have a substituent, an acyloxy group which may have a substituent, a benzoyloxy group which may have a substituent, a dialkylaminocarbonyloxy group which may have a substituent, a diarylaminocarbonyloxy group which may have a substituent, an alkoxycarbonyloxy group which may have a substituent, an aryloxyarbonyloxy group which may have a substituent, an N-pyrazolyl group which may have a substituent, an N-imidazolyl group which may have a substituent, or an N-benzotriazolyl group which may have a substituent.

Specific examples of the couplers represented by the general formula (7) are given are given below, but it should be understood that the invention is not restricted to these examples. The tautomers of the following couplers are also suitable.

C-210

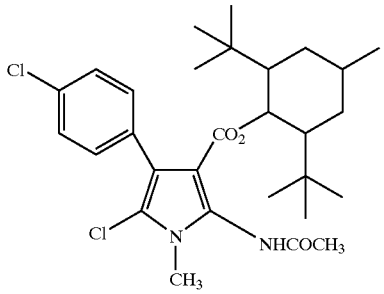

C-211

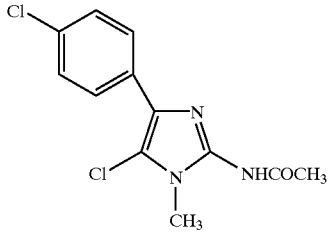

C-212

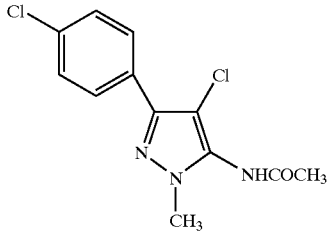

-continued
C-213
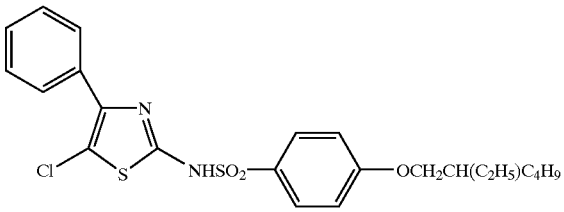
C-214
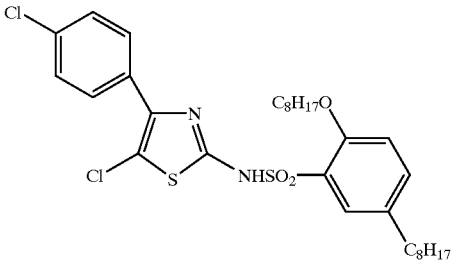
C-215
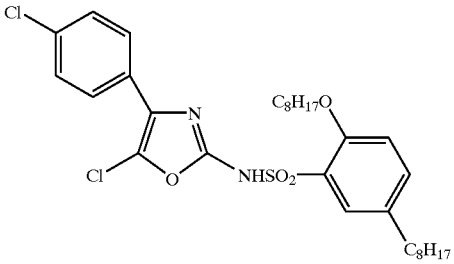
C-216
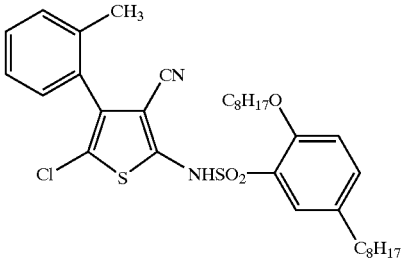
C-217
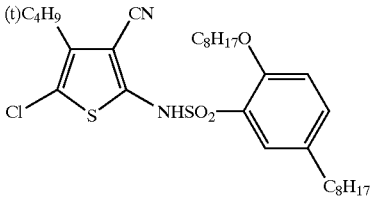
C-218
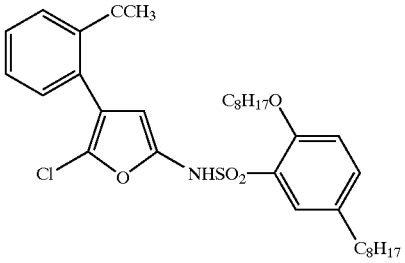
-continued
C-219
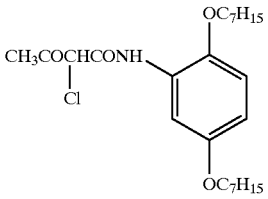
C-220
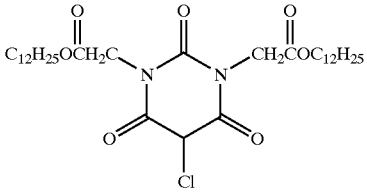
C-221
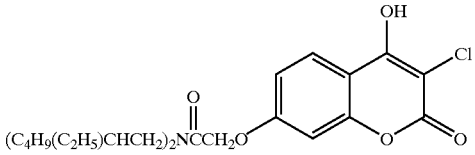
C-222
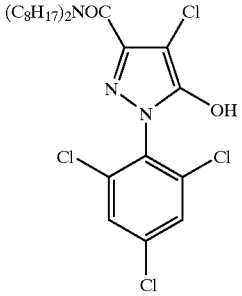
C-223
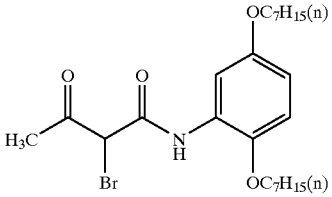
C-224
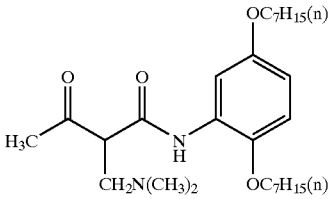
C-225
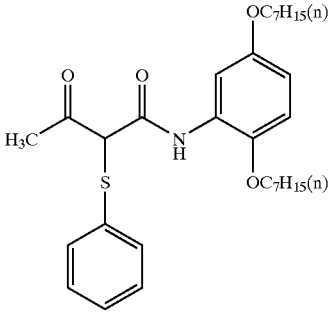

-continued
C-226
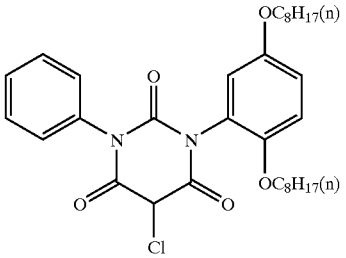
C-227
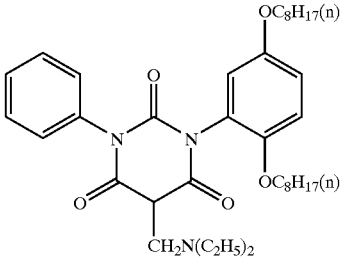
C-228
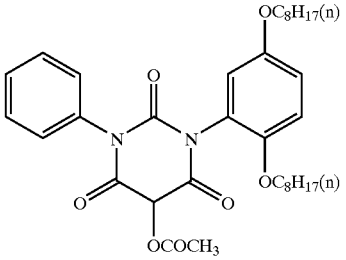
C-229
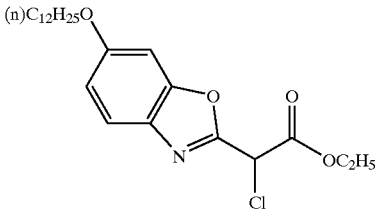
C-230
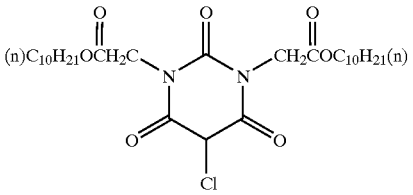
C-231
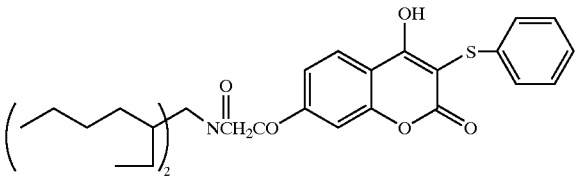
C-232
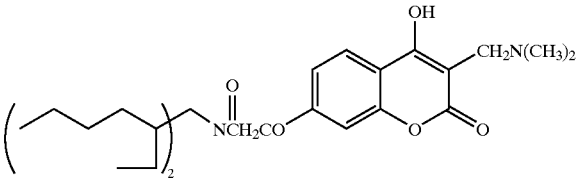
-continued
C-233
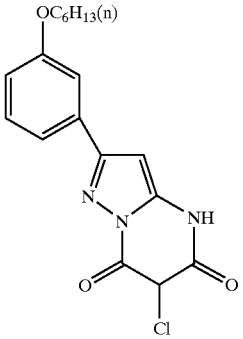
B-1
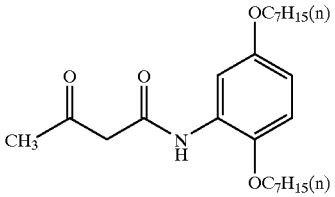
B-2
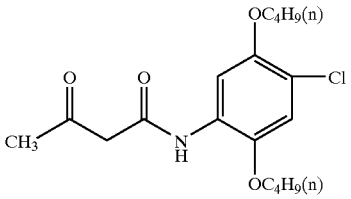
B-3
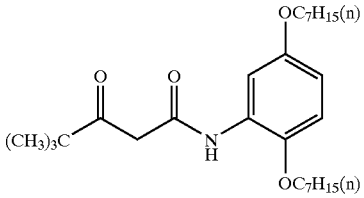
B-4
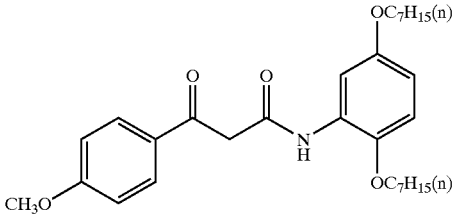
B-5
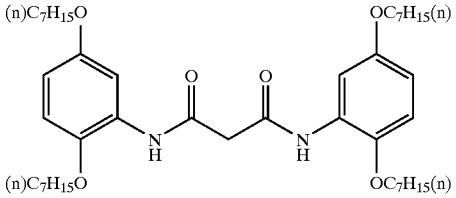
B-6
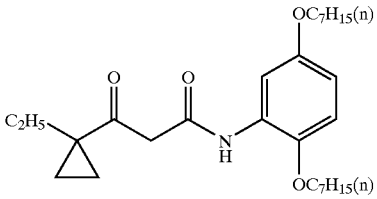

-continued
B-7
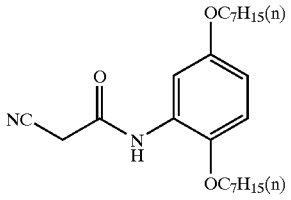
B-8
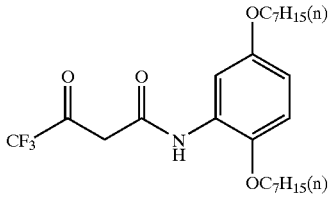
B-9
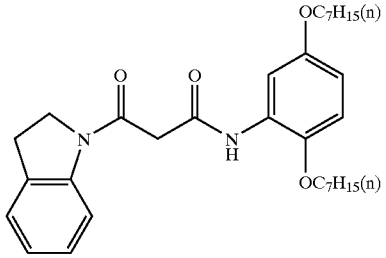
B-10
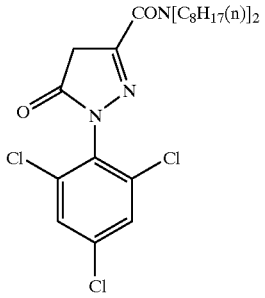
B-11
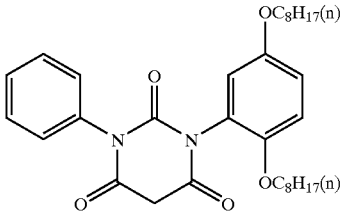
B-12
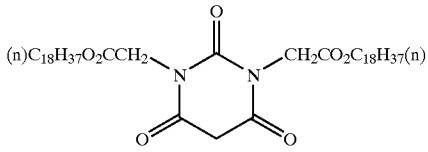
B-13
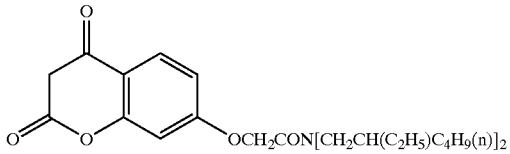
-continued
B-14
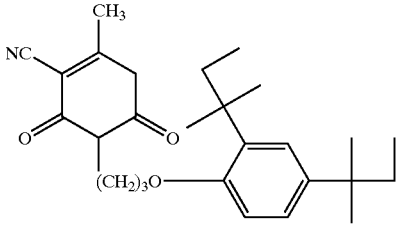
B-15
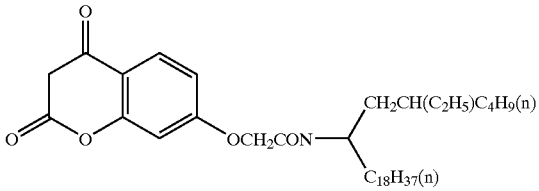
B-16
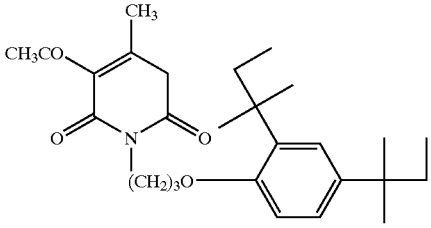
B-17
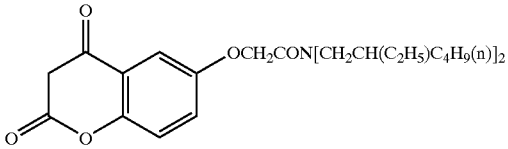
B-18
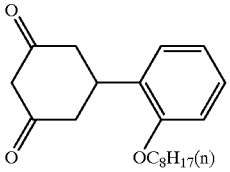
B-19
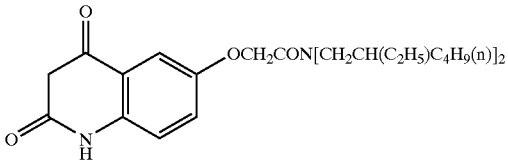
B-20
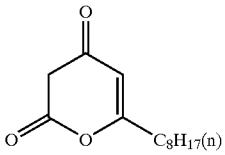
B-21
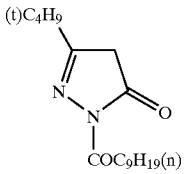

-continued
B-22
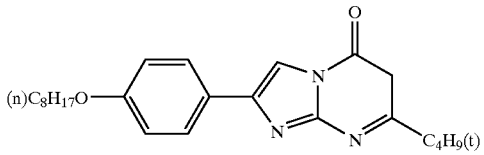
B-23
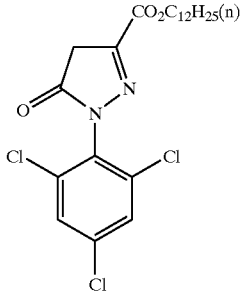
B-24
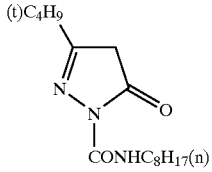
B-25
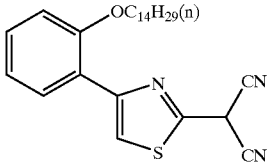
B-26
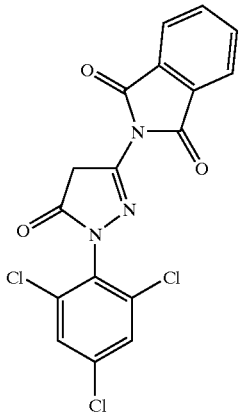
B-27
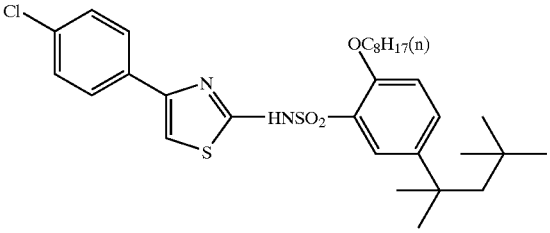
-continued
B-28
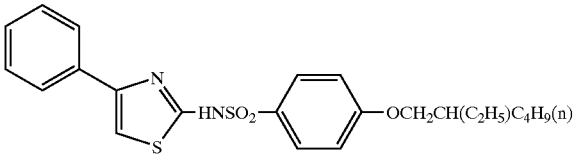
B-29
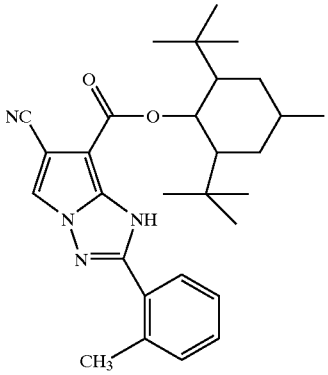
B-30
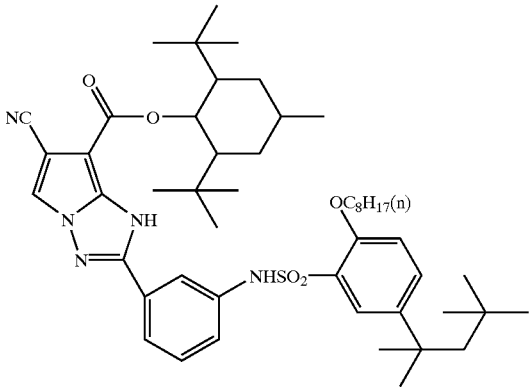
B-31
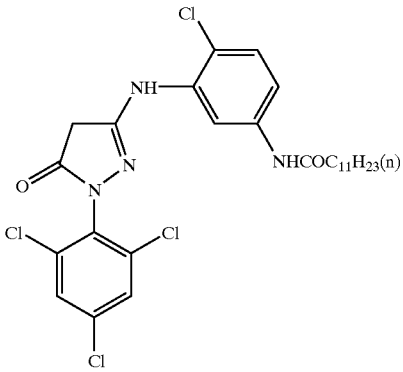

-continued

B-32

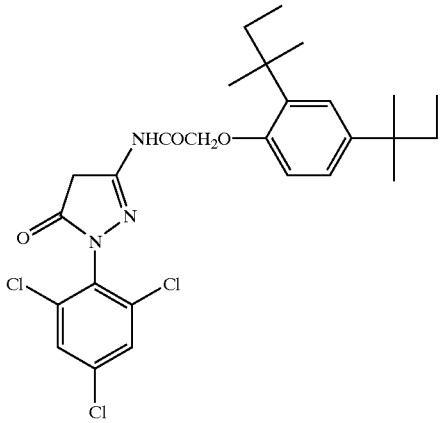

B-33

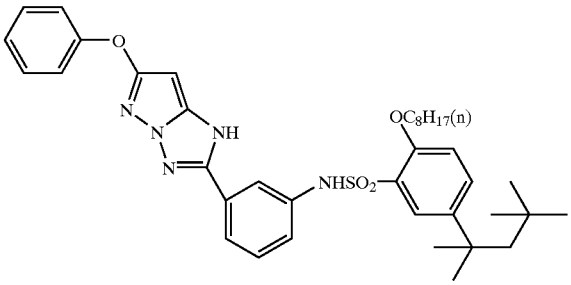

B-34

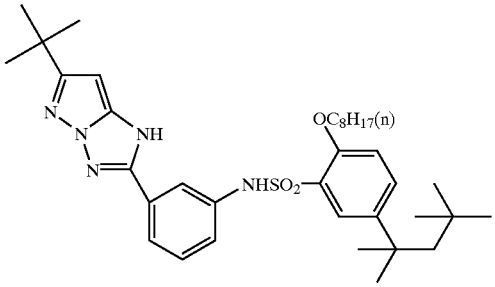

B-35

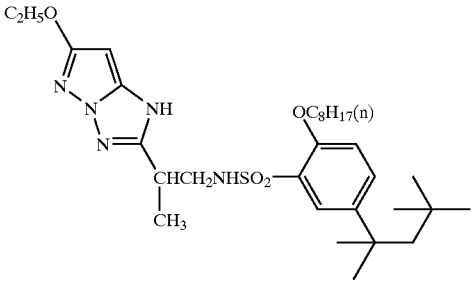

B-36

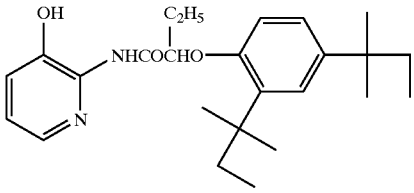

-continued

B-37

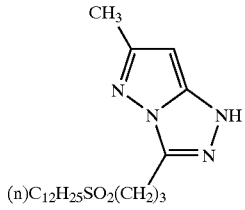

B-38

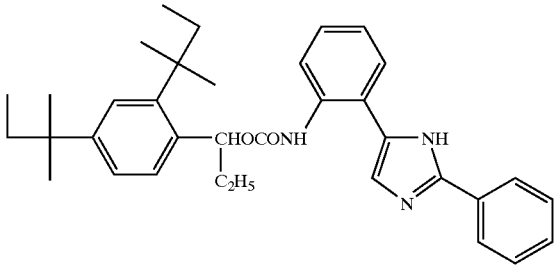

The tautomer of the above-mentioned coupler means a coupler that can exist as an isomer of the above-mentioned coupler, and the structures of the two couplers can be changed easily into each other. The tautomers are also preferable as the couplers to be used in the invention.

In the magenta heat-sensitive recording layer, the total mol of the coupler(s) added is preferably 0.5 to 10 times, and more preferably 1 to 5 times as large as the mol of the diazonium salt added in the magenta heat-sensitive recording layer from the standpoint of the effects.

When the total mol of the coupler(s) added is less than 0.5 times as large as the mol of the diazonium salt added, sufficient color-formability may not be obtained. On the other hand, the total mol of the total coupler(s) added, which is more than 10 times, impairs color-formability because of the problem of heat efficiency and is not desirable in view of the thickness.

Basic Substances

The basic substances include an inorganic or organic basic substance and a compound which, when heated, releases an alkaline substance as a result of decomposition or the like. Typical examples include nitrogen-containing compounds such as organic ammonium salts, organic amines, amides, urea and thiourea and derivatives thereof, thiazoles, pyrroles, pyrimidines, piperazines, guanidines, indoles, imidazoles, imidazolines, triazoles, morpholines, piperidines, amidines, formamidines, and pyridines. Specific examples of these compounds include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazinobenzothiazole, etc. These organic bases may be used in combinations of two or more.

Sensitizers

As to the sensitizer, an organic compound, which has a low melting point and has properly an aromatic group and a polar group inside the molecule, is preferable. Examples of such organic compound include benzyl p-benzyloxybenzoate, α-naphthyl benzyl ether, β-naphthyl benzyl ether, phenyl β-naphthoate, phenyl α-hydroxy-β-naphthoate, β-naphthol-(p-chlorobenzyl) ether, 1,4-butandiol phenyl ether, 1,4-butandiol-p-methylphenyl ether, 1,4-butandiol-p-ethylphenyl ether, 1,4-butandiol-m-methylphenyl ether, 1-phenoxy-2-(p-tolyloxy)ethane, 1-phenoxy-2-(p-ethylphenoxy)ethane, 1-phenoxy-2-(p-chlorophenoxy)ethane, p-benzylbiphenyl, etc.

Microcapsules

In the invention, the method of using the diazo compound and/or diazonium salt, the coupler which reacts with the diazo compound or the like upon heating to form a color, the basic substance, and the sensitizer is not particularly limited. And, any of the following methods may be employed. That is, (1) a method in which these compounds are used as a dispersion of solid particles; (2) a method in which these compounds are used as a dispersion by emulsification; (3) a method in which these compounds are used as a polymer dispersion; (4) a method in which these compounds are used as a latex dispersion; and (5) a method in which these compounds are encapsulated in microcapsules. Among these methods, the method in which the compounds are encapsulated in microcapsules is preferable from the viewpoint of preservability. In particular, a method, in which the diazo compound and the diazonium salt are enclosed in microcapsules, is preferable.

As for the method of encapsulation in microcapsules, a conventionally known method of encapsulation in microcapsules can be employed. The method is as follows. Color-forming agents, additives, and a microcapsule wall precursor are dissolved in an organic solvent which is difficultly soluble or insoluble in water. The resulting solution is added into an aqueous solution of a water-soluble polymer; emulsified by means of a homogenizer or the like; and heated so that a wall film of a polymeric substance constituting a microcapsule wall film is formed in the oil/water interface.

Examples of the organic solvent include low-boiling auxiliary solvents such as acetic ester, methylene chloride, and cyclohexanone and/or phosphoric ester, phthalic ester, acrylic ester, methacrylic ester, other carboxylic acid esters, fatty acid amides, alkylated biphenyl, alkylated terphenyl, alkylated naphthalene, diaryl ethane, chlorinated paraffin, alcohols, phenols, ethers, monoolefins, and epoxies. Specific examples include high-boiling oils such as tricresyl phosphate, trioctyl phosphate, octyl diphenyl phosphate, tricyclohexyl phosphate, dibutyl phthalate, dioctyl phthalate, dilauryl phthalate, dicyclohexyl phthalate, butyl oleate, diethylene glycol benzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffin, diisopropylnaphthalene, 1,1'-ditolylethane, 2,4-di-t-amylphenol, N,N-dibutyl-2-butoxy-5-t-octylaniline, 2-ethylhexyl hydroxybenzoate, and polyethylene glycol. Among these high-boiling oils, alcohols, phosphoric esters, carboxylic acid esters, alkylated biphenyl, alkylated terphenyl, alkylated naphthalene, and diaryl ethane are preferable. Further, a carbonization inhibitor such as a hindered phenol or a hindered amine may be added to these high-boiling oils. In particular, an oil comprising an unsaturated fatty acid is preferable as the oil and examples thereof include an α-methylstyrene dimer. Examples of the α-methylstyrene dimer include "MSD100" (trade name, manufactured by Mitsui Toatsu Chemicals, Inc.)

A water-soluble polymer such as polyvinyl alcohol is used as the water-soluble polymer. In this case, a hydrophobic polymer emulsion or latex or the like can be used together with the water-soluble polymer. Examples of the water-soluble polymer include polyvinyl alcohol, silanol-modified polyvinyl alcohol, carboxy-modified polyvinyl alcohol, amino-modified polyvinyl alcohol, itaconic acid-modified polyvinyl alcohol, styrene/maleic anhydride copolymers, butadiene/maleic anhydride copolymers, ethylene/maleic anhydride copolymers, isobutylene/maleic anhydride copolymers, polyacrylamide, polystyrenesulfonic acid, polyvinyl pyrrolidone, ethylene/acrylic acid copolymers, and gelatin. Among these water-soluble polymers, carboxy-modified polyvinyl alcohol or gelatin is particularly preferable. Examples of the hydrophobic polymer emulsion or latex include styrene/butadiene copolymers, carboxy-modified styrene/butadiene copolymers, and acrylonitrile/butadiene copolymers. In this case, a conventionally known surfactant or the like may be added as necessary.

Specific examples of the polymeric material constituting a microcapsule wall film include a polyurethane resin, a polyurea resin, a polyamide resin, a polyester resin, a polycarbonate resin, an aminoaldehyde resin, a melamine resin, a polystyrene resin, a styrene/acrylate copolymer resin, a styrene/methacrylate copolymer resin, gelatin, and polyvinyl alcohol. Among these examples, a polyurethane/polyurea resin is particularly preferable as the wall-forming material.

The microcapsules having a wall film composed of a polyurethane/polyurea resin are prepared by the steps of blending a microcapsule wall precursor such as a polyvalent isocyanate into a core material to be encapsulated, dispersing the blend by emulsification into an aqueous solution of a water-soluble polymer such as polyvinyl alcohol or gelatin, and heating the resulting liquid so that a polymer forming reaction takes place in the interface of oil droplets.

Some specific examples of the polyvalent isocyanate compound are given below. For example, these are diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, and cyclohexylene-1,4-diisocyanate; triisocyanates such as 4,4',4"-triphenylmethane triisocyanate and toluene-2,4,6-triisocyanate; tetraisocyanates such as 4,4'-dimethylphenylmethane-2,2', 5,5'-tetraisocyanate; and isocyanate prepolymers such as a hexamethylene diisocyanate/trimethylol propane adduct, a 2,4-tolylene diisocyanate/trimethylol propane adduct, a xylylene diisocyanate/trimethylol propane adduct, and a tolylene diisocyanate/hexanetriol adduct. If necessary, two or more kinds of the polyvalent isocyanate compounds can be used. Among these polyvalent isocyanate compounds, a compound having three or more isocyanate groups in the molecule is particularly preferable.

In the method of encapsulation, the oils listed for dispersion by emulsification can be used as the organic solvents for dissolving the color-forming agents, additives, and microcapsule wall precursors. The same applies to the water-soluble polymers.

The particle diameter of the microcapsule is preferably 0.1 to 1.0 μm and more preferably 0.2 to 0.7 μm.

Recording Methods

According to the heat-sensitive recording material of the invention, a multicolor heat-sensitive recording material is formed by the lamination of at least three layers of heat-sensitive layers comprising different diazonium salt compounds whose light-sensitive wavelengths differ from one another and couplers which reacts, respectively, with the diazonium salt compounds upon heating to form different colors.

For example, the heat-sensitive recording material comprises a support having disposed thereon a first heat-sensitive recording layer (yellow heat-sensitive recording layer) containing a diazo compound or the like whose maximum absorption wavelength is 350 nm or less and a coupler which reacts with the diazo compound or the like to develop a color upon heating, a second heat-sensitive recording layer (cyan heat-sensitive recording layer) containing a diazonium salt compound whose maximum absorption wavelength is 370±30 nm and a coupler which reacts with the diazo compound or the like to develop a color upon heating, and a third heat-sensitive recording layer (magenta heat-sensitive recording layer) containing a diazo compound or the like whose maximum absorption wavelength is 430±30 nm and a coupler which reacts with the diazo compound or the like to develop a color upon heating.

The method of recording in this multicolor heat-sensitive recording material is as follows. First, the third heat-sensitive recording layer (magenta heat-sensitive recording layer) is heated so that a color is formed by the reaction between the diazo compound or the like and the coupler contained in the layer. Next, the third heat-sensitive recording layer is irradiated with light having a wavelength of 430±30 nm so that the diazo compound or the like remaining unreacted in the third heat-sensitive recording layer is decomposed. After that, suffcient heat to cause the second heat-sensitive recording layer (cyan heat-sensitive recording layer) to develop a color is applied to the second heat-sensitive recording layer and a color is formed by the reaction between the diazo compound or the like and the coupler contained in the layer. When the heat is applied, although the third heat-sensitive recording layer is also heated strongly, the third heat-sensitive recording layer does not develop any color because the diazo compound or the like is already decomposed to an extent that its color-forming capability is lost. Further, the second heat-sensitive recording layer is irradiated with light having a wavelength of 370±30 nm so that the diazo compound or the like remaining unreacted in the second heat-sensitive recording layer is decomposed. Finally, sufficient heat to cause the first heat-sensitive recording layer to develop a color is applied to the first heat-sensitive recording layer. When the heat is applied, although the third and second heat-sensitive recording layers are also heated strongly, these heat-sensitive recording layers do not develop any color because the diazo compounds or the like contained in the third and second heat-sensitive recording layers are already decomposed to an extent that their color-forming capability is lost.

The light sources to be used for the photodecomposition (photo-fixation) of the diazo compound or the like include various kinds of fluorescent lamps, xenon lamps, mercury lamps, etc. For the purpose of efficient fixation, it is preferable that the light emission spectra of these light sources are approximately equal to the absorption spectra of the diazonium salts in the heat-sensitive recording material.

In particular, it is most preferable to use a light source that emits light whose central wavelength is 340 to 460 nm in the invention.

The heat-sensitive recording material can also be used as a light-writable heat development type heat-sensitive recording material in which image-wise writing is made by light and images are produced by heat development. In this case, the steps of printing and imaging are carried out by a light source such as a laser in place of the heating device described above.

Antioxidants

In the invention, in order to further improve the lightfastness, conventionally known antioxidants described in the following publications can be used. Examples of the antioxidants include those described in, for example, EP No. 310551A, German Patent Application Laid-Open (OLS) No. 3435443, EP No. 310552A, JP-A No. 3-121449, EP No. 459416A, JP-A Nos. 2-262654, 2-71262, and 63-163351, U.S. Pat. No. 4,814,262, JP-A Nos. 54-48535, 5-61166, and 5-119449, U.S. Pat. No. 4,980,275, JP-A Nos . 63-113536 and 62-262047, EP Nos. 223739A, 309402A, 309401A, etc. Specific examples include the following;

Q-1

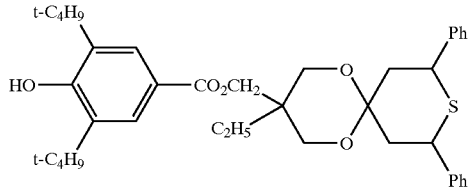

Q-2

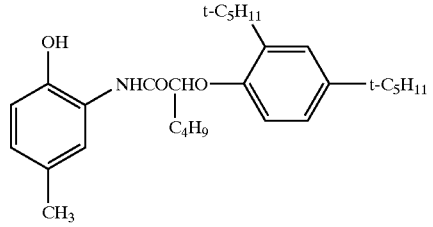

Q-3

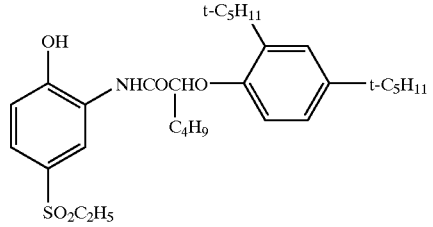

Q-4

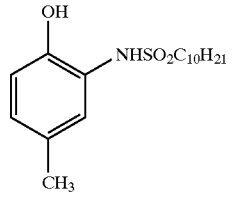

Q-5

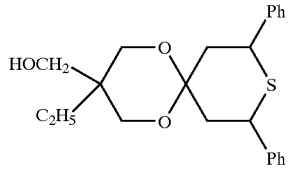

Q-6

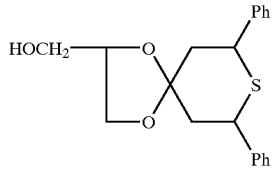

-continued
Q-7
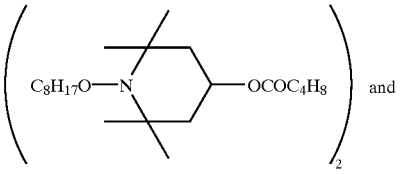
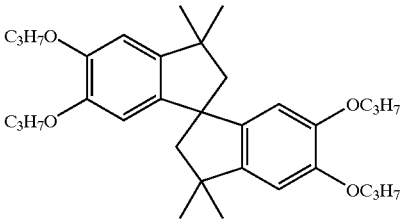
Q-8
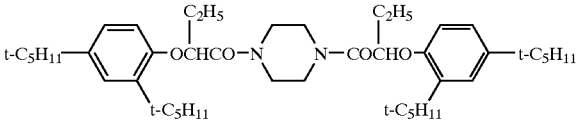
Q-9
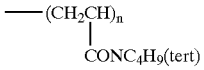
Q-10
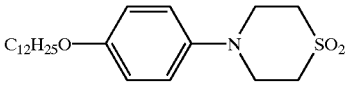
Q-11
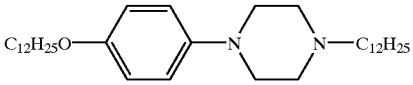
Q-12
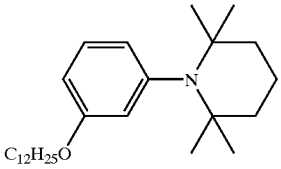
Q-13
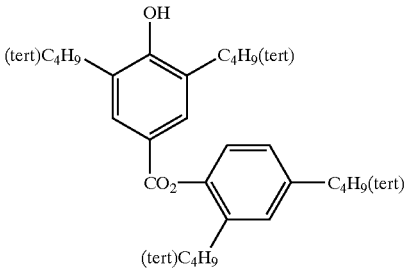
Q-14
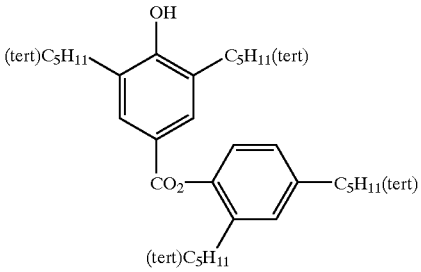
-continued
Q-15
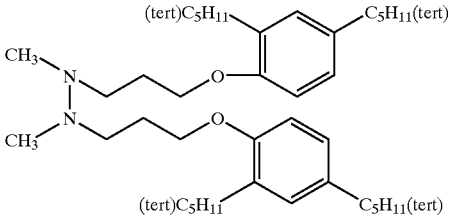
Q-16
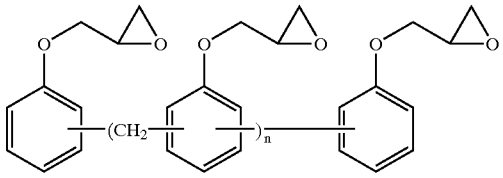
Q-17
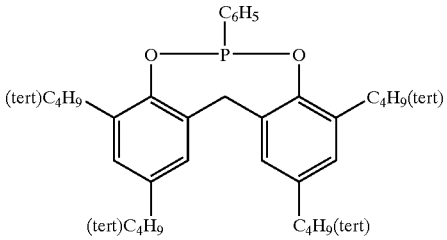
Q-18
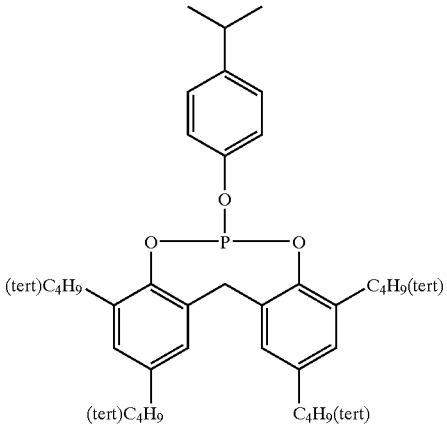
Q-19
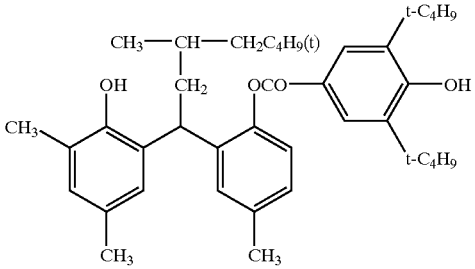
Q-20
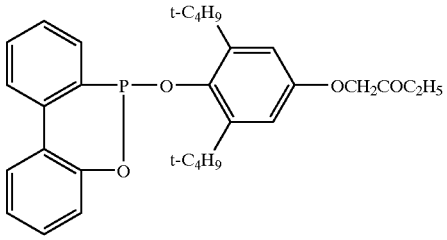

-continued

Q-21

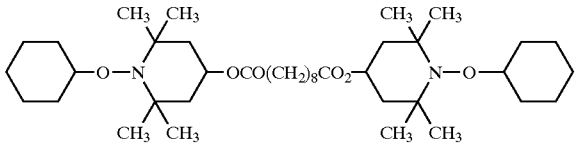

Q-22

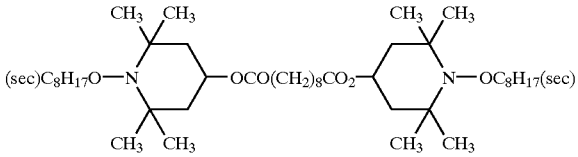

Q-23

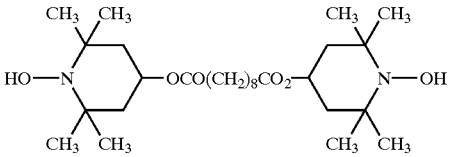

Q-24

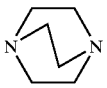

Q-25

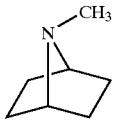

Q-26

$(C_{14}H_{29}OCOCH_2CH_2)_2S$

Q27

$(C_{18}H_{37}OCOCH_2CH_2)_2S$

Q28

$(C_{12}H_{25}SCH_2CH_2CO_2CH_2)_4C$

It is also effective to use additives conventionally known as those for use in heat-sensitive recording materials and pressure-sensitive recording materials. Some examples of these antioxidants include the compounds described in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282, and 63-051174, Japanese Patent Application Publication (JP-B) Nos. 48-043294 and 48-033212, etc.

Specific examples of the antioxidants include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis-4-hydroxyphenylpropane, 1,1-bis-4-hydroxyphenyl-2-ethylhexane, 2-methyl-4-methoxy-diphenylamine, 1-methyl-2-phenylindole, and the compounds listed below.

Q-29

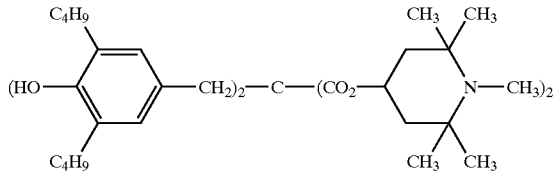

Q-30

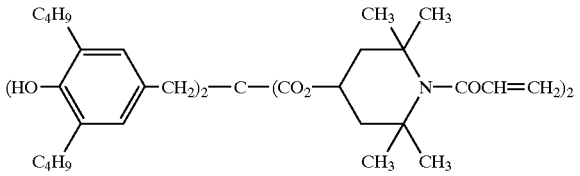

Q-31

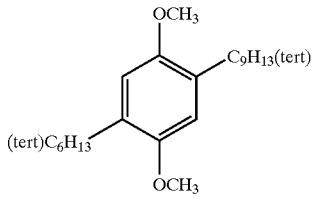

Q-32

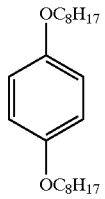

Q-33

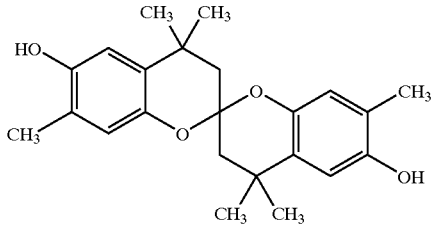

Q-34

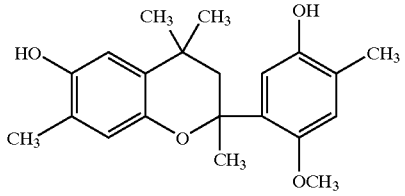

Q35

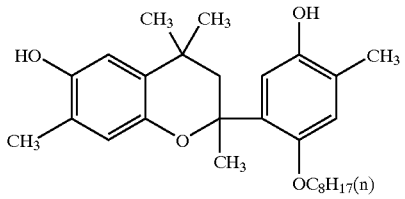

Q-36

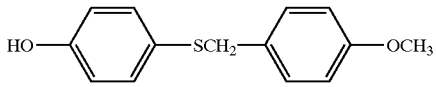

-continued
Q-37
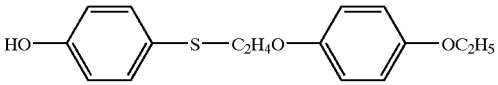
Q-38
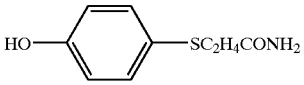
Q-39
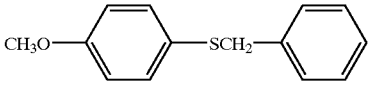
Q-40
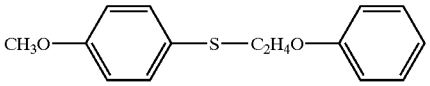
Q-41
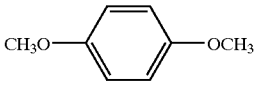
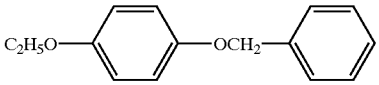
Q-42
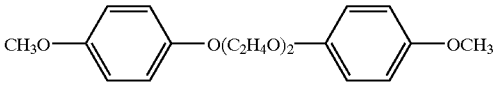
Q-43
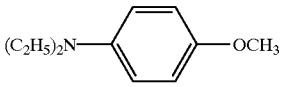
Q-44
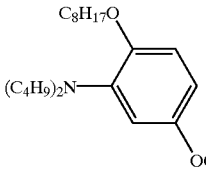
Q-45
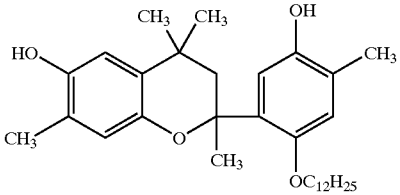
and
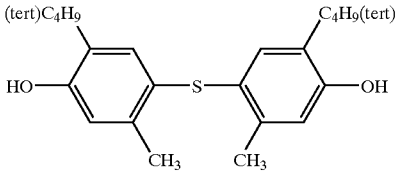
Q-46
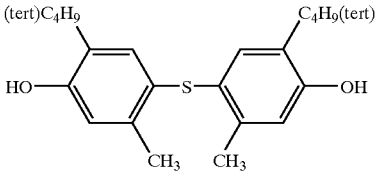
and Hydroquinone ether
-continued
Q-47
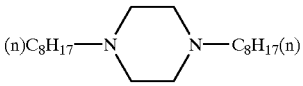
Q-48
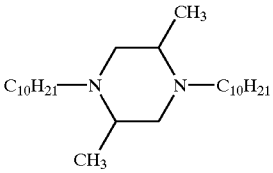
Q-49
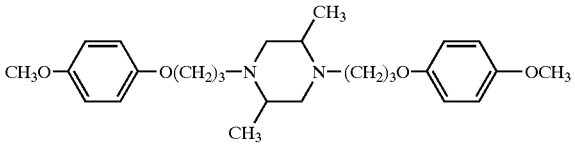
Q-50
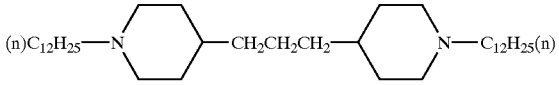
Q-51
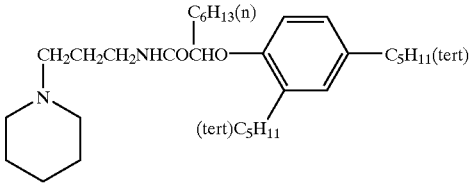
Q-52
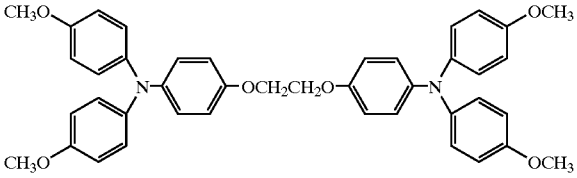
Q-53
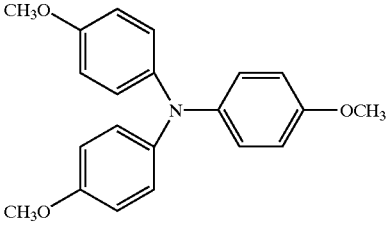
Q-54
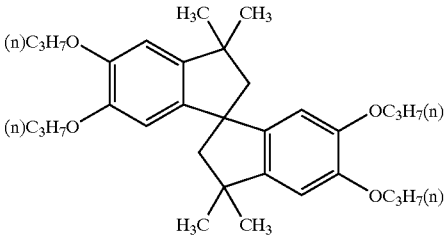

-continued

Q-55

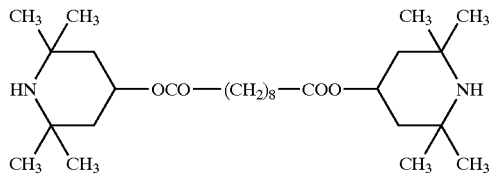

Q-56

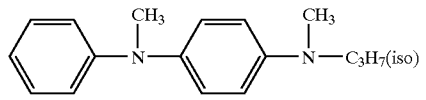

Q-57

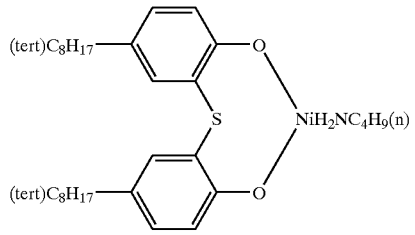

Q-58

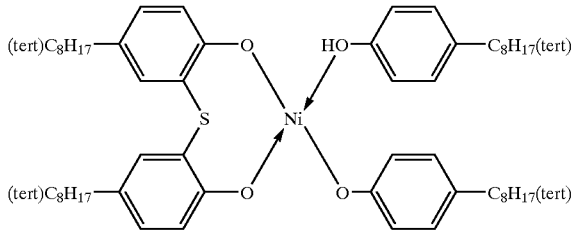

These antioxidants can be incorporated in a heat-sensitive recording layer or an intermediate layer, a light transmittance-adjusting layer, and a protective layer. In the case where these antioxidants are used in a combination, the examples of the combination include a combination of the specific example (Q-7), (Q-45), (Q-46), or (Q-10) and the compound (Q-13).

EXAMPLES

The present invention is more specifically explained by the following examples, though it should be understood that the invention is not restricted to these examples.

Example 1

<Support with a Primer Layer>

An aqueous solution of gelatin for primer layer was prepared by adding 40 parts by mass of enzyme-decomposed gelatin (having an average molecular weight of 10000, a viscosity of 1.5 mPa·s (15 mP) according to a PAGI method, and a jelly strength of 20 g according to a PAGI method) to 60 parts by mass of ion-exchanged water and dissolving the gelatin by stirring at 40° C.

Meanwhile, 8 parts by mass of water-swellable synthetic mica (aspect ratio: 1000, trade name: Somasif ME100, manufactured by Co-op Chemical Co., Ltd.) was mixed with 92 parts by mass of water. The resulting mixture was subjected to a wet-dispersing treatment by means of a visco-mill. As a result, a mica dispersion liquid having a volume-average particle diameter of 2.0 $\mu$m was obtained. Next, water in an amount to obtain a mica concentration of 5% by mass was added to the mica dispersion liquid and the resulting mixture was homogenized by stirring. In this way, a desired mica dispersion liquid was prepared.

Next, 120 parts by mass of water and 556 parts by mass of methanol were added to 100 parts by mass of the 40% by mass aqueous solution of gelatin for primer layer at 40° C. After these components were sufficiently mixed by stirring, 208 parts by mass of the 5% by mass mica dispersion liquid was added and these components were sufficiently mixed by stirring. After that, 9.8 parts by mass of a 1.66% by mass polyethylene oxide surfactant was added. The liquid was maintained at a temperature in the range of 35 to 40° C. and 7.3 parts by mass of ethylene diglycidyl diether as a gelatin hardener was added. In this way, a coating liquid (5.7% by mass) for primer layer was prepared.

The coating liquid for primer layer was applied to one side of a transparent PET support (thickness: 160 $\mu$m) such that the coating weight of the mica of 0.2 g/m$^2$ was obtained. In this way, the primer layer was formed.

<Preparation of a Phthalated Gelatin Solution>

32 parts by mass of phthalated gelatin (trade name: MGP Gelatin, manufactured by NITSUBI COLLAGEN Co., Ltd.), 0.9143 parts by mass of 1,2-benzothiazoline-3-one (a 3.5% methanol solution, manufactured by Daito Chemical Industries, Ltd.), and 367.1 parts by mass of ion-exchanged water were mixed together and made into a solution at 40° C. to thereby obtain an aqueous solution of phthalated gelatin.

<Preparation of a Gelatin Solution for Making an Emulsion>

25.5 parts by mass of alkali-treated low-ion gelatin (trade name: No. 750 Gelatin, manufactured by Nitta Gelatin Inc.), 0.7286 parts by mass of 1,2-benzothiazoline-3-one (a 3.5% methanol solution, manufactured by Daito Chemical Industries, Ltd.), 0.153 parts by mass of calcium hydroxide, and 143.6 parts by mass of ion-exchanged water were mixed together and made into a solution at 50° C. to thereby obtain an aqueous solution of gelatin for making an emulsion.

<Preparation of Liquids of Microcapsules Enclosing Diazonium Salt Compounds>

(Preparation of a Liquid (a) of Microcapsules Enclosing a Diazonium Salt)

To 15.0 parts by mass of ethyl acetate were added 3.2 parts by mass of the following diazonium salt (A) (maximum absorption wavelength: 420 nm) and 10.7 parts by mass of diphenyl phthalate. The mixture was heated and made into a homogeneous solution. To the solution thus obtained was added 9.7 parts by mass of a mixture of a xylylene diisocyanate/trimethylol propane adduct and a xylylene diisocyanate/bisphenol A adduct (trade name: Takenate D119N ((a 50% ethyl acetate solution), manufactured by Takeda Chemical Industries, Ltd.) as a capsule wall-forming material, and the resulting mixture was homogenized by stirring. In this way, a blend liquid (I) was obtained.

On the other hand, to 65 parts by mass of the 8% by mass aqueous solution of phthalated gelatin were added 18.1 parts by mass of ion-exchanged water, 0.38 parts by mass of Scraph AG-8 (50% by mass, manufactured by Nippon Fine Chemical Co., Ltd.), and the blend liquid (I) (solution) of the diazonium salt (A) obtained above. The resulting mixture was emulsified by means of a homogenizer (manufactured by Nippon Seiki Seisakusho Co., Ltd.) at 40° C. Then, 10 parts by mass of water was added to the emulsified liquid and the liquid was homogenized. Next, an encapsulation reaction was carried out while stirring the liquid at 40° C. for 3 hours. After that, 4.6 parts by mass of Amberlite IRA68 (manufactured by Organo Corporation) and 9.2 parts of Amberlite IRC50 (manufactured by Organo Corporation) were added as ion-exchange resins and the liquid was stirred for further one hour. The ion-exchange resins were then eliminated by filtration and 0.7 parts by mass of a 5% aqueous solution of hydroquinone was added to the filtrate. Then, after the resulting mixture was stirred, the concentration of the capsule liquid was adjusted so that the concentration of the solid components became 24.5%. In this way, a liquid (a) of microcapsules enclosing a diazonium salt was obtained.

Diazonium Salt (A)

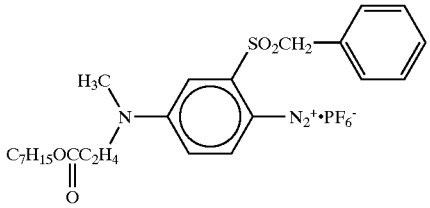

(Preparation of a Liquid (b) of Microcapsules Enclosing a Diazonium Salt)

To 15.1 parts by mass of ethyl acetate were added 3.4 parts by mass of the following diazonium salt (B) (maximum absorption wavelength: 365 nm), 5.7 parts by mass of tricresyl phosphate, 5.7 parts by mass of isopropyl biphenyl, 0.2 parts by mass of 2,2-dimethoxy-1,2-diphenylethane-1-one (trade name: IRGACURE 651, manufactured by Ciba Specialty Chemicals Corp.), and 0.5 parts by mass of diphenyl-(2,4,6-trimethylbenzoyl)phosphine oxide (trade name: Lucilin TPO, manufactured by BASF Japan Ltd). The mixture was heated and made into a homogeneous solution. To the solution thus obtained were added 14.1 parts by mass of a mixture of a xylylene diisocyanate/trimethylol propane adduct and a xylylene diisocyanate/bisphenol A adduct (trade name: Takenate D119N ((a 50% by mass ethyl acetate solution), manufactured by Takeda Chemical Industries, Ltd.) and 0.4 parts by mass of polymethylenepolyphenyl polyisocyanate (trade name: MILLIONATE MR-200, manufactured by Nippon Polyurethane Industry Co., Ltd.) as capsule wall forming materials, and the resulting mixture was homogenized by stirring. In this way, a blend liquid (II) was obtained.

On the other hand, to 66.1 parts by mass of the 8% by mass aqueous solution of phthalated gelatin were added 25.2 parts by mass of ion-exchanged water, 0.4 parts by mass of Scraph AG-8 (50% by mass, manufactured by Nippon Fine Chemical Co., Ltd.), and the blend liquid (II) (solution) of the diazonium salt (B) obtained above. The resulting mixture was emulsified by means of a homogenizer (manufactured by Nippon Seiki Seisakusho Co., Ltd.) at 40° C. Then, 10 parts by mass of water was added to the emulsified liquid and the liquid was homogenized. Next, an encapsulation reaction was carried out while stirring the liquid at 40° C. for 0.5 hours. Further, the temperature was raised to 50° C. and an encapsulation reaction was carried out for 2.5 hours. After that, 15 parts by mass of Amberlite IRA68 (manufactured by Organo Corporation) and 30 parts of Amberlite IRC50 (manufactured by Organo Corporation) were added as ion-exchange resins and the liquid was stirred for further one hour. The ion-exchange resins were then eliminated by filtration. The concentration of the capsule liquid was adjusted so that the concentration of the solid components became 23%. In this way, a liquid (b) of microcapsules enclosing a diazonium salt compound was obtained.

Diazonium Salt (B)

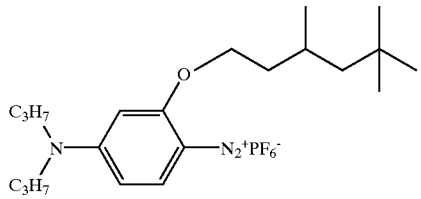

(Preparation of a Liquid (c) of Microcapsules Enclosing a Diazo Compound)

To 15.1 parts by mass of ethyl acetate were added 4.6 parts by mass of the following diazo compound (C) (maximum absorption wavelength: 350 nm or less) and 10.4 parts by mass of diphenyl phthalate. The mixture was heated and made into a homogeneous solution. To the solution thus obtained were added 6.1 parts by mass of a xylylene diisocyanate/trimethylol propane adduct (trade name: Takenate D110N (a 75% by mass ethyl acetate solution), manufactured by Takeda Chemical Industries, Ltd.) and 2.4 parts by mass of polymethylenepolyphenyl polyisocyanate (trade name: MILLIONATE MR-200, manufactured by Nippon Polyurethane Industry Co., Ltd.) as capsule wall-forming materials, and the resulting mixture was homogenized by stirring. In this way, a blend liquid (III) was obtained.

On the other hand, to 62.7 parts by mass of the 8% by mass aqueous solution of phthalated gelatin were added 13.8 parts by mass of ion-exchanged water, 0.41 parts by mass of Scraph AG-8 (50% by mass, manufactured by Nippon Fine Chemical Co., Ltd.), and the blend liquid (III) (solution) of the diazo compound (C) obtained above. The resulting mixture was emulsified by means of a homogenizer (manufactured by Nippon Seiki Seisakusho Co., Ltd.) at 40° C. Then, 70 parts by mass of water was added to the emulsified liquid and the liquid was homogenized. Next, an encapsulation reaction was carried out while stirring the liquid at 40° C. for 1.0 hour. Further, the liquid temperature was raised to 60° C. and an encapsulation reaction was carried out for 2.0 hours and thereafter the liquid temperature was lowered to 40° C. After that, 7.5 parts by mass of Amberlite IRA68 (manufactured by Organo Corporation) and 15 parts of Amberlite IRC50 (manufactured by Organo Corporation) were added as ion-exchange resins and the liquid was stirred for further one hour. The ion-exchange resins were then eliminated by filtration. The concentration of the capsule liquid was adjusted so that the concentration of the solid components became 20%. In this way, a liquid (c) of microcapsules enclosing a diazonium salt compound was obtained.

Diazo Compound (C)

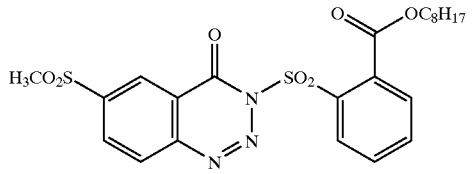

<Preparation of Coupler-Dispersed Emulsions>

(Preparation of a Coupler-Dispersed Emulsion (d))

A blend liquid (IV) was prepared by dissolving 5.2 parts by mass of the following coupler (D), 3.3 parts by mass of triphenylguanidine (manufactured by Hodogaya Chemical Co., Ltd.), 20 parts by mass of 4,4'-(m-phenylenediisopropylidene)diphenol (trade name: Bisphenol M, manufactured by Mitsui Petrochemical Industries, Ltd.), 13.3 parts by mass of 4-(2-ethyl-1-hexyloxy) benzenesulfonic acid amide (manufactured by Manac Incorporated), 6.8 parts by mass of 4-n-pentyloxybenzenesulfonic acid amide (manufactured by Manac Incorporated), 1.6 parts by mass of 3,3,3',3'-tetramethyl-5,5',6,6'-tetra(1-propyloxy)-1,1'-spirobisindan (manufactured by Sankyo Chemical Industries, Ltd.), 6.8 parts by mass of tricresyl phosphate, and 4.2 parts by mass of calcium dodecylbenzenesulfonate (trade name: Pionin A-41-C, a 70% methanol solution, manufacture by Takemoto Oil & Fat Co., Ltd.) in 31.9 parts by mass of ethyl acetate.

On the other hand, 137.5 parts by mass of ion-exchanged water was blended into 158.1 parts by mass of the above-mentioned aqueous solution of gelatin for making an emulsion and thereafter the coupler blend liquid (IV) obtained above was added. The resulting mixture was emulsified by means of a homogenizer (manufactured by Nippon Seiki Seisakusho Co., Ltd.). The coupler-dispersed emulsion thus obtained was heated under a reduced pressure to remove the ethyl acetate. After that, the concentration of the emulsion was adjusted so that the concentration of the solid components became 20% by mass. In this way, the coupler-dispersed emulsion (d) was obtained.

Coupler (D)

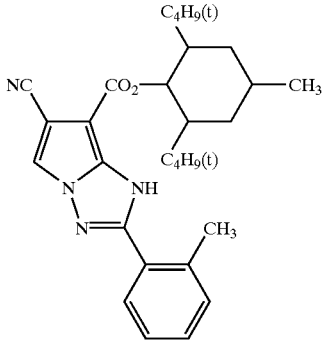

(Preparation of a Coupler-Dispersed Emulsion (e))

A blend liquid (V) was prepared by dissolving 4.47 parts by mass of the following coupler (E), 1.87 parts by mass of triphenylguanidine (manufactured by Hodogaya Chemical Co., Ltd.), 4.39 parts by mass of 4,4'-(m-phenylenediisopropylidene)diphenol (trade name: Bisphenol M, manufactured by Mitsui Petrochemical Industries, Ltd.), 1.4 parts by mass of an α-tocopherol, 5.84 parts by mass of tricresyl phosphate, and 1.63 parts by mass of calcium dodecylbenzenesulfonate (trade name: Pionin A-41-C, a 70% methanol solution, manufacture by Takemoto Oil & Fat Co., Ltd.) in 37.3 parts by mass of ethyl acetate.

On the other hand, 45.5 parts by mass of ion-exchanged water was blended into 49.3 parts by mass of the above-mentioned aqueous solution of gelatin for making an emulsion and thereafter the coupler blend liquid (V) obtained above was added. The resulting mixture was emulsified by means of a homogenizer (manufactured by Nippon Seiki Seisakusho Co., Ltd.) The coupler-dispersed emulsion thus obtained was heated under a reduced pressure to remove the ethyl acetate. After that, the concentration of the emulsion was adjusted so that the concentration of the solid components became 20% by mass. In this way, the coupler-dispersed emulsion (e) was obtained.

Coupler (E)

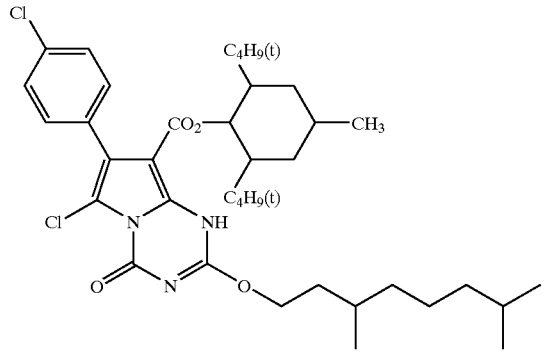

(Preparation of a Coupler-Dispersed Emulsion (f))

A blend liquid (VI) was prepared by dissolving 6.0 parts by mass of the following coupler (F), 1.9 parts by mass of triphenylguanidine (manufactured by Hodogaya Chemical Co., Ltd.), 11.5 parts by mass of tricresyl phosphate, and 0.8 parts by mass of calcium dodecylbenzenesulfonate (trade name: Pionin A-41-C, a 70% methanol solution, manufacture by Takemoto Oil & Fat Co., Ltd.) in 49 parts by mass of ethyl acetate.

On the other hand, 104 parts by mass of ion-exchanged water was blended into 77 parts by mass of the above-mentioned aqueous solution of gelatin for making an emulsion and thereafter the coupler blend liquid (VI) obtained above was added. The resulting mixture was emulsified by means of a homogenizer (manufactured by Nippon Seiki Seisakusho Co., Ltd.). The coupler-dispersed emulsion thus obtained was heated under a reduced pressure to remove the ethyl acetate. After that, the concentration of the emulsion was adjusted so that the concentration of the solid components became 17.5% by mass. In this way, the coupler-dispersed emulsion (f) was obtained.

Coupler (F)

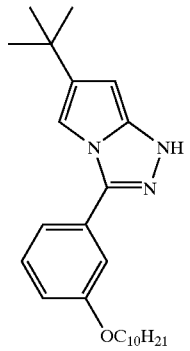

<Preparation of Coating Liquids for Heat-Sensitive>Recording Layers (Preparation of a Coating Liquid (G) for Magenta Heat-Sensitive Recording Layer)

The liquid (a) of microcapsules enclosing a diazonium salt and the coupler-dispersed emulsion (d) were mixed together such that the molar ratio of the enclosed coupler compound to the diazo compound was 2:1. Further, an aqueous solution (5% by mass) of polystyrenesulfonic acid (partially neutralized by calcium hydroxide), in a proportion of 0.2 parts by mass to 10 parts by mass of the liquid (a) of microcapsules enclosing a diazonium salt, was added. In this way, the coating liquid (G) for magenta heat-sensitive recording layer was obtained.

(Preparation of a Coating Liquid (H) for Cyan Heat-Sensitive Recording Layer)

The liquid (b) of microcapsules enclosing a diazonium salt and the coupler-dispersed emulsion (e) were mixed together such that the molar ratio of the enclosed coupler compound to the diazo compound was 3:1. Further, an aqueous solution (5% by mass) of polystyrenesulfonic acid (partially neutralized by calcium hydroxide), in a proportion of 0.1385 parts by mass to 10 parts by mass of the liquid (b) of microcapsules enclosing a diazonium salt, and water, in a proportion of 3.65 parts by mass to 10 parts by mass of the liquid (b) of microcapsules enclosing a diazonium salt, were added. In this way, the coating liquid (H) for cyan heat-sensitive recording layer was obtained.

(Preparation of a Coating Liquid (I) for Yellow Heat-Sensitive Recording Layer)

The liquid (c) of microcapsules enclosing a diazonium salt and the coupler-dispersed emulsion (f) were mixed together such that the molar ratio of the enclosed coupler compound to the diazo compound was 3:1. Further, water, in a proportion of 0.86 parts by mass to 10 parts by mass of the liquid (c) of microcapsules enclosing a diazonium salt, was added. Still further, 0.166 parts by mass of a fluorescent brightener (trade name: KEIKOL BXNL ((28% by mass), manufactured by Nippon Soda Co., Ltd.), which contained a 4,4'-bistriazinylaminostilbene-2,2'-disulfonic acid derivative, was added. In this way, the coating liquid (I) for yellow heat-sensitive recording layer was obtained.

<Preparation of a Coating Liquid for Intermediate Layer>

10.0 parts by mass of a 15% by mass aqueous solution of alkali-treated low-ion gelatin (trade name: No. 750 Gelatin, manufactured by Nitta Gelatin Inc.), 0.05 parts by mass of sodium 4-[(4-nonylphenoxy)-tri(oxyethylene)] butylsulfonate (a 2.0% by mass aqueous solution, manufactured by Sankyo Chemical Industries, Ltd.), 1.5 parts by mass of boric acid (a 4.0% by mass aqueous solution), 0.19 parts by mass of an aqueous solution (5% by mass ) of polystyrenesulfonic acid (partially neutralized by potassium hydroxide), 4.53 parts by mass of an aqueous solution (4% by mass) (manufactured by Wako Pure Chemical Industries, Ltd.) of a mixture of N,N'-ethylene-bis (vinylsulfonylacetamide), N,N'-trimethylene-bis (vinylsulfonylacetamide), and sodium citrate, and 0.67 parts by mass of ion-exchanged water were mixed together. The mixture was used as the coating liquid for intermediate layer.

<Preparation of a Coating Liquid for Light Transmittance-Adjusting Layer>

(Preparation of a Liquid of Microcapsules Enclosing an Ultraviolet Light Absorbent Precursor)

14.5 parts by mass of [2-allyl-6-(2H-benzotriazole-2-yl)-4-t-octylphenyl]benzenesulfonate as an ultraviolet light absorbent precursor, 5.0 parts by mass of 2,5-bis(t-octyl) hydroquinone, 1.9 parts by mass of tricresyl phosphate, 5.7 parts by mass of α-methylstyrene dimer (trade name: MSD-100, manufactured by Mitsui Chemicals, Inc.), and 0.45 parts by mass of calcium dodecylbenzenesulfonate (trade name: Pionin A-41-C, a 70% methanol solution, manufacture by Takemoto Oil & Fat Co., Ltd.) were dissolved in 71 parts by mass of ethyl acetate. To the resulting blend-solution was added 54.7 parts by mass of a xylylene diisocyanate/trimethylolpropane adduct (trade name: Takenate D110N (a 75% by mass ethyl acetate solution), manufactured by Takeda Chemical Industries, Ltd.) as a capsule wall-forming material and the resulting mixture was homogeneously stirred. In this way, a blend liquid (VII) of an ultraviolet light absorbent precursor was obtained.

On the other hand, an aqueous solution of PVA for the liquid of microcapsules enclosing an ultraviolet light absorbent precursor was prepared by blending 52 parts by mass of itaconic acid-modified polyvinyl alcohol (trade name: KL-318, manufactured by Kuraray Co., Ltd.) with 8.9 parts by mass of a 30% by mass aqueous solution of phosphoric acid and 532.6 parts by mass of ion-exchanged water.

The blend liquid (VII) of an ultraviolet light absorbent precursor was added to 516.06 parts by mass of the aqueous solution of PVA for the liquid of microcapsules enclosing an ultraviolet light absorbent precursor and the resulting mixture was emulsified by means of a homogenizer (manufactured by Nippon Seiki Seisakusho Co., Ltd.) at 20° C. Then, 254.1 parts by mass of ion-exchanged water was added to the emulsion obtained and the liquid was homogenized. Next, an encapsulation reaction was carried out by stirring the liquid at 40° C. for 3 hours. After that, 94.3 parts by mass of Amberlite MB-3 (manufactured by Organo Corporation) as an ion-exchange resin was added and the liquid was stirred for further one hour. The ion-exchange resin was then eliminated by filtration and the concentration of the capsule liquid was adjusted so that the concentration of the solid components became 13.5%. The particle diameter of the microcapsules obtained was 0.30 μm. Into 859.1 parts by mass of the capsule liquid thus obtained were blended 2.416 parts by mass of a carboxy-modified styrene/butadiene latex (trade name: SN-307 (a 48% by mass aqueous solution), manufactured by Sumitomo Naugatuck Co., Ltd.) and 39.5 parts by mass of ion-exchanged water. In this way, a liquid of microcapsules enclosing an ultraviolet light absorbent precursor was obtained.

(Preparation of a Coating Liquid for Light Transmittance-Adjusting Layer)

A coating liquid for light transmittance-adjusting layer was obtained by mixing 1000 parts by mass of the liquid of microcapsules enclosing an ultraviolet light absorbent precursor, 5.2 parts by mass of potassium N-(perfluoro-1-octanesulfonyl)-N-propylaminoacetate (trade name: Megafac F-120, manufactured by Dainippon Ink & Chemicals, Inc.) (a 5% by mass aqueous solution), 7.75 parts by mass of a 4% by mass aqueous solution of sodium hydroxide, and 73.39 parts by mass of sodium (4-nonylphenoxytrioxyethylene)butylsulfonate (a 2.0% by mass aqueous solution, manufactured by Sankyo Chemical Industries, Ltd.).

<Preparation of a Coating Liquid for Protective Layer>

(Preparation of a Polyvinyl Alcohol Solution for Protective Layer)

A homogeneous polyvinyl alcohol solution for protective layer was obtained by mixing 160 parts by mass of a vinyl alcohol/alkyl vinyl ether copolymer (trade name: EP-130, manufactured by Denki Kagaku Kogyo Kabushiki Kaisha), 8.74 parts by mass of a blend solution of a sodium alkylsulfonate and a polyoxyethylene alkyl ether phosphoric ester (trade name: Neoscore CM-57 (a 54% by mass aqueous solution), manufactured by Toho Chemical Industry Co., Ltd.), and 3832 parts by mass of ion-exchanged water and making the mixture into a solution at 90° C. by taking one hour.

(Preparation of a Pigment Dispersion Liquid for Protective Layer)

A mixture of 8 parts by mass of barium sulfate (trade name: BF-21F, having a barium sulfate content of 93% or more, manufactured by Sakai Chemical Industry Co., Ltd.), 0.2 parts by mass of an anionic special polycarboxylic acid type polymeric surfactant (trade name: Poise 532A (a 40% by mass aqueous solution), manufactured by Kao Corporation), and 11.8 parts by mass of ion-exchanged water was dispersed using a Dyno mill to thereby prepare a pigment dispersion liquid for protective layer. The median particle diameter of the dispersed particles of the dispersion liquid was found to be 0.30 μm or less as a result of measurement (by means of LA-910, manufactured by Horiba, Ltd.)

(Preparation of a Matting Agent Dispersion Liquid for Protective Layer)

A matting agent dispersion liquid for protective layer was prepared by blending 220 parts by mass of wheat starch (trade name: Komugi Denpun S, manufactured by Shinshin Shokuryo Kogyo Co., Ltd.), 3.81 parts by mass of an aqueous dispersion of 1-2-benzisothiazoline-3-one (trade name: PROXEL B.D, manufactured by ICI Limited), and 1976.19 parts by mass of ion-exchanged water and uniformly dispersing these components.

(Preparation of a Coating Blend Liquid for Protective Layer)

A coating blend liquid for protective layer was prepared by blending 1000 parts by mass of the polyvinyl alcohol solution for protective layer homogeneously with 40 parts by mass of potassium N-(perfluoro-1-octanesulfonyl)-N-propylaminoacetate (trade name: Megafac F-120, manufactured by Dainippon Ink & Chemicals, Inc.) (a 5% by mass aqueous solution), 50 parts by mass of sodium (4-nonylphenoxytrioxyethylene)butylsulfonate (a 2.0% by mass aqueous solution, manufactured by Sankyo Chemical Industries, Ltd.), 49.87 parts by mass of the pigment dispersion liquid for protective layer, 16.65 parts by mass of the matting agent dispersion liquid for protective layer, and 48.7 parts by mass of a zinc stearate dispersion liquid (trade name: Hydrin F115, a 20.5% by mass aqueous dispersion, manufactured by Chukyo Oil & Fat Co., Ltd.).

<Application of the Coating Liquids for the Heat-Sensitive Recording Layers>

The coating liquid (I) for yellow heat-sensitive recording layer, the coating liquid for intermediate layer, the coating liquid (H) for cyan heat-sensitive recording layer, the coating liquid for intermediate layer, the coating liquid (G) for magenta heat-sensitive recording layer, the coating liquid for light transmittance-adjusting layer, and the coating liquid for protective layer were applied, in that order, consecutively to the primer layer surface of the support so as to form 7 layers at the same time. The layers were dried under conditions of 30° C. and 30% RH and conditions of 40° C. and 30% RH, consecutively. In this way, the multicolor heat-sensitive recording material of Example 1 was obtained.

In the operation described above, the coating liquid (I) for yellow heat-sensitive recording layer was applied at a coating weight of 4.5 g/m$^2$ calculated as solid components, the coating liquid (H) for cyan heat-sensitive recording layer was applied at a coating weight of 6.7 g/m$^2$ calculated as solid components, and the coating liquid (G) for magenta heat-sensitive recording layer was applied at a coating weight of 4.71 g/m$^2$ calculated as solid components.

The coating liquid for intermediate layer was applied at a coating weight of 3.25 g/m$^2$ calculated as solid components, the coating liquid for light transmittance-adjusting layer was applied at a coating weight of 2.35 g/m$^2$ calculated as solid components, and the coating liquid for protective layer was applied at a coating weight of 1.39 g/m$^2$ calculated as solid components.

Example 2

The multicolor heat-sensitive recording material of Example 2 was obtained in the same way as in Example 1, except that the coating liquids for the heat-sensitive recording layers of Example 1 were applied at a coating weight of 5.40 g/m$^2$ calculated as solid components for the coating liquid (I) for yellow heat-sensitive recording layer, at a coating weight of 8.50 g/m$^2$ calculated as solid components for the coating liquid (H) for the cyan heat-sensitive recording layer, and at a coating weight of 5.70 g/m$^2$ calculated as solid components for the coating liquid (G) for magenta heat-sensitive recording layer.

Comparative Example 1

<Support Coated with a Primer Layer>

An aqueous solution of gelatin for primer layer was prepared by adding 40 parts by mass of enzyme-decomposed gelatin (having an average molecular weight of 10000, a viscosity of 1.5 mPa·s (15 mP) according to a PAGI method, and a jelly strength of 20 g according to a PAGI method) to 60 parts by mass of ion-exchanged water and dissolving the gelatin by stirring at 40° C.

Meanwhile, 8 parts by mass of water-swellable synthetic mica (aspect ratio: 1000, trade name: Somasif ME 100, manufactured by Co-op Chemical Co., Ltd.) was mixed with 92 parts by mass of water. The resulting mixture was subjected to a wet-dispersing treatment by means of a visco-mill. As a result, a mica dispersion liquid having an average particle diameter of 2.0 μm was obtained. Next, water in an amount to produce a mica concentration of 5% by mass was added to the mica dispersion liquid and the resulting mixture was homogenized by stirring. In this way, a desired mica dispersion liquid was prepared.

Next, 120 parts by mass of water and 556 parts by mass of methanol were added to 100 parts by mass of the 40% by mass aqueous solution of gelatin at 40° C. After these components were sufficiently mixed by stirring, 208 parts by mass of the 5% by mass mica dispersion liquid was added and these components were sufficiently mixed by stirring. After that, 9.8 parts by mass of a 1.66% by mass polyethylene oxide surfactant was added. The liquid was maintained at a temperature in the range of 35 to 40° C. and 7.3 parts by mass of ethylene diglycidyl diether as a gelatin hardener was added. In this way, a coating liquid (5.7% by mass) for primer layer was prepared.

The coating liquid for primer layer was applied to the surface of a transparent PET support (thickness: 160 μm) such that the coating weight of the mica of 0.2 g/m$^2$ was obtained. In this way, the primer layer was formed.

<Preparation of a Coating Liquid for Cyan Heat-Sensitive Recording Layer>

(Preparation of a Liquid (j) of Microcapsules Enclosing an Electron-Donating Dye Precursor)

5 parts by mass of 3-(o-methyl-p-dimethylaminophenyl)-3-(1'-ethyl-2'-methylindole-3-yl)phthalide (electron-donating dye precursor) was dissolved in 20 parts by mass of ethyl acetate. To this solution was added 20 parts by mass of isopropylbiphenyl (high-boiling solvent) and the resulting mixture was homogenized by stirring under heating.

To the solution thus obtained was added 20 parts by mass of a 1/3 adduct of xylylene diisocyanate/trimethylol propane and the resulting mixture was homogenized by stirring. And, this solution was used as an electron-donating colorless dye precursor solution.

On the other hand, a solution was prepared by adding 2 parts by mass of 2% by mass aqueous solution of sodium dodecylbenzenesulfonate to 54 parts by mass of the 6% by mass aqueous solution of phthalated gelatin. To this solution was added the electron-donating colorless dye precursor solution and the resulting mixture was emulsified by means of a homogenizer to therebyobtain an emulsified dispersion. Then, 68 parts by mass of water was added to the emulsified liquid and the liquid was homogenized by stirring. Next, an encapsulation reaction was carried out while stirring the liquid at 50° C. for 3 hours. In this way, a liquid (j) of microcapsules enclosing an electron-donating colorless dye precursor was obtained. The average particle diameter of the microcapsules was 1.6 μm.

(Preparation of a Dispersion Liquid (k) of an Electron-Accepting Compound)

30 parts by mass of 4,4'-(p-phenylenediisopropylidene) diphenol (trade name: Bisphenol P, manufactured by Mitsui Petrochemical Industries, Ltd.) as an electron-accepting compound was added to 150 parts by mass of a 4% by mass aqueous solution of gelatin. The resulting mixture was dispersed for 24 hours in a ball mill. In this way, the dispersion liquid (k) of an electron-accepting compound was obtained. The average particle diameter of the electron-accepting compound was 1.2 μm.

(Preparation of a Coating Liquid for Cyan Heat-Sensitive Recording Layer)

The liquid (j) of microcapsules enclosing an electron-donating colorless dye precursor and the dispersion liquid (k) of an electron-accepting compound were mixed together such that the ratio of the electron-donating colorless dye precursor/the electron-accepting compound was 1/10. Further, sodium dodecylbenzenesulfonate was added in an amount that would lead to a coating weight of 0.1 g/m$^2$ in the cyan heat-sensitive recording layer to be formed from the coating liquid for the cyan heat-sensitive recording layer. In this way, the desired coating liquid for the cyan heat-sensitive recording layer was prepared.

<Preparation of a Coating Liquid for Magenta Heat-Sensitive Recording Layer>

(Preparation of a Liquid (l) of Microcapsules Enclosing a Diazonium Salt)

2.0 parts of the diazonium salt compound (L) (decomposable by light having a wavelength of 365 nm) indicated by the following formula was dissolved in 20 parts by mass of ethyl acetate. To the solution were added 20 parts by mass of isopropylbiphenyl and 0.4 parts by mass of diphenyl-(2,4,6-trimethylbenzoyl)phosphine oxide (trade name: Lucilin TPO, manufactured by BASF Japan Co., Ltd). The mixture was heated and made into a homogeneous solution. To the solution thus obtained was added 15 parts by mass of a 1/3 adduct of xylylene diisocyanate/trimethylol propane (as a capsule wall-forming material) and the resulting mixture was homogenized by stirring and made into a solution. In this way, a solution of the diazonium salt was obtained.

The solution of the diazonium salt thus obtained was added to a solution that had been prepared by mixing 54 parts by mass of a 6% by mass aqueous solution of phthalated gelatin and 2 parts by mass of a 2% by mass aqueous solution of sodium dodecylbenzenesulfonate. The resulting mixture was emulsified by means of a homogenizer to thereby obtain an emulsified dispersion. Then, 68 parts by mass of water was added to the emulsified dispersion liquid and the liquid was homogenized. Next, an encapsulation reaction was carried out while stirring the liquid at 40° C. for 3 hours so that the average particle diameter of the microcapsules became 1.2 μm. After that, the liquid temperature was lowered to 35° C. To the liquid thus obtained were added 6.5 parts by mass of Amberlite IRA68 (manufactured by Organo Corporation) and 13 parts by mass of Amberlite IRC50 (manufactured by Organo Corporation) as ion-exchange resins and the liquid was stirred for further one hour. The ion-exchange resins were eliminated by filtration and the desired liquid (1) of microcapsules enclosing the diazonium salt was obtained.

Diazonium Salt (L)

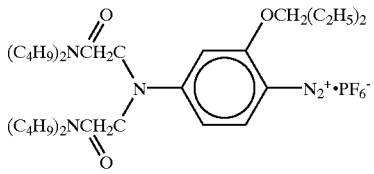

(Preparation of an Emulsion (m) of a Coupler)

2.0 parts by mass of the coupler (M) indicated by the following formula, 2.0 parts by mass of 1,2,3-triphenylguanidine, 2.0 parts by mass of 1,1-(p-hydroxyphenyl)-2-ethylhexane, 4.0 parts by mass of 4,4'-(m-phenylenediisopropylidene)diphenol, and 0.6 parts by mass of 3,3,3',3'-tetramethyl-5,5',6,6'-tetra(1-propyloxy)-1,1'-spirobisindan were dissolved in 10 parts by mass of ethyl acetate. The solution thus obtained was poured into an aqueous solution that had been prepared by mixing 20 parts by mass of a 6% by mass aqueous solution of gelatin and 2 parts by mass of a 2% by mass aqueous solution of sodium dodecylbenzenesulfonate. The resulting mixture was emulsified for 10 minutes by means of a homogenizer to thereby obtain an emulsion (m) of the coupler.

Coupler (M)

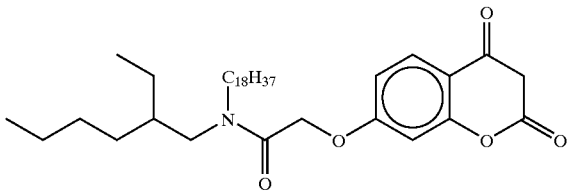

(Preparation of a Coating Liquid for Magenta Heat-Sensitive Recording Layer)

To the liquid (1) of microcapsules enclosing a diazonium was added an SBR latex (trade name "SN-307" manufactured by Sumitomo Naugatuck Co., Ltd.) in an amount of 40% by mass based on the capsule solid components. After that, the emulsion (m) of the coupler and the liquid (1) of microcapsules enclosing a diazonium salt were mixed together such that a blending ratio by mass of 3/2 was obtained. In this way, the coating liquid for magenta heat-sensitive recording layer was prepared.

<Preparation of a Coating Liquid for Yellow Heat-Sensitive Recording Layer>

(Preparation of a Liquid (n) of Microcapsules Enclosing Diazonium Salts)

In 16.4 parts by mass of ethyl acetate were dissolved 3.5 parts by mass of the following diazonium salt (N1) and 0.9 parts by mass of the following diazonium salt (N2) as diazonium salts each having a maximum absorption wavelength for decomposition at 420 nm. To the resulting solution were added high-boiling solvents, i.e., 9.8 parts by mass of isopropylbiphenyl and 0.4 parts by mass of diphenyl-(2,4,6-trimethylbenzoyl)phosphine oxide (trade name: Lucilin TPO, manufactured by BASF Japan Co., Ltd). The mixture was heated and made into a homogeneous solution by stirring. To the solution thus obtained were added 4.5 parts by mass of a xylylene diisocyanate/trimethylol propane adduct (a 75% by mass ethyl acetate solution, Takenate D110N, manufactured by Takeda Chemical Industries, Ltd.) and 4.2 parts by mass of a 30% by mass ethyl acetate solution of a xylylene diisocyanate/bisphenol A adduct as capsule wall forming materials, and the resulting mixture was homogenized by stirring.

On the other hand, 0.36 parts by mass of Scraph AG-8 (manufactured by Nippon Fine Chemical Co., Ltd.) was added to 77 parts by mass of a 6% by mass aqueous solution of gelatin to prepared a solution. To this solution was added the above-mentioned solution of the diazonium salts and the resulting mixture was emulsified by means of a homogenizer. Then, 20 parts by mass of water was added to the emulsified liquid and the liquid was homogenized. Next, an encapsulation reaction was carried out while stirring the liquid at 40° C. for 3 hours. After that, the liquid temperature was lowered to 35° C. and 6.5 parts by mass of Amberlite IRA68 (manufactured by Organo Corporation) and 13 parts of Amberlite IRC50 (manufactured by Organo Corporation) were added as ion-exchange resins and the liquid was stirred for further one hour. The ion-exchange resins were then eliminated by filtration. Then, to the filtrate was added a 1% by mass hydroquinone aqueous solution in a proportion of 0.4 parts by mass based on 10 parts by mass of the capsules and the resulting mixture was stirred. In this way, the desired liquid (n) of microcapsules enclosing diazonium salts was obtained. The average particle diameter of the capsules was 0.91 $\mu$m Diazonium Salt (N1)

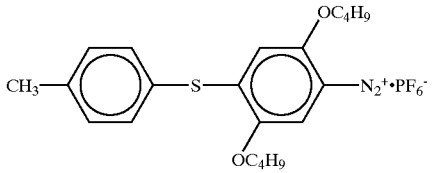

Diazonium Salt (N2)

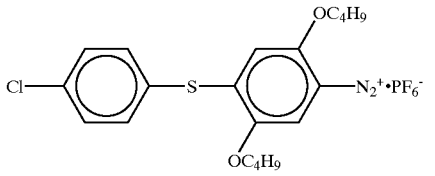

(Preparation of a Coupler Emulsion (o))

2.4 parts by mass of the following coupler (O), 2.5 parts by mass of triphenylguanidine, 2.5 parts by mass of 1-1-(p-hydroxyphenyl)-2-ethylhexane, 3.6 parts by mass of 4,4'-(m-phenylenediisopropylidene)diphenol, 3.2 parts by mass of 2-ethylhexyl-4-hydroxybenzoate, and 0.8 parts by mass of 3,3,3',3'-tetramethyl-5,5',6,6'-tetra(1-propyloxy)-1,1'-spirobisindan were dissolved in 8.0 parts by mass of ethyl acetate. To this solution was added 1.0 part by mass of Pionin A-41-C (manufactured by Takemoto Oil & Fat Co., Ltd.) and the resulting mixture was made into a homogeneous solution under heating by stirring. This solution was added to 75 parts by mass of a 10% by mass aqueous solution of gelatin (No. 750 Gelatin, manufactured by Nitta Gelatin Inc.) and was emulsified by means of a homogenizer. The remaining ethyl acetate was distilled off from this emulsion. In this way, the desired coupler-dispersed emulsion (o) was obtained.

Coupler (O)

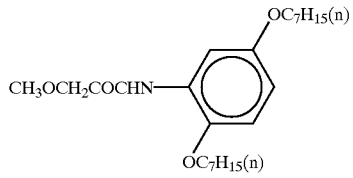

(Preparation of a Coating Liquid for yellow Heat-Sensitive Recording Layer)

The liquid (n) of microcapsules enclosing diazonium salts, the coupler emulsion (o), and a styrene/butadiene rubber (SN-307 manufactured by Sumitomo Naugatuck Co., Ltd.) were mixed such that ratio of the diazonium salt to the coupler was 1/3.2 and the mass of the styrene/butadiene rubber was equal to the mass of the gelatin of the coating liquid. In this way, the coating liquid for yellow heat-sensitive recording layer was prepared.

<Preparation of a Coating Liquid for Intermediate Layer>

A coating liquid for intermediate layer was prepared by adding 2 parts by mass of a 2% by mass aqueous solution of sodium (4-nonylphenoxytrioxyethylene)butylsulfonate to 100 parts by mass of a 10% by mass aqueous solution of gelatin (No. 750 Gelatin, manufactured by Nitta Gelatin Inc.).

<Preparation of a Coating Liquid for Light Transmittance-Adjusting Layer>

(Preparation of a Liquid of Microcapsules Enclosing an Ultraviolet Light Absorbent Precursor)

10 parts by mass of [2-allyl-6-(2H-benzotriazole-2-yl)-4-t-octylphenyl]benzenesulfonate as an ultraviolet light absorbent precursor, 3 parts by mass of 2,5-di-t-octylhydroquinone, 2 parts of tricresyl phosphate, and 4 parts of $\alpha$-methylstyrene dimer were dissolved in 30 parts of ethyl acetate. To the resulting solution was added 20 parts by mass of a xylylene diisocyanate/trimethylolpropane adduct (a 75% ethyl acetate solution, trade name: Takenate D110N, manufactured by Takeda Chemical Industries, Ltd.) as a capsule wall forming material and the resulting mixture was homogeneously stirred.

On the other hand, 200 parts by mass of a 8% by mass aqueous solution of itaconic acid-modified polyvinyl alcohol (KL-318, manufactured by Kuraray Co., Ltd.) was prepared. The above-mentioned solution containing the ultraviolet light absorbent precursor was added to the 8% by mass aqueous solution of itaconic acid-modified polyvinyl alcohol and the resulting mixture was emulsified by means of a homogenizer. Then, 120 parts by mass of water was added to the emulsified liquid and the liquid was homogenized. Next, an encapsulation reaction was carried out while stirring the liquid at 40° C. for 3 hours. After that, 7.0 parts by mass of Amberlite MB-3 (manufactured by Organo Corporation) as an ion-exchange resin was added and the liquid was stirred for further one hour. In this way, the desired liquid of microcapsules enclosing the ultraviolet light absorbent precursor was obtained. The average particle diameter of the microcapsules was found to be 0.3 $\mu$m.

<Preparation of a Coating Liquid for Light Transmittance-Adjusting Layer>

A coating liquid for light transmittance-adjusting layer was obtained by adding 10 parts by mass of a 2% by mass aqueous solution of sodium (4-nonylphenoxytrioxyethylene)butylsulfonate to 100 parts by mass of the liquid of microcapsules enclosing the ultraviolet light absorbent precursor.

<Preparation of a Coating Liquid for Protective Layer>

A coating liquid for protective layer was prepared by mixing 100 parts by mass of a 7% by mass aqueous solution of a vinyl alcohol/alkyl vinyl ether copolymer (trade name: EP-130, manufactured by Denki Kagaku Kogyo Kabushiki Kaisha), 50 parts by mass of water, 10 parts by mass of a 20% by mass dispersion liquid of barium sulfate (trade name: BF-21F, manufactured by Sakai Chemical Industry Co., Ltd.), 5 parts by mass of a 2.0% by mass aqueous solution of sodium (4-nonylphenoxytrioxyethylene) butylsulfonate, and 5 parts by mass of a 5.0% by mass aqueous solution of potassium N-(perfluoro-1-octanesulfonyl)-N-propylaminoacetate.

<Manufacture of Heat-Sensitive Recording Materials for Comparison>

A multicolor heat-sensitive recording material of Comparative Example 1 was obtained by applying the coating liquid for cyan heat-sensitive recording layer, the coating liquid for intermediate layer, the coating liquid for magenta heat-sensitive recording layer, the coating liquid for intermediate layer, the coating liquid for yellow heat-sensitive recording layer, the coating liquid for light transmittance-adjusting layer, and the coating for protective layer, in that order, to the surface of the primer layer on the support by a multilayer application method and drying the layers. The application was made such that the coating weights were 7.12 g, 3.28 g, 8.33 g, 3.13 g, 8.06 g, 2.50 g, and 1.23 g per $m^2$ for the layers, respectively, in the order starting from the coating liquid for cyan heat-sensitive recording layer.

<<Evaluation>>

The heat-sensitive recording materials of Examples 1 and 2 and the heat-sensitive recording material of Comparative Example 1 were evaluated according to the following methods. The results are shown in Table 1. The heat-sensitive layers were designated as the first heat-sensitive layer, the second heat-sensitive layer, and the third heat-sensitive layer, respectively, in the order enumerated from the protective layer side.

<Haze Value>

The haze values of the multicolor heat-sensitive recording materials obtained were measured using a haze meter (HGM-2DP, manufactured by Suga Test Instruments Co., Ltd. The results are shown in Table 1.

TABLE 1

| Support | Example 1 not greater than 10 | Example 2 not greater than 10 | Comparative example 1 not greater than 10 |
|---|---|---|---|
| The first heat-sensitive layer + protective layer | 30 | 35 | 30 |
| The second heat-sensitive layer + protective layer | 30 | 38 | 30 |
| The third heat-sensitive layer + protective layer | 20 | 25 | 60 |
| Light transmittance-adjusting layer + protective layer | 20 | 20 | 20 |
| Intermediate layer + protective layer | 20 | 20 | 20 |
| Overall layers | 45 | 48 | 70 |

<Hue>

The first heat-sensitive layer, the second heat-sensitive layer, and the third heat-sensitive layer were separately caused to develop a color so that the transmission density of the single color was 0.9 and transmission spectra were evaluated by means of UV3100 manufactured by Shimadzu Corporation. Examples 1 and 2 each gave a narrower half band width and thus proved superior to Comparative Example 1.

<Degree of Whiteness>

The multicolor heat-sensitive recording materials of Example 1, Example 2, and Comparative Example 1 were separately placed on a sheet of woodfree paper having the same degree of whiteness and the degrees of the whiteness were measured by means of X-Rite 938 manufactured by Nippon Heiban Kizai Co., Ltd. Examples 1 and 2 each gave a higher degree of whiteness and thus proved superior to Comparative Example 1.

TABLE 2

| | Hue | degree of whiteness |
|---|---|---|
| Example 1 | good | good |
| Example 2 | good | good |
| Comparative example 1 | poor | poor |

The heat-sensitive recording materials of Examples 1 and 2 each gave a haze value not greater than 40 and were superior in fixing time, hue, and degree of whiteness. By contrast, the heat-sensitive recording material of Comparative Example 1, which comprised a support, a cyan heat-sensitive recording layer, a magenta heat-sensitive recording layer, and a yellow heat-sensitive recording layer laminated, in that order, wherein a leuco dye was used in the cyan heat-sensitive recording layer, gave a haze value greater than 40 and the results were unsatisfactory in terms of fixing time, hue, and degree of whiteness.

What is claimed is:

1. A multicolor heat-sensitive recording material comprising a support having disposed thereon at least a yellow-forming heat-sensitive recording layer, a cyan-forming heat-sensitive recording layer, and a magenta-forming heat-sensitive recording layer, wherein when any one of the heat-sensitive recording layers is disposed on a transparent support and a protective layer is disposed on the any one of the heat-sensitive recording layers, a haze value of the resultant laminate is no greater than 40.

2. The multicolor heat-sensitive recording material of claim 1, further comprising an intermediate layer, wherein when the intermediate layer is disposed on a transparent support and a protective layer is disposed on the intermediate layer, a haze value of the resultant laminate is no greater than 40.

3. The multicolor heat-sensitive recording material of claim 1, further comprising a light transmittance-adjusting layer, wherein when the light transmittance-adjusting layer is disposed on a transparent support and a protective layer is disposed on the light transmittance-adjusting layer, a haze value of the resultant laminate is no greater than 40.

4. The multicolor heat-sensitive recording material of claim 2, further comprising a light transmittance-adjusting layer, wherein when the light transmittance-adjusting layer is disposed on a transparent support and a protective layer is disposed on the light transmittance-adjusting layer, a haze value of the resultant laminate is no greater than 40.

5. The multicolor heat-sensitive recording material of claim 1, wherein each heat-sensitive recording layer contains a diazo compound and/or a diazonium salt and a coupler compound that reacts with the diazo compound and/or the diazonium salt to form the respective colors.

6. The multicolor heat-sensitive recording material of claim 2, wherein each heat-sensitive recording layer contains a diazo compound and/or a diazonium salt and a coupler compound that reacts with the diazo compound and/or the diazonium salt to form the respective colors.

7. The multicolor heat-sensitive recording material of claim 3, wherein each heat-sensitive recording layer contains a diazo compound and/or a diazonium salt and a coupler compound that reacts with the diazo compound and/or the diazonium salt to form the respective colors.

8. The multicolor heat-sensitive recording material of claim 4, wherein each heat-sensitive recording layer contains a diazo compound and/or a diazonium salt and a coupler compound that reacts with the diazo compound and/or the diazonium salt to form the respective colors.

9. The multicolor heat-sensitive recording material of claim 1, wherein when any one of the heat-sensitive recording layers is disposed on a transparent support and a protective layer is disposed on the any one of the heat-sensitive recording layers, a haze value of the resultant laminate is no greater than 30.

10. The multicolor heat-sensitive recording material of claim 2, wherein when the intermediate layer is disposed on a transparent support and a protective layer is disposed on the intermediate layer, a haze value of the resultant laminate is no greater than 30.

11. The multicolor heat-sensitive recording material of claim 3, wherein when the light transmittance-adjusting layer is disposed on a transparent support and a protective layer is disposed on the light transmittance-adjusting layer, a haze value of the resultant laminate is no greater than 30.

12. The multicolor heat-sensitive recording material of claim 1, wherein the haze value of the support is no greater than 10.

13. A multicolor heat-sensitive recording material comprising a transparent support having disposed thereon a yellow-forming heat-sensitive recording layer, a cyan-forming heat-sensitive recording layer, a magenta-forming heat-sensitive recording layer, and a protective layer, wherein the haze value of the recording material is no greater than 50.

14. The multicolor heat-sensitive recording material of claim 13, wherein each heat-sensitive recording layer contains a diazo compound and/or a diazonium salt and a coupler compound that reacts with the diazo compound and/or the diazonium salt to form the respective colors.

15. The multicolor heat-sensitive recording material of claim 13, wherein the haze value of the recording material is no greater than 40.

16. The multicolor heat-sensitive recording material of claim 13, wherein the haze value of the transparent support is no greater than 10.

17. The multicolor heat-sensitive recording material of claim 13, further comprising an intermediate layer.

18. The multicolor heat-sensitive recording material of claim 13, further comprising a light transmittance-adjusting layer.

* * * * *